US010857829B2

(12) United States Patent
Maehira et al.

(10) Patent No.: US 10,857,829 B2
(45) Date of Patent: Dec. 8, 2020

(54) DISPLAY MEMBER, BOOKLET, ID CARD, METHOD OF MANUFACTURING DISPLAY MEMBER, AND APPARATUS FOR MANUFACTURING DISPLAY MEMBER

(71) Applicant: TOPPAN PRINTING CO., LTD., Tokyo (JP)

(72) Inventors: Makoto Maehira, Tokyo (JP); Masami Inokuchi, Tokyo (JP); Mizuki Yanagimoto, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 16/522,434

(22) Filed: Jul. 25, 2019

(65) Prior Publication Data

US 2019/0344601 A1 Nov. 14, 2019

Related U.S. Application Data

(63) Continuation of application No. PCT/JP2018/009087, filed on Mar. 8, 2018.

(30) Foreign Application Priority Data

Mar. 9, 2017 (JP) ..... 2017-045328
Mar. 9, 2017 (JP) ..... 2017-045329
Sep. 27, 2017 (JP) ..... 2017-186286

(51) Int. Cl.
*B42D 25/342* (2014.01)
*B42D 25/00* (2014.01)
(Continued)

(52) U.S. Cl.
CPC ..... *B42D 25/342* (2014.10); *B41J 2/04* (2013.01); *B41J 2/32* (2013.01); *B41M 3/14* (2013.01);
(Continued)

(58) Field of Classification Search
CPC ..... B42D 2035/14; B42D 2035/16; B42D 2035/26
See application file for complete search history.

(56) References Cited

U.S. PATENT DOCUMENTS 5,932,318 A * 8/1999 Uchiyama ..... B41C 1/14 283/117
6,089,614 A 7/2000 Howland et al.
(Continued)

FOREIGN PATENT DOCUMENTS

JP S53-28443 A 3/1978
JP H06-106740 A 4/1994
(Continued)

OTHER PUBLICATIONS

International Searching Authority, "Written Opinion," issued in connection with International Patent Application No. PCT/JP2018/009087, dated May 15, 2018.
(Continued)

*Primary Examiner* — Kyle R Grabowski
(74) *Attorney, Agent, or Firm* — Foley & Lardner LLP

(57) ABSTRACT

A display member includes: a surface which is an observation object; a first image pattern which is covered by the surface and displays, through the surface, a first image including one or more first information elements for identifying an owner of the display member; a second image pattern which is covered by the surface and in which one or more second information elements are embedded, a part of the second image pattern restricting identification of the one or more second information elements, the second image pattern including a second image that differs from the first image and is for identifying the owner of the display member; and a concealment pattern that is located between the second image pattern and the surface and removes the
(Continued)

restriction on identification of the one or more second information elements by concealing the part of the second image pattern.

13 Claims, 28 Drawing Sheets

(51) Int. Cl.

| | |
|---|---|
| ***B42D 25/328*** | (2014.01) |
| ***B42D 25/373*** | (2014.01) |
| ***B41J 2/04*** | (2006.01) |
| ***B41J 2/32*** | (2006.01) |
| ***B41M 3/14*** | (2006.01) |
| ***G03G 15/01*** | (2006.01) |
| *B42D 25/23* | (2014.01) |
| *B42D 25/24* | (2014.01) |

(52) U.S. Cl.
CPC ..... *B42D 25/00* (2014.10); *B42D 25/328* (2014.10); *B42D 25/373* (2014.10); *G03G 15/01* (2013.01); *B42D 25/23* (2014.10); *B42D 25/24* (2014.10)

(56) References Cited

U.S. PATENT DOCUMENTS 6,546,128 B1 * 4/2003 Uchiyama ..... B41C 1/14 283/117
7,807,254 B2 * 10/2010 Bi ..... B41M 3/14 283/72
8,444,181 B2 * 5/2013 Wicker ..... B41M 3/14 283/113
2003/0030271 A1 * 2/2003 Wicker ..... B41M 3/14 283/113
2004/0022967 A1 * 2/2004 Lutz ..... B41M 3/14 428/29
2006/0274392 A1 * 12/2006 Schilling ..... G02B 5/1819 359/13
2010/0253059 A1 * 10/2010 Hansen ..... B42D 25/351 283/75
2018/0050555 A1 * 2/2018 Berthe ..... B42D 25/41

FOREIGN PATENT DOCUMENTS

| | | | | |
|---|---|---|---|---|
| JP | H09-156199 | A | 6/1997 | |
| JP | 2004-195818 | A | 7/2004 | |
| JP | 2011-081165 | A | 4/2011 | |
| JP | 2011-152652 | A | 8/2011 | |
| WO | WO-97/47478 | A1 | 12/1997 | |
| WO | WO-2011/141858 | A | 11/2011 | |
| WO | WO-2012069547 | A1 * | 5/2012 | ..... B41M 3/148 |

OTHER PUBLICATIONS

Extended European Search Report dated Feb. 5, 2020 for corresponding Application No. 18764474.5.

* cited by examiner

DISPLAY MEMBER, BOOKLET, ID CARD, METHOD OF MANUFACTURING DISPLAY MEMBER, AND APPARATUS FOR MANUFACTURING DISPLAY MEMBER

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2018/009087, filed on Mar. 8, 2018, which is based upon and claims the benefit of priority to Japanese Patent Application Nos. 2017-045328, filed on Mar. 9, 2017, 2017-045329, filed on Mar. 9, 2017, and 2017-186286, filed on Sep. 27, 2017; the disclosures of which are all incorporated herein by reference in their entireties.

TECHNICAL FIELD

The present invention relates to a display member, a booklet, an ID card, a method of manufacturing a display member, and an apparatus for manufacturing a display member.

BACKGROUND ART

A display member, such as a passport or an ID card, which is used to authenticate an individual, includes information associated with an owner of the display member, for example, a facial image. The facial image of the owner is formed on a substrate of the display member, for example, by an intermediate transfer method. In the intermediate transfer method, first, a facial image of the owner is printed on an image receiving layer of a transfer foil using ink, and next, the facial image on the image receiving layer is transferred together with the image receiving layer to the substrate which is an object to which the facial image is to be transferred. Thus, the facial image of the owner is formed on the display member (see, for example, PTL 1).

[Citation List] [Patent Literature] [PTL 1] JP 2011-152652 A

SUMMARY OF THE INVENTION

Technical Problem

In some cases, the above display member is falsified by the following method. Specifically, together with the ink constituting the facial image, the image receiving layer is peeled off from the substrate, followed by removal of the ink from the image receiving layer. Then, after a false facial image is printed on the image receiving layer from which the ink has been removed, the image receiving layer is bonded to the substrate again. Thus, the display member is falsified. Accordingly, better prevention of such falsification of the display member is needed.

Such a problem is not limited to the display members manufactured by the intermediate transfer method, but the problem is common also to methods of manufacturing a display member manufactured by directly printing an image on a substrate of the display member.

An object of the present invention is to provide a display member, a booklet, an ID card, a method of manufacturing a display member, and an apparatus for manufacturing a display member that are capable of better preventing falsification.

Solution to Problem

An display member for solving the above problem includes: a surface which is an observation object; a first image pattern which is covered by the surface and displays, through the surface, a first image including one or more first information elements for identifying an owner of the display member; a second image pattern which is covered by the surface and in which one or more second information elements are embedded, a part of the second image pattern restricting identification of the one or more second information elements, the second image pattern including a second image that differs from the first image and is for identifying the owner of the display member; and a concealment pattern that is located between the second image pattern and the surface and removes the restriction on identification of the one or more second information elements by concealing the part of the second image pattern.

A booklet for solving the above problem includes the display member.

An ID card for solving the above problem includes the display member.

According to the above configuration, the restriction on identification of the second information element embedded in the second image pattern is removed by the concealment of the part of the second image pattern by the concealment pattern. Thus, as compared with a configuration in which the second information element can be identified only by the second image pattern, falsification of the display member can be better prevented.

The display member may further include a diffraction portion that is located between the concealment pattern and the surface, and has asperities and is configured to emit diffracted light. According to the above configuration, since the display member includes the diffraction portion, falsification of the display member becomes more difficult. This can consequently better prevent falsification of the display member.

The display member may be configured such that in plan view of the surface, the diffraction portion covers at least a part of at least one of the first image pattern and the concealment pattern. According to the above configuration, a diffraction image formed by the diffracted light emitted from the diffraction portion overlaps at least one of the first image produced by the first image pattern and the second information element for which the restriction on identification has been removed by the overlapping of the second image pattern with the concealment pattern. This improves designability of the display member. Furthermore, since the first image or the second information element needs to be aligned with the diffraction image, falsification of the display member becomes more difficult. This can consequently better prevent falsification of the display member.

The display member may be configured such that the concealment pattern is formed of metal. According to the above configuration, the concealment pattern can be formed by etching a metal film.

The display member may be configured such that at least one of the first image pattern and the second image pattern includes overlapping dots in which a plurality of printed dots overlap each other.

As a printing method, a dot-on-dot method can be used to form overlapping dots in which a plurality of printed dots overlap each other. According to the above configuration, when the one of the first image pattern and the second image pattern that includes overlapping dots has been formed by a printing method different from the dot-on-dot method, it can be determined, according to the shape of the printed dots constituting the image pattern, whether the display member has been falsified.

The display member may be configured such that the concealment pattern includes a plurality of concealing portions having a dot shape or a line shape; and the concealing portions are arranged at regular intervals in an arrangement direction. According to the above configuration, the concealing portions having the same shape are arranged at regular intervals in one direction. Thus, as compared with a case where the concealing portions have random shapes or a case where the concealing portions are randomly arranged, the concealment pattern can be easily formed.

The display member may further include: a first sheet; and a second sheet that differs from the first sheet and is for verification, and may be configured such that the first sheet includes the first image pattern and the second image pattern; the second sheet includes the concealment pattern; and the second sheet is movable between a first position and a second position, the first position being a position for concealing a part of the second image pattern by the concealment pattern, the second position being a position for removing the concealment performed by the concealment pattern.

According to the above configuration, by changing a position of the second sheet between the first position and the second position, a state of the second information element embedded in the second image pattern can be changed between a state in which identification of the second information element is restricted and a state in which identification of the second information element is released.

A method of manufacturing a display member for solving the above problem includes the steps of: generating print information according to a position of a concealment pattern for concealing one or more of a plurality of printed dots, the print information indicating positions of the plurality of printed dots; forming the plurality of printed dots on a surface of a print object based on the print information; and manufacturing a display member by overlapping the concealment pattern with the plurality of printed dots, one or more of the plurality of printed dots being concealed by the concealment pattern in the display member. The step of generating print information includes generating information on positions of the plurality of printed dots according to a position of the concealment pattern so that in plan view of the surface, the one or more of the plurality of printed dots of the display member overlap the concealment pattern and the display member displays an image having a different color tone than an image produced by the plurality of printed dots when the concealment pattern is not present.

An apparatus for manufacturing a display member for solving the above problem includes: an information generation section that generates print information according to a position of a concealment pattern for concealing one or more of a plurality of printed dots, the print information indicating positions of the plurality of printed dots; a forming section that forms the plurality of printed dots on a surface of a print object based on the print information; and an overlapping section that overlaps the concealment pattern with the plurality of printed dots so that one or more of the plurality of printed dots are concealed by the concealment pattern. The information generation section generates information on positions of the plurality of printed dots according to a position of the concealment pattern so that in plan view of the surface, the one or more of the plurality of printed dots of the print object overlap the concealment pattern and the display member displays an image having a different color tone than an image produced by the plurality of printed dots when the concealment pattern is not present.

According to the above configuration, the image produced by the overlapping of the one or more of the plurality of printed dots with the concealment pattern differs in color tone from the image produced only by the plurality of printed dots. Thus, an image having the same color tone as the image displayed by the display member cannot be displayed unless positions of printed dots and a position of a concealment pattern are both the same as those of the genuine display member. This makes falsification of the display member more difficult than falsification of a display member in which an image having a predetermined color tone is produced only by a plurality of printed dots. This can better prevent falsification of the display member.

The method of manufacturing a display member may be configured such that the plurality of printed dots include at least a plurality of printed dots of a first color and a plurality of printed dots of a second color; and the step of generating print information includes generating information on positions of the plurality of printed dots according to a position of the concealment pattern so that in plan view of the surface, among the plurality of printed dots of the display member, at least one or more of the plurality of printed dots of the first color overlap the concealment pattern, and so that the display member displays an image having a different color tone than an image produced by the plurality of printed dots when the concealment pattern is not present.

According to the above configuration, among the printed dots of two or more colors, at least one or more of the printed dots of only a single color overlap the concealment pattern, and thus the color tone of the image produced by the overlap has a different hue from the color tone of the image produced only by the printed dots. Accordingly, as compared with a configuration in which the color tone of the image produced by the overlapping of the printed dots with the concealment pattern differs only in brightness from the color tone of the image produced only by the printed dots, it is more difficult to cause, by falsification of the display member, the falsified display member to produce the same color tone as the genuine display member. As a result, it is possible to better prevent falsification of the display member.

The method of manufacturing a display member may be configured such that the printed dots include first printed dots for displaying a first image and second printed dots for displaying a second image; and the step of generating print information includes: generating information on positions of the first printed dots according to a position of the concealment pattern so that in plan view of the surface, one or more of the first printed dots of the display member overlap the concealment pattern and the display member displays the first image having a different color tone than an image produced by the printed dots when the concealment pattern is not present; and generating information on positions of the second printed dots according to a position of the concealment pattern so that in plan view of the surface, one or more of the second printed dots of the display member overlap the concealment pattern and the display member displays the second image having a different color tone than an image produced only by the printed dots when the concealment pattern is not present.

According to the above configuration, of the printed dots, one or more of the first printed dots and one or more of the second printed dots overlap the concealment pattern, and the overlapping of the first printed dots with the concealment pattern and the overlapping of the second printed dots with the concealment pattern each cause the display member to display an image having a different color tone than an image produced only by the printed dots. This makes falsification of the display member more difficult than falsification of a configuration in which the display member produces only one image having a different color tone than an image produced only by the printed dots. This can consequently further better prevent falsification of the display member.

The method of manufacturing a display member may be configured such that the display member is a medium for authenticating an owner of the display member; and the step of generating print information includes generating information on positions of the plurality of printed dots according to a position of the concealment pattern so that in plan view of the surface, the one or more of the plurality of printed dots of the display member overlap the concealment pattern and the display member displays an image that is related to the owner and has a different color tone than an image produced by the plurality of printed dots when the concealment pattern is not present.

According to the above configuration, information on the owner cannot be displayed unless positions of printed dots and a position of a concealment pattern are both the same as those of the genuine display member. Therefore, even if the display member is falsified, by determining whether the display member displays information on the owner, it is easily determined whether the display member is a false display member obtained by falsification.

The method of manufacturing a display member may be configured such that the image produced only by the plurality of printed dots when the concealment pattern is not present includes a facial image of the owner and a background image located around the facial image; and the one or more of the plurality of printed dots overlapping the concealment pattern form a part of the background image.

According to the above configuration, since the printed dots overlapping the concealment pattern are a part of the background image of the image produced only by the printed dots, when the display member is falsified, the printed dots are more likely to be removed from the display member together with the facial image of the display member. Once the printed dots are removed, it is difficult to display the image produced by the overlapping of the concealment pattern with the printed dots, unless positions of printed dots and a position of a concealment pattern are the same as those of the genuine display member. This can better prevent falsification of the display member.

Advantageous Effects of the Invention

According to the present invention, it is possible to better prevent falsification of a display member, booklet, or ID card.

DETAILED DESCRIPTION OF REPRESENTATIVE EMBODIMENTS

Figure 1:
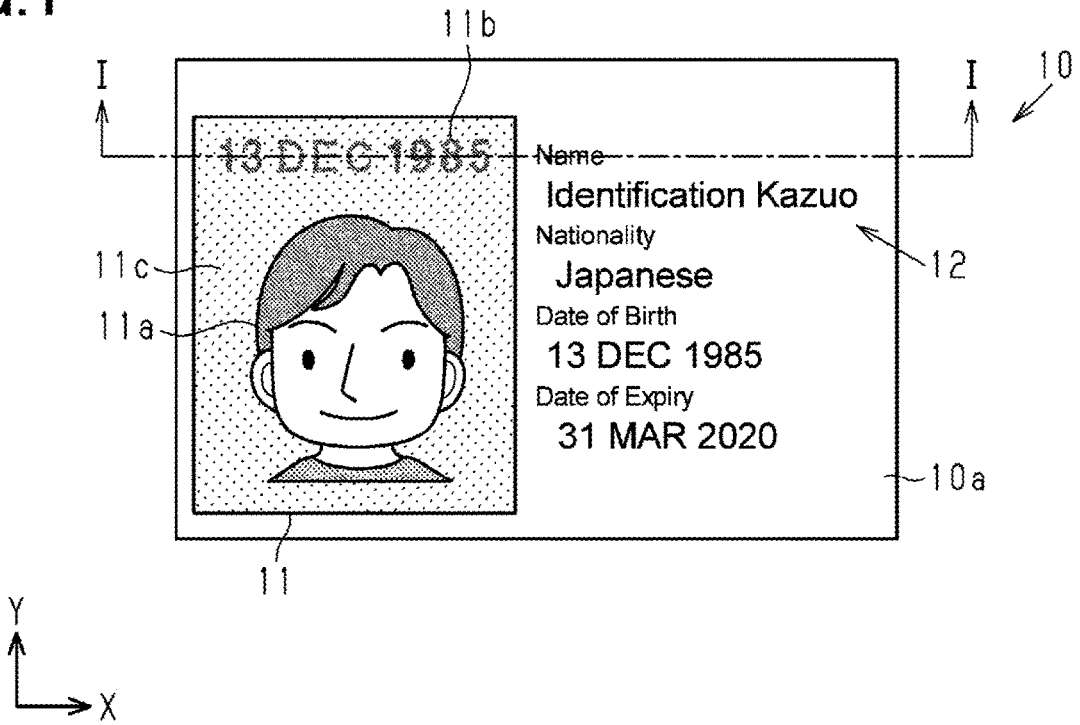
FIG. 1 is a plan view showing a structure of a display member manufactured by a method of manufacturing a display member.

With reference to the accompanying Figures, a description will now be given of representative embodiments according to the present invention. The present invention is not limited to the following representative embodiments, and appropriate modifications can be made without departing from the spirit of the present invention. The representative embodiments described below are merely examples of the present invention, and the design thereof could be appropriately changed by one skilled in the art. Here, the drawings are schematic, and the relationship between thickness and plane size, the ratio of the thickness of each layer, etc., are different from actual ones. The embodiments described below are merely examples of the configurations for embodying the technical idea of the present invention, and the technical idea of the present invention should not limit the materials, shapes, structures, and the like of the components to those described below. The technical idea of the present invention can be modified in various ways within the technical scope specified by the claims.

The same constituent elements are denoted by the same reference numerals unless there is a reason for the sake of convenience, and redundant description is omitted. In the drawings referred to in the following description, for clarity, characteristic parts are enlarged, and thus the components are not shown to scale. It is, however, clear that one or more embodiments can be implemented without such details. In addition, known structures and devices may be schematically represented for simplicity.

First Embodiment

A first embodiment of a display member, a booklet, an ID card, a method of manufacturing a display member, and an apparatus for manufacturing a display member will be described with reference to FIGS. 1 to 17. A configuration of the display member, a configuration of an intermediate transfer apparatus which is an example of the apparatus for manufacturing a display member, the method of manufacturing a display member, and an example will be sequentially described below.

[Configuration of Display Member]

A configuration of a display member manufactured by the method of manufacturing a display member will be described with reference to FIGS. 1 and 2. As an example of the display member, an example will be described below in which the display member is embodied as a personal authentication medium such as a page of a passport or an ID card.

As shown in FIG. 1, in plan view of a front surface 10*a* of a display member 10, the display member 10 has a sheet shape extending across an XY plane including an X direction which is one direction and a Y direction which is a direction orthogonal to the X direction. In plan view of the front surface 10*a*, in the display member 10, a face authentication image 11 and a character authentication image 12 are arranged along the X direction.

The character authentication image 12 is an image including information on an owner of the display member 10, and is composed of, for example, a plurality of characters and a plurality of numbers. As the information on the owner, for example, the character authentication image 12 includes a name, a nationality, and a date of birth of the owner, but may include other information. The character authentication image 12 may include information other than the information on the owner.

The face authentication image 11 is composed of a facial image 11*a* of the owner of the display member 10, a related image 11*b* including information on the owner, and a background image 11*c* surrounding the facial image 11*a* and the related image 11*b*. The facial image 11*a* is an image that is composed of printed dots formed of ink and that is composed of a plurality of colors. However, the facial image 11*a* may instead be an image composed of a single color.

The related image 11*b* is an overlapping image produced by overlapping of printed dots with a concealment pattern for concealing one or more of the printed dots. The related image 11*b* is an image having a different color tone than an image produced only by the printed dots for displaying the related image 11*b*. In other words, the related image 11*b* is an image having a different color tone than an image produced by the printed dots when the concealment pattern overlapping the printed dots is not present. The related image 11*b* differs in at least one of brightness and hue from the image produced only by the printed dots.

The related image 11*b* preferably includes information that matches a part of the information included in the character authentication image 12. For example, in the present embodiment, the related image 11*b* includes the date of birth of the owner as the information included in the character authentication image 12. The information included in the related image 11*b* may be information on the owner other than the date of birth.

Similarly to the related image 11*b*, the background image 11*c* is an overlapping image produced by overlapping of printed dots with the concealment pattern for concealing one or more of the printed dots. The background image 11*c* is an image having a different color tone than an image produced only by the printed dots for displaying the background image 11*c*, and is an image having a different color tone than the related image 11*b*. In other words, the background image 11*c* is an image having a different color tone than an image produced by the printed dots when the concealment pattern overlapping the printed dots is not present and having a different color tone than the related image 11*b*. The background image 11*c* differs in at least one of brightness and hue from the image produced only by the printed dots and from the related image 11*b*.

The background image 11*c* is composed of a single hue, but may be composed of a plurality of hues. Furthermore, the background image 11*c* may be such that only a part of the background image 11*c* surrounding the related image 11*b* is the image produced by the overlapping of the printed dots with the concealment pattern, while the other part of the background image 11*c* is the image produced only by the printed dots.

Figure 2:
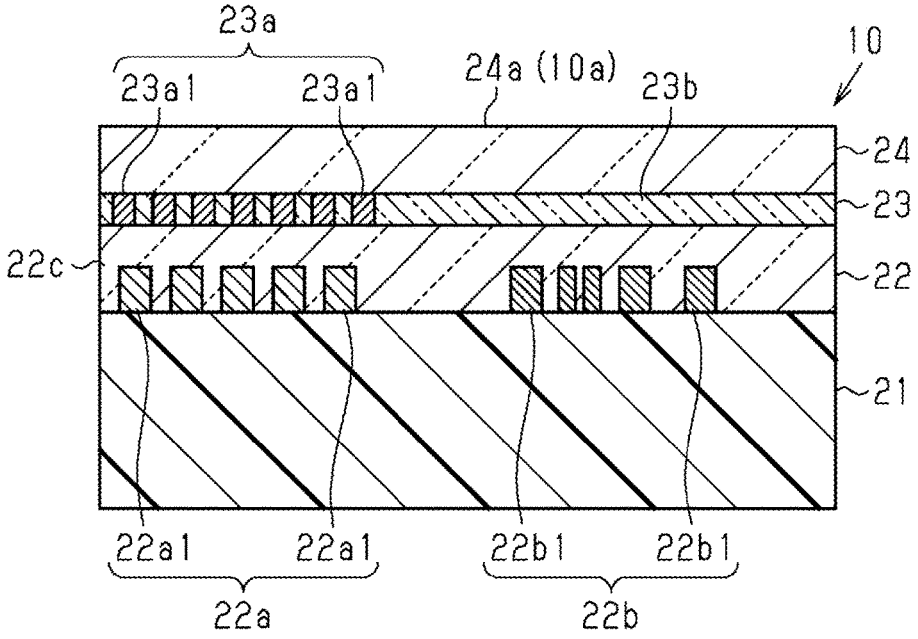
FIG. 2 is a cross-sectional view showing a structure taken along line I-I in FIG. 1.

FIG. 2 shows a cross-sectional structure of the display member 10 taken along line I-I in FIG. 1. In FIG. 2, for convenience of understanding the cross-sectional structure of the display member 10, thicknesses of layers of the display member 10 are exaggerated.

As shown in FIG. 2, the display member 10 includes a substrate 21, a pattern layer 22, a concealing layer 23, and a protective layer 24, which are laminated in this order in the display member 10. The substrate 21 needs to have strength capable of supporting the pattern layer 22, the concealing layer 23, and the protective layer 24 laminated on the substrate 21. For example, the substrate 21 may be formed of various synthetic resins or various papers.

For example, the various synthetic resins include vinyl resins, polyester resins, polycarbonate resins, polyolefin resins, acrylic resins, and cellulose resins. Examples of vinyl resins include polyvinyl chloride. Examples of polyester resins include polyethylene terephthalate and polyethylene naphthalate. Examples of polyolefin resins include polypropylene and polyethylene. Examples of cellulose resins include triacetyl cellulose. The substrate 21 may have a monolayer structure including a single layer formed of one of these resins or a multilayer structure including a plurality of layers formed of different respective resins.

To the above resins forming the substrate 21, a pigment or various additives may be added. Examples of the pigment include titanium oxide and calcium carbonate. Furthermore, a front surface of the substrate 21 may be subjected to treatment such as antistatic treatment, corona treatment, and adhesion enhancement treatment.

The pattern layer 22 includes a first print pattern 22*a* and a second print pattern 22*b*. The first print pattern 22*a* is composed of a plurality of printed dots 22*a*1, and the printed dots 22*a*1 are each formed of ink. For example, the ink for forming the printed dots 22*a*1 is pigment ink containing a pigment. For example, the ink for forming the printed dots 22*a*1 may be dye ink containing a dye. The printed dots 22*a*1 include printed dots 22*a*1 of two or more colors.

The first print pattern 22*a* includes printed dots 22*a*1 for displaying the facial image 11*a*, printed dots 22*a*1 for displaying the related image 11*b*, and printed dots 22*a*1 for displaying the background image 11*c* described above. Among the plurality of printed dots 22*a*1, a set of the printed dots 22*a*1 for displaying the facial image 11*a* is a first dot group, a set of the printed dots 22*a*1 for displaying the related image 11*b* is a second dot group, and a set of the printed dots 22*a*1 for displaying the background image 11*c* is a third dot group.

The second print pattern 22*b* is composed of a plurality of printed dots 22*b*1, and the printed dots 22*b*1 are each formed of ink. For example, the ink for forming the printed dots 22*b*1 is pigment ink containing a pigment. For example, the ink for forming the printed dots 22*b*1 may be dye ink containing a dye. The printed dots 22*b*1 are composed of printed dots of a single color, for example, only black printed dots 22*b*1, but may include printed dots 22*b*1 of two or more colors.

In plan view of the front surface 10*a* of the display member 10, the second print pattern 22*b* displays the character authentication image 12 through the front surface 10*a*.

The pattern layer 22 includes an adhesion portion 22*c* having light transmissivity. The adhesion portion 22*c* has a layer shape covering the first print pattern 22*a* and the second print pattern 22*b*. The adhesion portion 22*c* is a layer functioning as an image receiving layer for the printed dots 22*a*1 and 22*b*1, and is also a layer for adhering the pattern layer 22, the concealing layer 23, and the protective layer 24 to the substrate 21.

For example, the adhesion portion 22*c* may be formed of a polyester resin, a vinyl chloride resin, an acrylic resin, a polystyrene resin, a vinyl resin, a urethane resin, or an epoxy resin. Examples of the polyester resin include a linear saturated polyester. Examples of the vinyl chloride resin include polyvinyl chloride and a vinyl chloride-vinyl acetate copolymer resin. Examples of the acrylic resin include polyacrylic acid, poly(2-methoxyethyl acrylate), poly(methyl acrylate), poly(2-naphthyl acrylate), poly(isobornyl acrylate), polymethacrylomethyl, polyacrylonitrile, poly methyl chloroacrylate, poly(methyl methacrylate), poly (ethyl methacrylate), poly(tert-butyl methacrylate), poly (isobutyl methacrylate), poly(phenyl methacrylate), and a copolymer resin of methyl methacrylate and alkyl methacrylate (provided that the alkyl group has 2 to 6 carbons).

Examples of the vinyl resin include polydivinylbenzene, polyvinylbenzene, a styrene-butadiene copolymer resin, a copolymer resin of styrene and methacrylic acid alkyl (provided that the alkyl group has 2 to 6 carbons). The adhesion portion 22*c* may be formed of one of these resins, or may be formed of a mixture of two or more of these resins. To the adhesion portion 22*c*, an ultraviolet absorber and various additives such as fillers may be added.

The second print pattern 22*b* does not need to be formed of ink. For example, the second print pattern 22*b* may be formed by irradiating, with a laser beam, a layer containing a thermosensitive coloring agent. In this case, the substrate 21 may be the layer containing a thermosensitive coloring agent, and a second print pattern may be formed on the substrate 21. Alternatively, the display member 10 may include the layer containing a thermosensitive coloring agent between the substrate 21 and the pattern layer 22, and a second print pattern may be formed on the layer containing a thermosensitive coloring agent.

The concealing layer 23 includes a concealment pattern 23*a* and a transmission portion 23*b*. The transmission portion 23*b* has light transmissivity, and has a layer shape filling a portion of the concealing layer 23 other than the concealment pattern 23*a*. The transmission portion 23*b* may be formed of a transparent resin or a transparent dielectric.

In the case where the transmission portion 23*b* is formed of a transparent dielectric, the transmission portion 23*b* functions as a transparent reflective layer. The transparent reflective layer may have a monolayer structure or a multilayer structure. In the case where the transparent reflective layer has a multilayer structure, a material for forming layers of the transparent reflective layer and the like may be selected so that reflection and interference repeatedly occur in the transparent reflective layer, i.e., so that the transparent reflective layer functions as a multilayer interference film. In this case, for example, the transmission portion 23*b* may be formed of zinc sulfide, titanium dioxide, or the like.

The transmission portion 23*b* formed of a transparent resin or a transparent dielectric may include a metal pattern or print pattern fine enough to be difficult to visually recognize. During visual observation, the presence or absence of the metal pattern or the print pattern does not change an image that is covered by the transmission portion 23*b* and displayed through the transmission portion 23*b*.

The transmission portion 23*b* may be a metal layer that has light transmissivity and has a thickness of less than 20 nm. For example, the metal layer may be formed of chromium, nickel, aluminum, iron, titanium, silver, gold, copper, or the like.

The concealment pattern 23*a* is composed of a plurality of concealing portions 23*a*1. Each concealing portion 23*a*1 has lower light transmittance than the transmission portion 23*b*, and transmits light only to such an extent that the printed dots 22*a*1 are not visually recognized in the state where the concealing portion 23*a*1 overlaps the printed dots 22*a*1. In other words, the concealing portions 23*a*1 are opaque enough to have almost no light transmissivity.

The concealing portions 23*a*1 may be formed of a metal mentioned above as the material for forming the transmission portion 23*b*. However, the concealing portions 23*a*1 differ from the transmission portion 23*b* in that the concealing portions 23*a*1 have enough thickness to transmit almost no light incident on the concealing portions 23*a*1. The concealing portions 23*a* l preferably have a thickness of 20 nm or more and 80 nm or less. Furthermore, out of the above metals, the concealing portions 23*a*1 are preferably formed of aluminum.

In plan view of the front surface 10*a* of the display member 10, the related image 11*b* of the face authentication image 11 is produced by overlapping of a part of the second dot group with a part of the concealment pattern 23*a*, and the background image 11*c* of the face authentication image 11 is produced by overlapping of a part of the third dot group with a part of the concealment pattern 23*a*.

The concealment pattern 23*a* may be formed by etching using a mask in which a metal layer is patterned to have a predetermined pattern. Alternatively, the concealment pattern 23*a* may be formed by forming a metal layer on a base layer having an asperity structure and then etching the metal layer. In this case, in plan view of the front surface 10*a* of the display member 10, a portion of the asperity structure located at a portion of the base layer overlapping the concealment pattern 23*a* needs to be larger than a portion of the asperity structure located at a portion of the base layer not overlapping the concealment pattern 23*a*.

The concealment pattern 23*a* may be formed by a predetermined printing method. Examples of the printing method include offset printing, gravure printing, screen printing, and flexographic printing.

The protective layer 24 is a layer having light transmissivity, and is preferably a transparent layer. The protective layer 24 protects the concealing layer 23 of the display member 10 from chemical or physical damage. In a process of manufacturing the display member 10, the protective layer 24 also functions as a peeling layer for peeling off a multilayer composed of the protective layer 24, the concealing layer 23, and the pattern layer 22 from a substrate of an intermediate transfer foil for manufacturing the display member 10. A surface of the protective layer 24 on a side opposite to a surface of the protective layer 24 in contact with the concealing layer 23 is a front surface 24*a*. The front surface 24*a* of the protective layer 24 is the front surface 10*a* of the display member 10. The protective layer 24 may be formed of various synthetic resins.

The protective layer 24 may include a diffraction structure, and the diffraction structure needs to be at least one of a hologram and a diffraction grating. In terms of better preventing chemical or physical damage to the diffraction structure, the protective layer 24 preferably includes the diffraction structure on a back surface which is a surface on a side opposite to the front surface 24*a*. Furthermore, the display member 10 may have a layer that differs from the protective layer 24, located between the protective layer 24 and the concealing layer 23, and includes a diffraction structure.

[Schematic Configuration of Intermediate Transfer Apparatus]

A schematic configuration of the intermediate transfer apparatus will be described with reference to FIGS. 3 and 4. The intermediate transfer apparatus includes an information generation section, a forming section, and an overlapping section. The information generation section generates print information indicating positions of the plurality of printed dots 22*a*1 according to a position of the concealment pattern 23*a* for concealing one or more of the plurality of printed dots 22*a*1. The forming section forms the plurality of printed dots 22*a*1 on a surface of a print object based on the print information. The overlapping section overlaps the concealment pattern 23*a* with the plurality of printed dots 22*a*1 so that one or more of the plurality of printed dots 22*a*1 are concealed by the concealment pattern 23*a*.

The information generation section generates information on positions of the plurality of printed dots 22*a*1 according to a position of the concealment pattern 23*a* so as to satisfy the following condition. Specifically, the information generation section generates information so that in plan view of the surface of the print object, one or more of the plurality of printed dots 22*a*1 of the print object overlap the concealment pattern 23*a* and the display member displays an image having a different color tone than an image produced by the plurality of printed dots 22*a*1 when the concealment pattern 23*a* is not present.

Figure 3:
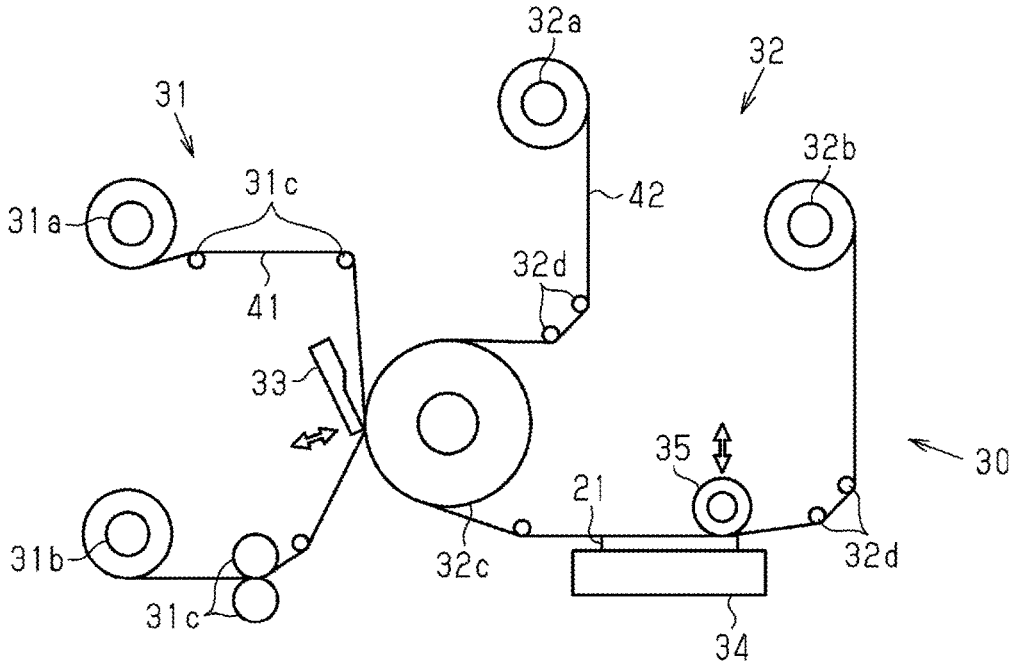
FIG. 3 is a block diagram showing a schematic configuration of an intermediate transfer apparatus.

In the present embodiment, as shown in FIG. 3, an intermediate transfer apparatus 30 includes an ink ribbon conveyance section 31, a transfer foil conveyance section 32, a thermal head 33, a stage 34, and a heat roller 35. In the intermediate transfer apparatus 30, the thermal head 33 is an example of the forming section and the overlapping section.

The ink ribbon conveyance section 31 includes a feed roller 31*a*, a take-up roller 31*b*, and a plurality of conveying rollers 31*c*. The feed roller 31*a* feeds an ink ribbon 41 before it is used to form the print patterns 22*a* and 22*b*. The take-up roller 31*b* takes up the ink ribbon 41 after the ink ribbon 41 has been used to form the print patterns 22*a* and 22*b*. The conveying rollers 31*c* are located at respective points in a conveying path of the ink ribbon 41, and convey the ink ribbon 41 from the feed roller 31*a* toward the take-up roller 31*b*.

The transfer foil conveyance section 32 conveys an intermediate transfer foil 42 on which the print patterns 22*a* and 22*b* are to be formed. The transfer foil conveyance section 32 includes a feed roller 32*a*, a take-up roller 32*b*, a platen roller 32*c*, and a plurality of conveying rollers 32*d*.

The feed roller 32*a* feeds the intermediate transfer foil 42 before formation of the two print patterns 22*a* and 22*b* on the intermediate transfer foil 42. The take-up roller 32*b* takes up the intermediate transfer foil 42 after the formation of the two print patterns 22*a* and 22*b* on the intermediate transfer foil 42 and transfer of the two print patterns 22*a* and 22*b*. The platen roller 32*c* is located at a point in a conveying path of the intermediate transfer foil 42, and faces the thermal head 33. The conveying rollers 32*d* are located at respective points in the conveying path of the intermediate transfer foil 42, and convey the intermediate transfer foil 42 from the feed roller 32*a* toward the take-up roller 32*b*.

The thermal head 33 is located at a point in the conveying path of the ink ribbon 41, and forms the printed dots 22*a*1 and 22*b*1 on the intermediate transfer foil 42 by pressing a part of the ink ribbon 41 against the intermediate transfer foil 42 located on the platen roller 32*c* while heating that part of the ink ribbon 41.

The stage 34 is located at a point in the conveying path of the intermediate transfer foil 42, and is located downstream of the platen roller 32*c* on the conveying path. The stage 34 supports the substrate 21 to which a part of the intermediate transfer foil 42 is transferred. The heat roller 35 faces the stage 34 across the intermediate transfer foil 42, and transfers a part of the intermediate transfer foil 42 to the substrate 21 by heating and pressing that part of the intermediate transfer foil 42 against the substrate 21.

For example, the ink ribbon 41 is an ink ribbon for forming the print patterns 22*a* and 22*b* according to a CMYK color model. In the ink ribbon 41, for example, a region in which cyan ink is located, a region in which magenta ink is located, a region in which yellow ink is located, and a region in which black ink is located are repeatedly arranged in this order along a conveying direction of the ink ribbon 41.

In the ink ribbon 41, a support that supports the ink may be a resin film. For example, the resin film may be a polyethylene terephthalate film, a polyethylene naphthalate film, or the like. A surface of the resin film may include a heat-resistant layer, a mold release layer, and the like, and may be subjected to adhesion enhancement treatment, anti-static treatment, and the like.

For example, the ink of the ink ribbon 41 is provided as an ink layer. The ink layer may be formed of sublimation ink or hot melt ink. As described above, the ink layer may be formed of dye ink or pigment ink. In order to maintain a printed image stable, the material for forming the ink layer is preferably a hot melt ink formed of pigment ink.

The intermediate transfer foil 42 has a multilayer structure in which a substrate, a peeling layer corresponding to the protective layer 24, the concealing layer 23, and an image receiving layer corresponding to the adhesion portion 22*c* are laminated in this order.

Figure 4:
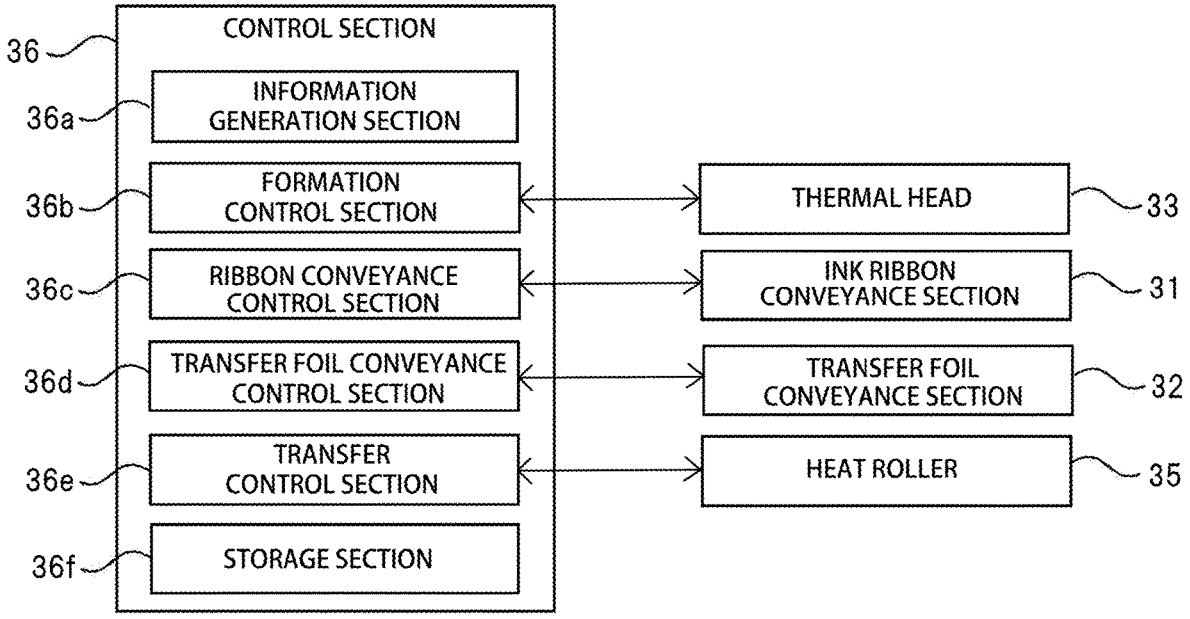
FIG. 4 is a block diagram showing an electrical configuration of the intermediate transfer apparatus.

In addition to the above components, as shown in FIG. 4, the intermediate transfer apparatus 30 includes a control section 36 that controls operation of these components. The control section 36 is composed of a CPU, a ROM, a RAM, and the like, and includes, as functional components, an information generation section 36*a*, a formation control section 36*b*, a ribbon conveyance control section 36*c*, a transfer foil conveyance control section 36*d*, a transfer control section 36*e*, and a storage section 36*f*.

The storage section 36*f* permanently or temporarily stores various control programs and data. The control section 36 performs various processes based on the various control programs stored in the storage section 36*f* The storage section 36*f* stores mask data which is information on a position of the concealment pattern 23*a*. The mask data is data indicating a pixel position of the concealment pattern 23*a* superimposed on the image receiving layer.

The image receiving layer on which the print pattern 22*a* is formed has a print region which is a region in which the print pattern 22*a* is formed. In the print region, a plurality of image cells arranged along the X direction and the Y direction are set. As a pixel position which is a position of the image cell, unique coordinates in an XY coordinate system are assigned to each of the image cells.

The storage section 36*f* stores first image data which is image data for generating print information. The first image data is image data representing, in units of pixels, a facial image of the owner and a background image located around the facial image. For example, the first image data is data represented based on an RGB color model. In the first image data, for example, the background image is an image having a single hue.

The storage section 36*f* stores second image data which is image data for generating print information. The second image data is data representing, in units of pixels, an overlapping image which is an image produced by overlapping of the printed dots 22*a*1 with the concealment pattern 23*a*. As described above, the overlapping image is the related image 11*b* and the background image 11*c* of the face authentication image 11.

The mask data, the first image data, and the second image data are inputted into the information generation section 36*a*. The information generation section 36*a* extracts region for drawing an overlapping image from the first image data, and calculates a difference of the second image data relative to the region extracted from the first image data. Such a difference between the data corresponds to a hue desired to be concealed by the concealment pattern 23*a* after the printed dots 22*a*1 overlap the concealment pattern 23*a*.

Accordingly, when the first image data is subjected to color conversion for printing, the information generation section 36*a* determines positions of the printed dots 22*a*1 so that the printed dots 22*a*1 that control the hue desired to be concealed are located at the pixel positions indicated by the mask data. Thus, print information which is information on positions of the printed dots 22*a*1 is generated by the information generation section 36*a*.

In this manner, the information generation section 36*a* generates print information so that by the overlapping of the printed dots 22*a*1 with the concealment pattern 23*a*, the related image 11*b* and the background image 11*c* having a different color tone than images produced only by the printed dots 22*a*1 are displayed.

For example, the print information is data represented based on the CMYK color model. The print information includes data indicating coordinates of each of the printed dots 22*a*1 for forming the first print pattern 22*a*.

The formation control section 36*b* provides instructions for operation of the thermal head 33 through various drivers. Based on the print information generated by the information generation section 36*a*, the formation control section 36*b* causes the thermal head 33 to form the first print pattern 22*a* according to the print information. The formation control section 36*b* also causes the thermal head 33 to form the second print pattern 22*b* according to the print information for forming the second print pattern 22*b*.

Together with the ribbon conveyance control section 36*c*, the transfer foil conveyance control section 36*d*, and the transfer control section 36*e*, the formation control section

36*b* determines timing for forming the print patterns 22*a* and 22*b*, according to conditions in which the ink ribbon 41 is conveyed, conditions in which the intermediate transfer foil 42 is conveyed, conditions in which a part of the intermediate transfer foil 42 is transferred to the substrate 21, and the like. The formation control section 36*b* causes the thermal head 33 to form the print patterns 22*a* and 22*b* according to the determined timing.

The ribbon conveyance control section 36*c* provides instructions for operation of mechanisms of the ink ribbon conveyance section 31 to the ink ribbon conveyance section 31 through various drivers. Together with the formation control section 36*b*, the transfer foil conveyance control section 36*d*, and the transfer control section 36*e*, the ribbon conveyance control section 36*c* determines timing for conveying the ink ribbon 41, according to conditions in which the print patterns 22*a* and 22*b* are formed, conditions in which the intermediate transfer foil 42 is conveyed, conditions in which a part of the intermediate transfer foil 42 is transferred to the substrate 21, and the like. The ribbon conveyance control section 36*c* causes the ink ribbon conveyance section 31 to convey the ink ribbon 41 according to the determined timing.

The transfer foil conveyance control section 36*d* provides instructions for operation of mechanisms of the transfer foil conveyance section 32 to the transfer foil conveyance section 32 through various drivers. Together with the formation control section 36*b*, the ribbon conveyance control section 36*c*, and the transfer control section 36*e*, the transfer foil conveyance control section 36*d* determines timing for conveyance the intermediate transfer foil 42, according to conditions in which the print patterns 22*a* and 22*b* are formed, conditions in which the ink ribbon 41 is conveyed, conditions in which a part of the intermediate transfer foil 42 is transferred to the substrate 21, and the like. The transfer foil conveyance control section 36*d* causes the transfer foil conveyance section 32 to convey the intermediate transfer foil 42 according to the determined timing.

The transfer control section 36*e* provides instructions for operation of the heat roller 35 through various drivers. Together with the formation control section 36*b*, the ribbon conveyance control section 36*c*, and the transfer foil conveyance control section 36*d*, the transfer control section 36*e* determines timing for transferring a part of the intermediate transfer foil 42 to the substrate 21 by the heat roller 35, according to conditions in which the print patterns 22*a* and 22*b* are formed, conditions in which the ink ribbon 41 is conveyed, conditions in which the intermediate transfer foil 42 is conveyed, and the like. The transfer control section 36*e* causes the heat roller 35 to transfer a part of the intermediate transfer foil 42 to the substrate 21 according to the determined timing.

[Method of Manufacturing Display Member]

A method of manufacturing the display member 10 will be described with reference to FIGS. 5 to 10. In the present embodiment, in the method of manufacturing the display member 10, a process performed by the intermediate transfer apparatus 30 will be described in detail.

The method of manufacturing the display member 10 includes the steps of: generating print information, forming the printed dots 22*a*1, and manufacturing the display member 10 by overlapping the concealment pattern 23*a* with the printed dots 22*a*1.

At the step of generating print information, print information indicating positions of the plurality of printed dots 22*a*1 is generated according to a position of the concealment pattern 23*a* for concealing one or more of the plurality of printed dots 22*a*1. At the step of forming the plurality of printed dots 22*a*1, based on the print information, the plurality of printed dots 22*a*1 are formed on a surface of the image receiving layer which is an example of the print object. At the step of manufacturing the display member 10, by overlapping the concealment pattern 23*a* with the plurality of printed dots 22*a*1, the display member 10 is manufactured in which one or more of the plurality of printed dots 22*a*1 are concealed by the concealment pattern 23*a*.

The step of generating print information includes generating information on positions of the plurality of printed dots 22*a*1 according to a position of the concealment pattern 23*a* so as to satisfy the following condition. Specifically, information on positions of the plurality of printed dots 22*a*1 is generated so that in plan view of the surface of the image receiving layer, one or more of the plurality of printed dots 22*a*1 of the display member 10 overlap the concealment pattern 23*a* and the display member 10 displays an image having a different color tone than an image produced by the plurality of printed dots 22*a*1 when the concealment pattern 23*a* is not present.

Furthermore, the plurality of printed dots 22*a*1 may include at least a plurality of printed dots 22*a*1 of a first color and a plurality of printed dots 22*a*1 of a second color. The second color is a color different from the first color. The step of generating print information may include generating information on positions of the plurality of printed dots 22*a*1 so that in plan view of the surface of the image receiving layer, among the plurality of printed dots 22*a*1 of the display member, at least one or more of the plurality of printed dots 22*a*1 of the first color overlap the concealment pattern 23*a*. The step of generating print information may include generating information on positions of the plurality of printed dots 22*a*1 according to a position of the concealment pattern 23*a* so that due to the above, the display member 10 displays an image having a different color tone than an image produced by the plurality of printed dots 22*a*1 when the concealment pattern 23*a* is not present.

Furthermore, the printed dots 22*a*1 may include first printed dots for displaying a first image and second printed dots for displaying a second image. The related image 11*b* is an example of the first image, and the printed dots 22*a*1 constituting the second dot group are an example of the first printed dots. Furthermore, the background image 11*c* is an example of the second image, and the printed dots 22*a*1 constituting the third dot group are an example of the second printed dots.

The step of generating print information may include generating information on positions of the first printed dots according to a position of the concealment pattern 23*a* so as to satisfy the following condition. Specifically, the step of generating print information may include generating information so that in plan view of the surface of the image receiving layer, one or more of the first printed dots of the display member overlap the concealment pattern 23*a* and the display member displays the first image having a different color tone than an image produced by the printed dots 22*a*1 when the concealment pattern 23*a* is not present.

Furthermore, the step of generating print information may include generating information on positions of the second printed dots according to a position of the concealment pattern 23*a* so as to satisfy the following condition. Specifically, the step of generating print information may include generating information so that in plan view of the surface of the image receiving layer, one or more of the second printed dots of the display member overlap the concealment pattern 23*a* and the display member displays the second image having a different color tone than an image produced by the printed dots 22*a*1 when the concealment pattern 23*a* is not present.

Figure 5:
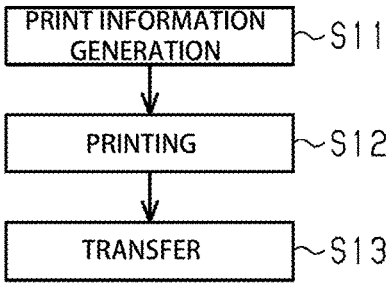
FIG. 5 is a flow chart sequentially showing steps of the method of manufacturing a display member.

In the present embodiment, as shown in FIG. 5, the method of manufacturing the display member 10 includes an information generation step (step S11), a printing step (step S12), and a transfer step (step S13). At the information generation step, the information generation section 36*a* generates print information based on the mask data, the first image data, and the second image data.

At the printing step, the first print pattern 22*a* composed of the plurality of printed dots 22*a*1 is formed in the print region of the image receiving layer by means of the thermal head 33. At the printing step, the plurality of printed dots 22*a*1 are formed so that one or more of the plurality of printed dots 22*a*1 overlap the concealment pattern 23*a* formed in advance on the intermediate transfer foil 42. Thus, the printing step is an example of the step of forming the plurality of printed dots 22*a*1 and the step of manufacturing the display member 10 by overlapping the concealment pattern 23*a* with the plurality of printed dots 22*a*1. At the printing step, the second print pattern 22*b* for displaying the character authentication image 12 is also formed.

At the transfer step, a multilayer composed of the image receiving layer, the concealing layer 23, and the peeling layer is transferred to the substrate 21 by means of the heat roller 35. Thus, the display member 10 whose configuration has been described earlier with reference to FIGS. 1 and 2 is manufactured.

The information generation step of the method of manufacturing the display member 10 will be described in more details with reference to FIGS. 6 to 10. In the following description, details of the mask data used at the information generation step will be described, followed by description of the information generation step.

Figure 6:
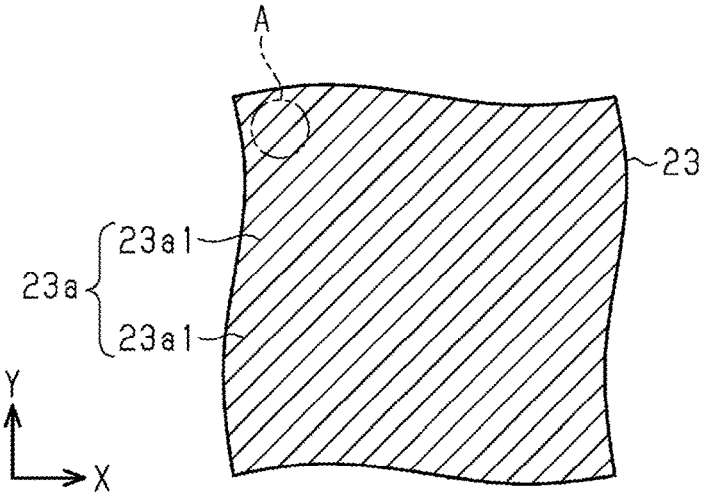
FIG. 6 is a plan view showing a structure of a concealment pattern.

As shown in FIG. 6, in plan view of an XY plane, for example, the concealment pattern 23*a* of the concealing layer 23 is composed of the plurality of concealing portions 23*a*1 having a line shape intersecting the X direction at 45°. The plurality of concealing portions 23*a*1 are arranged at regular intervals along a direction that intersects the Y direction at 45° and is orthogonal to a direction in which the concealing portions 23*a*1 extend.

Figure 7:
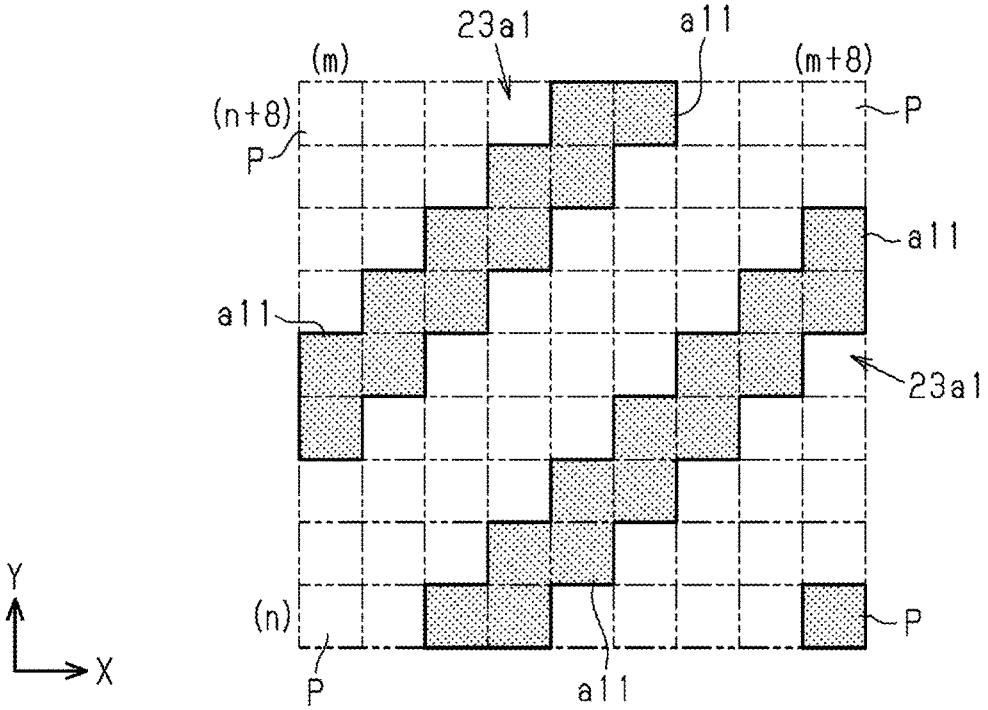
FIG. 7 is an enlarged plan view of a region A in FIG. 6.

FIG. 7 shows an enlarged view of a region A in FIG. 6. FIG. 7 shows a portion of the concealment pattern 23*a* located in a region bounded by an image cell P located at (m, n), an image cell P located at (m, n+8), an image cell P located at (m+8, n), and an image cell P located at (m+8, n+8) in the XY coordinate system. Note that n and m are an integer greater than or equal to 1, and for example, n and m have the same integer value.

As shown in FIG. 7, a plurality of image cells P include image cells P on which concealing elements all constituting the concealing portion 23*a*1 are superimposed and image cells P on which no concealing elements all are superimposed. The concealing elements all are arranged so that a width along the X direction and a width along the Y direction are 2 pixels and that a pitch in the X direction and a pitch in the Y direction are 6 pixels, thereby constituting the plurality of concealing portions 23*a*1.

For example, some of the concealing elements all are arranged from an image cell P located at (m, n+3) toward an image cell P located at (m+5, n+8) so that in the image cells P in which the concealing elements all are located, as an X coordinate value is increased by 1, a Y coordinate value is increased by 1. Furthermore, some of the concealing elements all are arranged from an image cell P located at (m, n+4) toward an image cell P located at (m+4, n+8) so that in the coordinates of the image cells P in which the concealing elements all are located, as an X coordinate value is increased by 1, a Y coordinate value is increased by 1.

The concealment pattern 23*a* overlaps a part of the second dot group and a part of the third dot group of the printed dots 22*a*1. Accordingly, the concealment pattern 23*a* has a shape with the above pitch, over a region in which the second dot group is located and a region in which the third dot group is located in the XY coordinate system.

The mask data stored in the storage section 36*f* is a set of data regarding such pixel positions of the concealing elements all.

As described above, the concealment pattern 23*a* is preferably formed of aluminum. Thus, the method of manufacturing the display member 10 may include, prior to the process performed by the intermediate transfer apparatus 30, a step of forming the concealment pattern 23*a* by patterning an aluminum film for forming the concealment pattern 23*a*. At the step of forming the concealment pattern 23*a*, the aluminum film is patterned so that the concealment pattern 23*a* is superimposed on the abovementioned pixel position in the image receiving layer. According to such a step, it is possible to form the concealment pattern 23*a* that is formed of aluminum and has a predetermined pattern.

At the information generation step, print information is generated based on the mask data, the first image data, and the second image data. At the information generation step, a region for drawing an overlapping image is extracted from the first image data, and a difference of the second image data relative to the extracted region is calculated. Next, based on the difference, print information is generated in which positions of the printed dots 22*a*1 are determined so that the printed dots 22*a*1 that control a hue desired to be concealed are located at the pixel positions indicated by the mask data.

Figure 8:
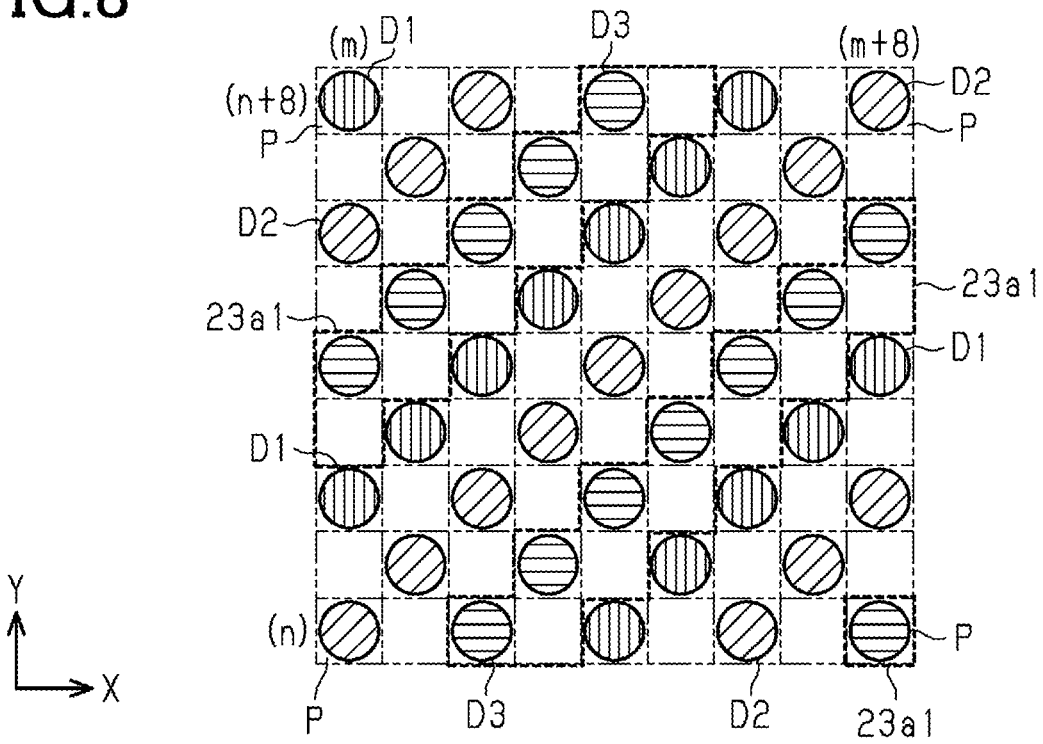
FIG. 8 is an enlarged plan view of a part of a third dot group.

In the present embodiment, as shown in FIG. 8, when the first image data is subjected to color conversion for printing, the third dot group is composed of first dots D1 having a first color, second dots D2 having a second color, and third dots D3 having a third color. Among these, the third dots D3 are the printed dots 22*a*1 that control the hue desired to be concealed by the concealment pattern 23*a*. Thus, the information generation section 36*a* determines positions of the printed dots 22*a*1 so that the first dots D1 and the second dots D2 do not overlap the concealment pattern 23*a* and that the third dots D3 overlap the concealment pattern 23*a*.

The information generation section 36*a* determines the positions of the printed dots 22*a*1 so that the first dots D1, the second dots D2, and the third dots D3 are arranged on respective straight lines intersecting the X direction at 45°. Furthermore, the information generation section 36*a* determines the positions of the printed dots 22*a*1 so that the straight line on which the first dots D1 are located, the straight line on which the second dots D2 are located, and the straight line on which the third dots D3 are located are arranged in this order at predetermined intervals along a direction orthogonal to the straight lines. Thus, the information generation section 36*a* determines the positions of the printed dots 22*a*1 so that a row of the first dots D1, a row of the second dots D2, and a row of the third dots D3 constitute one cycle.

Positions of the first dots D1, the second dots D2, and the third dots D3 are each determined so that their widths along the X direction and a width along the Y direction are 1 pixel and that a cycle in the X direction and a cycle in the Y direction are 6 pixels. Furthermore, the positions of the printed dots 22a1 are determined so that an interval along the X direction between the printed dots 22a1 having the different respective colors is 1 pixel. Thus, the positions of the printed dots 22a1 constituting the third dot group are determined by the information generation section 36a so that the pitch of the concealment pattern 23a matches a pitch at a start position of one cycle of the printed dots 22a1, i.e., a pitch between the rows of the first dots D1.

According to such print information, for example, some of the first dots D1 are arranged from an image cell P located at (m, n+2) toward an image cell P located at (m+6, n+8) so that in the coordinates of the image cells P in which the first dots D1 are located, as an X coordinate value is increased by 1, a Y coordinate value is increased by 1.

Some of the second dots D2 are arranged from an image cell P located at (m, n) toward an image cell P located at (m+8, n+8) so that in the coordinates of the image cells P in which the second dots D2 are located, as an X coordinate value is increased by 1, a Y coordinate value is increased by 1.

Some of the third dots D3 are arranged from an image cell P located at (m+2, n) toward an image cell P located at (m+8, n+6) so that in the coordinates of the image cells P in which the third dots D3 are located, as an X coordinate value is increased by 1, a Y coordinate value is increased by 1.

The print information generated by the information generation section 36a is a set of data regarding the positions of the printed dots 22a1. In the case where the print information is information according to the CMYK color model, for example, for information on the color of the first dots D1, a predetermined tone value other than zero is assigned to cyan, while a tone value of zero is assigned to magenta, yellow, and black. Furthermore, in information on the color of the second dots D2, a predetermined tone value other than zero is assigned to magenta, while a tone value of zero is assigned to cyan, yellow, and black. Furthermore, in information on the color of the third dots D3, a predetermined tone value other than zero is assigned to yellow, while a tone value of zero is assigned to cyan, magenta, and black.

Figure 9:
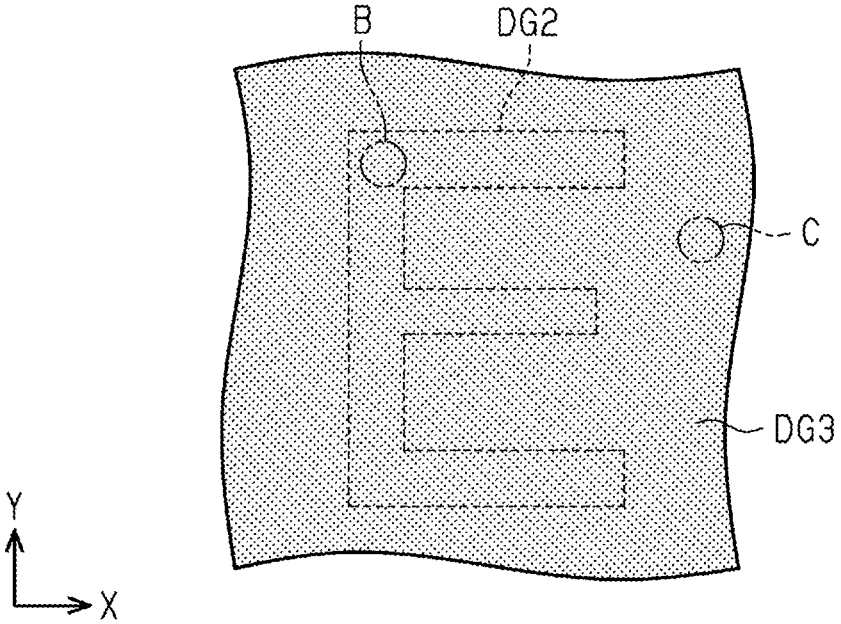
FIG. 9 is an enlarged plan view of a part of a print pattern.

As shown in FIG. 9, in a third dot group DG3, which is a set of the printed dots 22a1 including printed dots 22a1 located in a region C, positions of the first dots D1, the second dots D2, and the third dots D3 are determined according to the rule described above. On the other hand, in a second dot group DG2, which is a set of the printed dots 22a1 including printed dots 22a1 located in a region B, positions of the first dots D1, the second dots D2, and the third dots D3 are determined by the information generation section 36a in the following manner.

Figure 10:
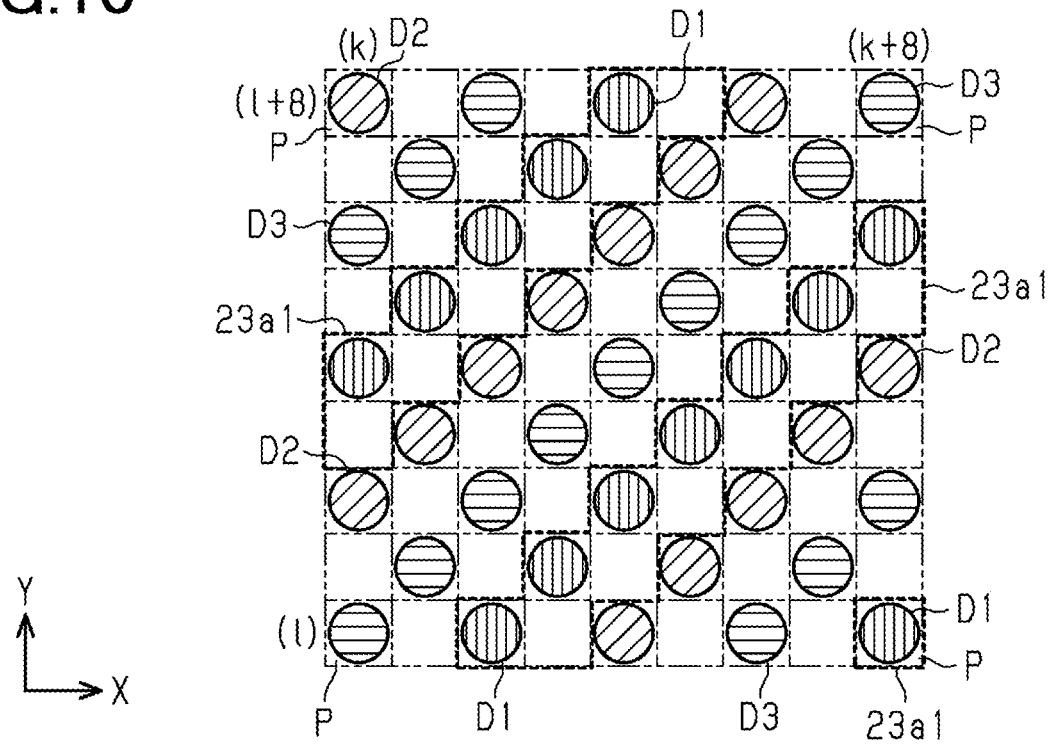
FIG. 10 is an enlarged plan view of a region B in FIG. 9.

FIG. 10 shows an enlarged view of the region B including a part of the second dot group. FIG. 10 shows printed dots 22a1 of the second dot group located in a region bounded by an image cell P located at (k, l), an image cell P located at (k, l+8), an image cell P located at (k+8, l), and an image cell P located at (k+8, l+8) in the XY coordinate system. Note that k and l are an integer greater than or equal to 1, and for example, k and l have the same integer value. Furthermore, k and n have different integer values, and l and m have different integer values.

For example, as shown in FIG. 10, when the first image data is subjected to color conversion for printing, similarly to the third dot group, the second dot group is composed of first dots D1, second dots D2, and third dots D3. Among these, the first dots D1 are the printed dots 22a1 that control the hue desired to be concealed by the concealment pattern 23a. Thus, the information generation section 36a determines positions of the printed dots 22a1 so that the second dots D2 and the third dots D3 do not overlap the concealment pattern 23a and that the first dots D1 overlap the concealment pattern 23a.

The information generation section 36a determines the positions of the printed dots 22a1 so that the first dots D1, the second dots D2, and the third dots D3 are arranged on respective straight lines intersecting the X direction at 45°, similarly to the dots in the region C. Furthermore, the information generation section 36a determines the positions of the printed dots 22a1 so that the straight line on which the first dots D1 are located, the straight line on which the second dots D2 are located, and the straight line on which the third dots D3 are located are arranged in this order at predetermined intervals along a direction orthogonal to the straight lines. Thus, the information generation section 36a determines the positions of the printed dots 22a1 so that a row of the first dots D1, a row of the second dots D2, and a row of the third dots D3 constitute one cycle.

However, the positions of the printed dots 22a1 located in the region B differ in positions of the printed dots 22a1 from the positions of the printed dots 22a1 located in the region C in the following manner. Specifically, the information generation section 36a determines the positions of the printed dots 22a1 so that the positions of the printed dots 22a1 in the region B differ from the positions of the printed dots 22a1 in the region C in that the position in the Y coordinate of the cycle composed of the row of the first dots D1, the row of the second dots D2, and the row of the third dots D3 in the region B is shifted by 2 pixels toward a higher coordinate value from the position in the Y coordinate of the cycle composed of the row of the first dots D1, the row of the second dots D2, and the row of the third dots D3 in the region C.

In other words, the information generation section 36a determines the positions of the printed dots 22a1 so that first dots D1 of the region B and third dots D3 of the region C are located at corresponding positions of the respective image cells P. Furthermore, the information generation section 36a determines the positions of the printed dots 22a1 so that thirds D3 of the region B and second dots D2 of the region C are located at corresponding positions of the respective image cells P. Thus, the positions of the printed dots 22a1 constituting the second dot group DG2 are determined by the information generation section 36a so that the cycle of the concealment pattern 23a matches the cycle of the printed dots 22a1, similarly to the positions of the printed dots 22a1 constituting the third dot group DG3.

According to such print information, for example, some of the first dots D1 are arranged from an image cell P located at (k, l+4) toward an image cell P located at (k+4, l+8) so that in the coordinates of the image cells P in which the first dots D1 are located, as an X coordinate value is increased by 1, a Y coordinate value is increased by 1.

Some of the second dots D2 are arranged from an image cell P located at (k, l+2) toward an image cell P located at (k+6, l+8) so that in the coordinates of the image cells P in which the second dots D2 are located, as an X coordinate value is increased by 1, a Y coordinate value is increased by 1.

Some of the third dots D3 are arranged from the image cell P located at (k, l) toward the image cell P located at (k+8, l+8) so that in the coordinates of the image cells P in which the third dots D3 are located, as an X coordinate value is increased by 1, a Y coordinate value is increased by 1.

Thus, the printed dots 22a1 included in the region B differ from the printed dots 22a1 included in the region C in the positions of the dots of the respective colors. However, since the cycle in which the dots are arranged in the region B is the same as the cycle in which the dots are arranged in the region C, a color tone of the region B is the same as a color tone of the region C in an image produced by the print pattern 22*a* which is the set of printed dots 22*a*1.

The print information generated by the information generation section 36*a* is a set of data regarding the positions of the printed dots 22*a*1.

[Effects of Display Member]

Effects of the display member 10 will be described with reference to FIGS. 11 to 17.

Figure 11:
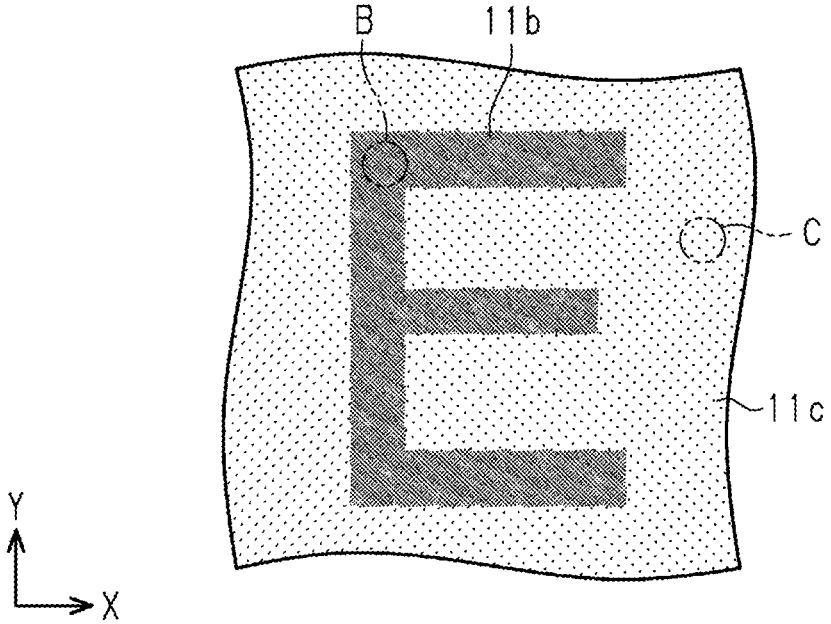
FIG. 11 is an enlarged plan view of a part of a related image together with a part of a background image of a first authentication image.

As shown in FIG. 11, when the first print pattern 22*a* is formed based on the print information generated by the information generation section 36*a*, the related image 11*b* and the background image 11*c* are displayed as images having different respective color tones.

Figure 12:
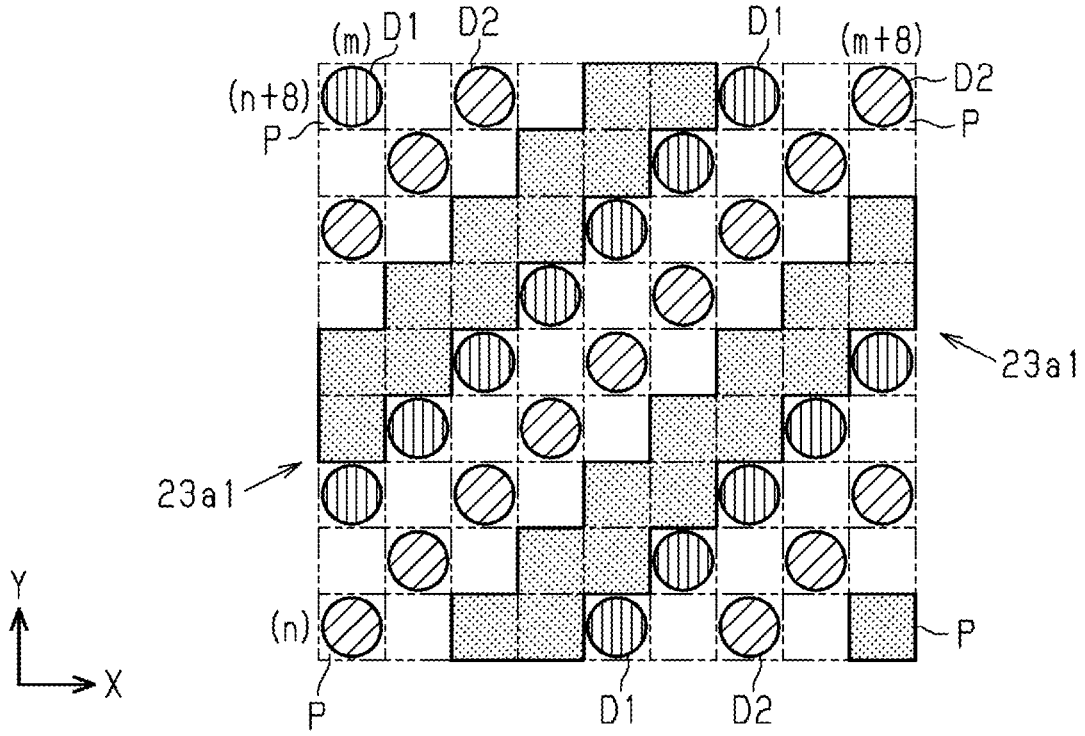
FIG. 12 is an enlarged plan view of a region B in FIG. 9 and a part of the concealment pattern.

As shown in FIG. 12, in the third dot group included in the region C, due to the overlapping of the printed dots 22*a*1 with the concealment pattern 23*a*, all of the third dots D3 of the printed dots 22*a*1 overlap the concealment pattern 23*a*, thereby being concealed. However, by the overlapping of the printed dots 22*a*1 with the concealment pattern 23*a*, none of the first dots D1 or the second dots D2 overlaps the concealment pattern 23*a*. Thus, the region C has a color tone produced by the first dots D1 and the second dots D2.

Figure 13:
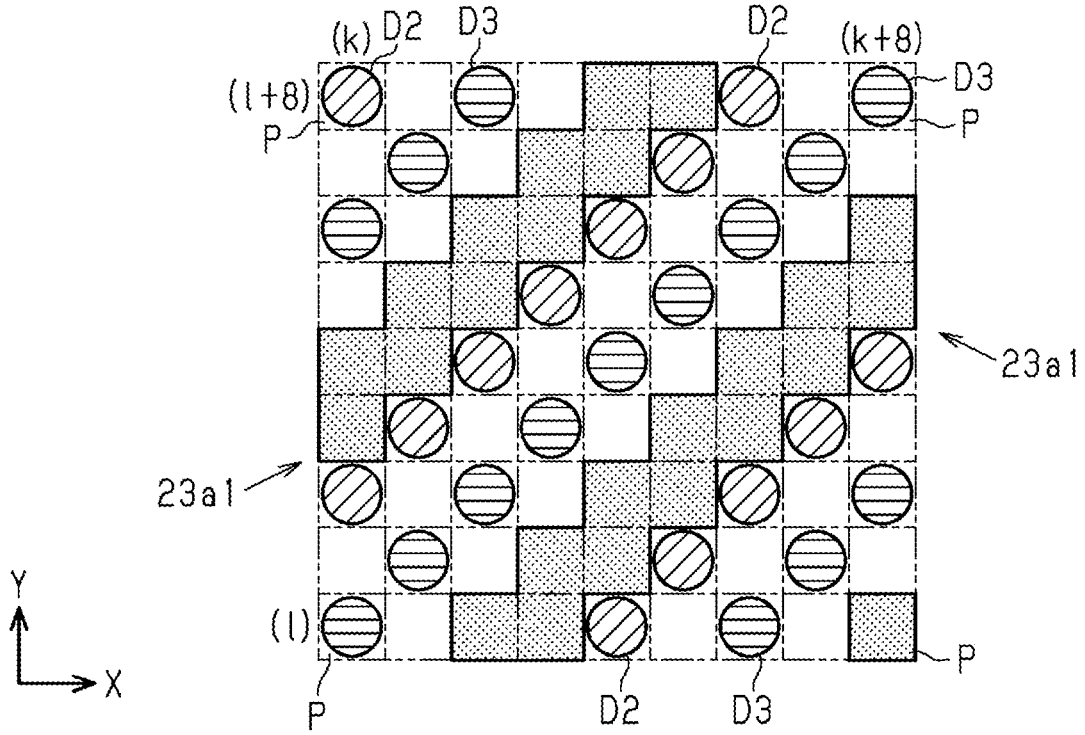
FIG. 13 is an enlarged plan view of the region C in FIG. 9 and a part of the concealment pattern.

On the other hand, as shown in FIG. 13, in the region B, by the overlapping of the printed dots 22*a*1 with the concealment pattern 23*a*, all of the first dots D1 of the printed dots 22*a*1 overlap the concealment pattern 23*a*, thereby being concealed. However, by the overlapping of the printed dots 22*a*1 with the concealment pattern 23*a*, none of the second dots D2 or the third dots D3 overlaps the concealment pattern 23*a*. Thus, the region B has a color tone composed of the second dots D2 and the third dots D3.

In this manner, in the display member 10 manufactured by overlapping the printed dots 22*a*1 with the concealment pattern 23*a*, the related image 11*b* and the background image 11*c* having different respective color tones are produced by overlapping the printed dots 22*a*1 with the concealment pattern 23*a*.

In the display member 10, among the printed dots 22*a*1 of two or more colors, at least one or more of the printed dots 22*a*1 of only a single color overlap the concealment pattern 23*a*, and thus the color tone of the image produced by the overlap has a different hue from the color tone of the image produced only by the printed dots 22*a*1. Accordingly, as compared with a configuration in which the color tone of the image produced by the overlapping of the printed dots 22*a*1 with the concealment pattern 23*a* differs only in brightness from the color tone of the image produced only by the printed dots 22*a*1, it is more difficult to cause, by falsification of the display member 10, the falsified display member 10 to produce the same color tone as the genuine display member 10. As a result, it is possible to better prevent falsification of the display member 10.

Furthermore, a part of the second dot group DG2 and a part of the third dot group DG3 of the printed dots 22*a*1 both overlap the concealment pattern 23*a*, and the overlapping of the second dot group DG2 with the concealment pattern 23*a* and the overlapping of the third dot group DG3 with the concealment pattern 23*a* each cause the display member 10 to display an image having a different color tone than an image produced only by the printed dots 22*a*1. This makes falsification of the display member 10 more difficult than falsification of a configuration in which the display member 10 produces only one image having a different color tone than an image produced only by the printed dots 22*a*1. This can consequently better prevent falsification of the display member 10.

Figure 14:
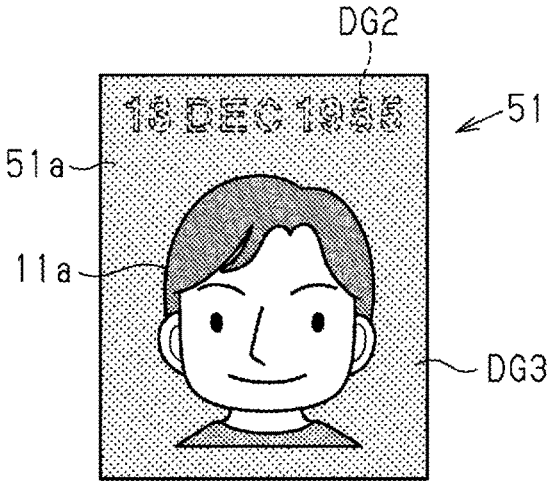
FIG. 14 is a plan view showing a print image produced only by a print pattern.

As shown in FIG. 14, a print image 51 produced only by the plurality of printed dots 22*a*1 formed according to the print information is composed of the facial image 11*a* of the owner and a background image 51*a* located around the facial image 11*a*. The background image 51*a* is composed of the second dot group DG2 and the third dot group DG3, and has a color tone produced by the first dots D1, the second dots D2, and the third dots D3.

Figure 15:
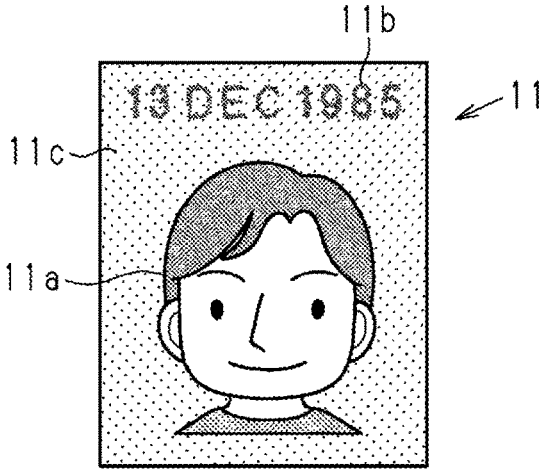
FIG. 15 is a plan view showing a face authentication image.

On the other hand, as shown in FIG. 15, by the overlapping of the printed dots 22*a*1 with the concealment pattern 23*a*, the printed dots 22*a*1 forming a part of the background image 51*a* of the print image 51 overlap the concealment pattern 23*a*. Thus, the face authentication image 11 composed of the facial image 11*a*, the related image 11*b*, and the background image 11*c* is displayed. Furthermore, the related image 11*b* and the background image 11*c* of the face authentication image 11 each have a different color tone than the background image 51*a* of the print image 51. In addition, in the face authentication image 11, the related image 11*b* has a different color tone than the background image 11*c*.

Thus, since the printed dots 22*a*1 overlapping the concealment pattern 23*a* are a part of the background image 51*a* of the image produced only by the printed dots 22*a*1, when the display member 10 is falsified, the printed dots 22*a*1 are more likely to be removed from the display member 10 together with the facial image 11*a* of the display member 10. Once the printed dots 22*a*1 are removed, it is difficult to display the image produced by the overlapping of the concealment pattern 23*a* with the printed dots 22*a*1, unless positions of the printed dots 22*a*1 and a position of the concealment pattern 23*a* are the same as those of the genuine display member 10. This can better prevent falsification of the display member 10.

Figure 16:
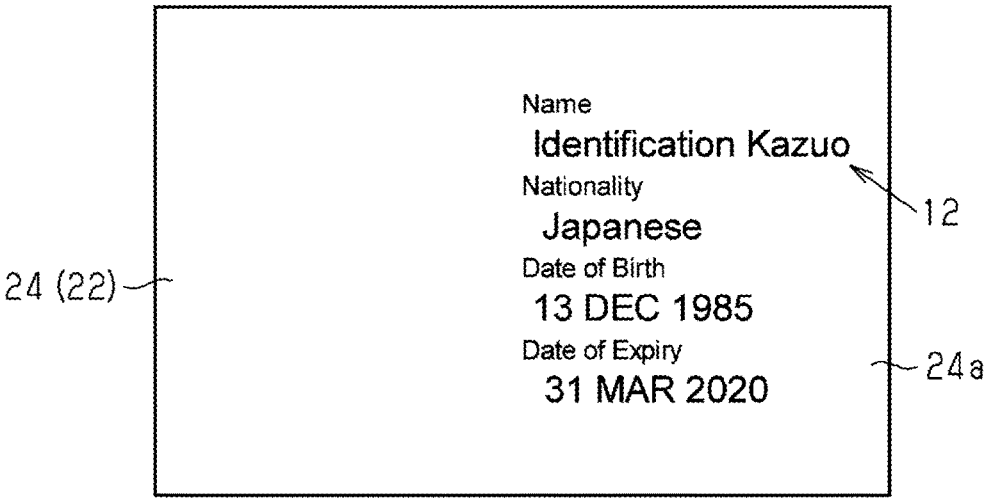
FIG. 16 is a plan view showing a state in which a first print pattern of the display member has been removed during falsification of the display member.

As shown in FIG. 16, when the display member 10 displaying the face authentication image 11 is falsified, first, the multilayer composed of the pattern layer 22, the concealing layer 23, and the protective layer 24 is peeled off from the substrate 21. Then, the first print pattern 22*a* is chemically or physically removed from the pattern layer 22.

Figure 17:
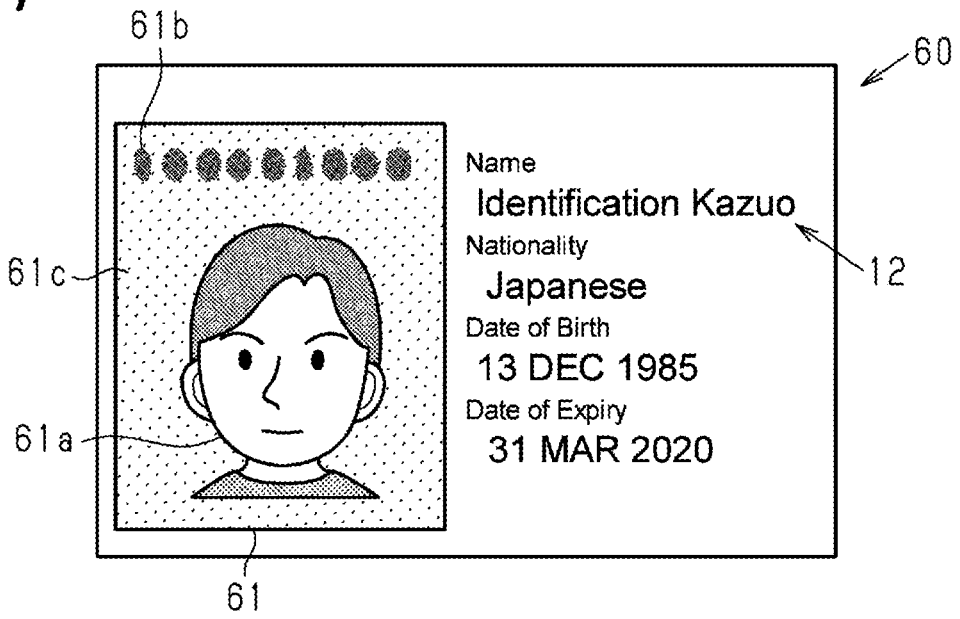
FIG. 17 is a plan view showing a planar structure of a falsified display member.

Next, as shown in FIG. 17, a print pattern including a facial image 61*a* of a false owner is formed on the pattern layer 22. Thus, a false display member 60 including a false face authentication image 61 is manufactured. As described above, however, the related image 11*b* and the background image 11*c* displayed by the display member 10 are formed by overlapping one or more of the printed dots 22*a*1 formed on the pattern layer 22 with the concealment pattern 23*a*.

Accordingly, by merely causing a color tone of the print pattern to resemble that of the genuine image, it is impossible to form the display member 60 that displays a background image 61*c* having a color tone equivalent to that of the genuine background image 11*c* and a related image 61*b* having a shape and color tone equivalent to those of the genuine related image 11*b*. According to the method of manufacturing the display member 10 having such a structure, therefore, it is possible to better prevent falsification of the display member 10.

The printed dots 22*a*1 formed using pigment ink are more likely to be located on a surface of a layer on which the printed dots have been formed, as compared with printed dots formed using other ink, e.g., dye ink. Thus, the printed dots formed using pigment ink are more likely to be removed from the layer on which the printed dots have been formed. As described above, even when the printed dots

22*a*1 formed of pigment ink are removed and new printed dots are formed, an image equivalent to that of the display member 10 is not displayed by merely forming printed dots resembling those of the image displayed by the genuine display member 10. Therefore, the method of manufacturing the display member 10 can yield a more significant effect of better preventing falsification of the display member 10 including the printed dots 22*a*1 formed using pigment ink.

Furthermore, according to the display member 10, the related image 11*b* cannot be displayed unless positions of the printed dots 22*a*1 and a position of the concealment pattern 23*a* are both the same as those of the genuine display member 10. Therefore, even if the display member 10 is falsified, by determining whether the display member 10 displays the related image 11*b*, it is easily determined whether the display member is a false display member obtained by falsification.

Example 1

An intermediate transfer foil including a substrate, a peeling layer, a concealing layer, and an image receiving layer was prepared. A concealment pattern was formed in advance at a position in the concealing layer that, when viewed in a thickness direction of the intermediate transfer foil, overlapped the position of a second dot group and the position of a third dot group in the image receiving layer. A plurality of concealing portions constituting the concealment pattern were formed so that the concealing portions intersected the X direction at 45° and that were arranged at regular intervals along a direction orthogonal to a direction in which the concealing portions extended. The width of the concealing portions, i.e., a width along the Y direction, was set to 80 μm, and a distance between the concealing portions adjacent to each other in the Y direction was set to 160 μm. Thus, a pitch of the concealment pattern was set to 240 μm.

Print information was generated by the information generation section of the control section based on the mask data, the first image data, and the second image data. At this time, the print information was generated so that the second dot group and the third dot group were arranged in the following manner.

Specifically, positions of printed dots were set so that in the third dot group, cyan printed dots, magenta printed dots, and yellow printed dots were located on respective straight lines and that the straight lines intersected the X direction at 45°. Furthermore, the positions of the printed dots were set so that among the straight lines, the straight line on which the cyan printed dots were located, the straight line on which the magenta printed dots were located, and the straight line on which the yellow printed dots were located were arranged in this order along a direction orthogonal to a direction in which the straight lines extended.

The width of the straight lines on each of which the printed dots of the corresponding one of the colors were located, i.e., a width along the Y direction, was set to 40 μm, and a distance between the straight lines adjacent to each other in the Y direction was set to 40 μm. Thus, similarly to the pitch of the concealment pattern, a pitch of the print pattern was set to 240 μm. Furthermore, the positions of the printed dots were set so that among the straight lines on each of which the printed dots of the corresponding one of the colors were located, only the straight line on which the yellow printed dots were located overlapped the concealment pattern.

A pitch of the second dot group was set to the same value as the pitch of the third dot group, and the pitch of the second dot group was shifted by 80 μm in the X direction from the pitch of the third dot group. Thus, the positions of the printed dots were set so that among the straight lines on each of which the printed dots of the corresponding one of the colors were located, only the straight line on which the cyan printed dots were located overlapped the concealment pattern.

Next, according to such print information, a plurality of printed dots were formed on the image receiving layer by means of an intermediate transfer apparatus (manufactured by Toppan Printing Co., Ltd., eP600), and then a multilayer including the image receiving layer, the concealing layer, and the peeling layer was transferred to the substrate to manufacture a display member. Thus, a display member that displayed a face authentication image including a background image having a purple color and a related image having an orange color was obtained.

As has been described, according to the first embodiment of the display member, the booklet, the ID card, the method of manufacturing a display member, and the apparatus for manufacturing a display member, the following effects can be obtained.

(1-1) Among the printed dots 22*a*1 of two or more colors, at least one or more of the printed dots 22*a*1 of only a single color overlap the concealment pattern 23*a*, and thus the color tone of the image produced by the overlap has a different hue from the color tone of the image produced only by the printed dots 22*a*1. Accordingly, as compared with a configuration in which the color tone of the image produced by the overlapping of the printed dots 22*a*1 with the concealment pattern 23*a* differs only in brightness from the color tone of the image produced only by the printed dots 22*a*1, it is more difficult to cause, by falsification of the display member 10, the falsified display member 10 to produce the same color tone as the genuine display member 10. As a result, it is possible to better prevent falsification of the display member 10.

(1-2) A part of the second dot group DG2 and a part of the third dot group DG3 of the printed dots 22*a*1 both overlap the concealment pattern 23*a*, and the overlapping of the second dot group DG2 with the concealment pattern 23*a* and the overlapping of the third dot group DG3 with the concealment pattern 23*a* each cause the display member 10 to display an image having a different color tone than an image produced only by the printed dots 22*a*1. This makes falsification of the display member 10 more difficult than falsification of a configuration in which the display member 10 produces only one image having a different color tone than an image produced only by the printed dots 22*a*1. This can consequently better prevent falsification of the display member 10.

(1-3) Even when the printed dots 22*a*1 are removed and new printed dots are formed, an image equivalent to that of the display member 10 is not displayed by merely forming printed dots resembling those of the image displayed by the genuine display member 10. Therefore, the method of manufacturing the display member 10 can yield a more significant effect of better preventing falsification of the display member 10 including the printed dots 22*a*1 formed using pigment ink.

(1-4) The related image 11*b* cannot be displayed unless positions of the printed dots 22*a*1 and a position of the concealment pattern 23*a* are both the same as those of the genuine display member 10. Therefore, even if the display member 10 is falsified, by determining whether the display member 10 displays the related image 11*b*, it is easily determined whether the display member is a false display member obtained by falsification.

(1-5) Since the printed dots 22*a*1 overlapping the concealment pattern 23*a* are a part of the background image 51*a* of the image produced only by the printed dots 22*a*1, when the display member 10 is falsified, the printed dots 22*a*1 are more likely to be removed from the display member 10 together with the facial image 11*a* of the display member 10. Once the printed dots 22*a*1 are removed, it is difficult to display the image produced by the overlapping of the concealment pattern 23*a* with the printed dots 22*a*1, unless positions of the printed dots 22*a*1 and a position of the concealment pattern 23*a* are the same as those of the genuine display member 10. This can better prevent falsification of the display member 10.

Modified Examples of First Embodiment

The first embodiment described above may be modified as appropriate in the following manner.

The printed dots 22*a*1 overlapping the concealment pattern 23*a* may be, for example, a background image located around an image including characters and numbers, such as the character authentication image 12. Alternatively, the image produced by the print pattern 22*a* including the printed dots 22*a*1 overlapping the concealment pattern 23*a* may be an image of a single color including neither a facial image nor an image including characters.

The printed dots 22*a*1 overlapping the concealment pattern 23*a* may be included in the first dot group that displays the facial image 11*a*.

The image produced by the overlapping of the printed dots 22*a*1 with the concealment pattern 23*a* does not need to be the image related to the owner of the display member 10, and may be, for example, an image representing a predetermined shape, characters, numbers, or the like unrelated to the owner.

In the second dot group DG2 and the third dot group DG3, the dots of two or more colors constituting the respective dot groups may overlap the concealment pattern 23*a*. Even in such a configuration, when the second dot group DG2 overlapping the concealment pattern 23*a* has a different color tone than the third dot group DG3 overlapping the concealment pattern 23*a*, an effect similar to the effect (1-2) described above can be obtained.

The printed dots 22*a*1 constituting each of the second dot group DG2 and the third dot group DG3 may include only printed dots 22*a*1 of two or less colors, or may include printed dots 22*a*1 of four or more colors.

The printed dots 22*a*1 overlapping the concealment pattern 23*a* may be included in only one of the second dot group DG2 and the third dot group DG3. In such a configuration, similarly to the first embodiment described above, in the dot group including the printed dots 22*a*1 overlapping the concealment pattern 23*a*, by overlapping of at least one or more of the printed dots 22*a*1 of only a single color with the concealment pattern 23*a*, it is possible to display an image having a different color tone than an image produced only by the printed dots 22*a*1.

A difference in color tone between two images may be represented by a difference only in brightness between the second dot group DG2 concealed by the concealment pattern 23*a* and the third dot group DG3 concealed by the concealment pattern 23*a*, while the hue is the same in the second dot group DG2 and the third dot group DG3.

The information generation section 36*a* does not need to generate print information that causes the pitch of the concealment pattern 23*a* to be equal to the pitch between the rows of the ink of the respective colors. The information generation section 36*a* may generate print information that causes the pitch of the concealment pattern 23*a* to be an integral multiple of 2 or more of the pitch between the rows of the ink of the respective colors. Even in such a configuration, by overlapping of the concealment pattern 23*a* with one or more of the printed dots 22*a*1, it is possible to display an image having a different color tone than an image produced only by the printed dots 22*a*1.

The printed dots 22*a*1 overlapping the concealment pattern 23*a* do not need to be entirely concealed by the concealment pattern 23*a*. Such a configuration can be embodied by causing the width of the concealing portion 23*a*1 to be smaller than the width of the printed dot 22*a*1. Alternatively, even when the width of the concealing portion 23*a*1 is equal to or larger than the width of the printed dot 22*a*1, positions of the printed dots 22*a*1 may be determined according to a position of the concealment pattern 23*a* so that a part of the printed dot 22*a*1 extends from the concealing portion 23*a*1 in a thickness direction of the display member 10.

In the configuration in which the printed dots 22*a*1 are located so that a part of the printed dot 22*a*1 extends from the concealment pattern 23*a*, it is preferable to determine the positions of the printed dots 22*a*1 so that the pitch between the printed dots 22*a*1 is shifted by 10% or less from the pitch of the concealment pattern 23*a*. This makes it possible to cause moire by interference between the concealment pattern 23*a* and the printed dots 22*a*1.

The concealing portions 23*a*1 may have a straight line shape intersecting each axis at an angle other than 45° in the XY coordinates, or may have a straight line shape extending along an X-axis or a Y-axis.

The concealing portions 23*a*1 do not need to be arranged at regular intervals along one direction. A distance between the concealing portions 23*a*1 along one direction may gradually be increased, or may gradually be reduced.

The concealing portions 23*a*1 do not need to have a line shape, and the concealment patterns 23*a* may be a set of points arranged according to a predetermined rule in the XY coordinates.

The method of forming the printed dots 22*a*1 is not limited to the heat transfer method using the thermal head, and may be an ink-jet method, an electrophotographic method, or the like. Alternatively, the printed dots 22*a*1 may be formed by a combination of at least two of the thermal transfer method, the ink-jet method, and the electrophotographic method.

The printed dots 22*a*1 of the display member 10 do not need to be formed by the intermediate transfer method, and may be directly formed on the image receiving layer for the printed dots 22*a*1 which is one of the layers constituting the display member 10. Thus, the apparatus for manufacturing a display member may be embodied as an apparatus that is not an intermediate transfer apparatus and is capable of forming the printed dots 22*a*1 and overlapping the printed dots 22*a*1 with the concealment pattern 23*a*.

In such a configuration, one or more of the printed dots 22*a*1 may be overlapped with the concealment pattern 23*a* by forming the printed dots 22*a*1 on the image receiving layer, followed by overlapping the concealing layer 23 with the image receiving layer. Alternatively, by forming the printed dots 22*a*1 on the image receiving layer including the concealment pattern 23*a*, one or more of the printed dots 22*a*1 may be overlapped with the concealment pattern 23*a* simultaneously with the formation of the printed dots 22*a*1.

The display member 10 is not limited to the personal authentication medium, and may be embodied, for example, as toys such as cards for games, various tickets, or the like. Even in such a configuration, it is possible to better prevent falsification of the display member 10.

Second Embodiment

A second embodiment of the display member, the booklet, the ID card, the method of manufacturing a display member, and the apparatus for manufacturing a display member will be described with reference to FIG. 1 and FIGS. 18 to 32. A configuration of the display member, examples of a concealment pattern and a second image pattern, application examples of the display member, and examples will be sequentially described below.

[Configuration of Display Member]

Figure 18:
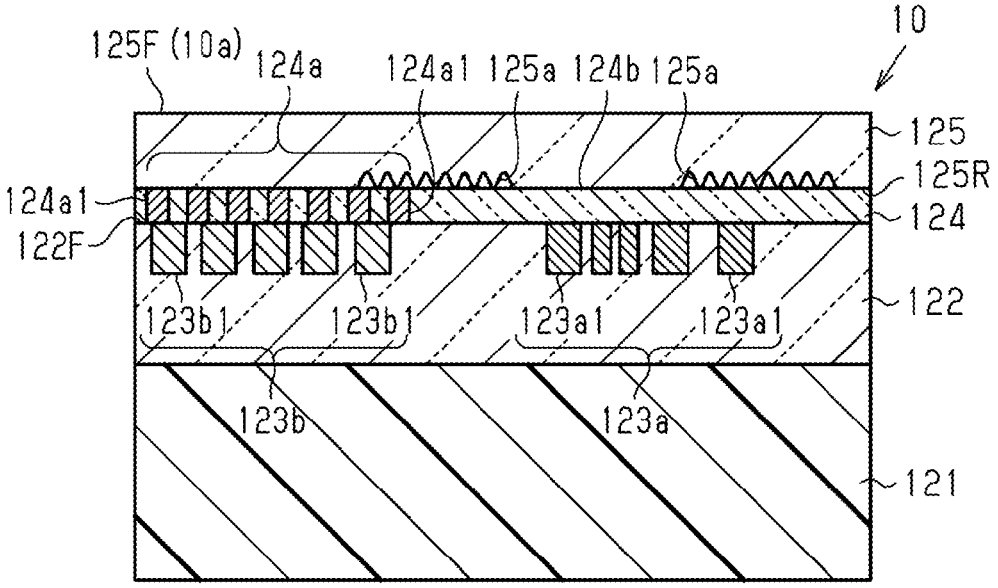
FIG. 18 is a cross-sectional view showing a structure taken along line I-I in FIG. 1.

A configuration of the display member will be described with reference to FIGS. 1 and 18. In FIG. 1, for convenience of illustration, a diffraction image formed by a diffraction portion of the personal authentication medium is not illustrated.

As shown in FIG. 1, the display member 10 has the front surface 10*a* which is an observation object. In plan view of the front surface 10*a*, the display member 10 displays the character authentication image 12 and the face authentication image 11 composed of the facial image 11*a*, the background image 11*c*, and the related image 11*b*. The display member 10 has a plate shape extending along the X direction which is one direction and the Y direction which is a direction orthogonal to the X direction.

The character authentication image 12 is covered by the front surface 10*a*, and includes one or more first information elements for identifying the owner of the display member 10. As the first information elements for identifying the owner, the character authentication image 12 includes a name, a nationality, and a date of birth of the owner. The character authentication image 12 may include an information element for identifying the owner other than these elements, and may include an information element other than the information elements for identifying the owner. As the information element other than the information elements for identifying the owner, the display member 10 of the present embodiment includes a date of expiry of the display member 10. The character authentication image 12 is an example of a first image pattern.

The facial image 11*a* is a facial image of the owner of the display member 10, and is an image that differs from the character authentication image 12 and is for identifying the owner of the display member 10. The facial image 11*a* is an example of a second image. The background image 11*c* is an image surrounding the facial image 11*a*.

The related image 11*b* is formed by overlapping of a second image pattern with a concealment pattern. The related image 11*b* is an image that is not produced only by the second image pattern, and an image that is not produced only by the concealment pattern. The related image 11*b* is a second information element for identifying the owner, and includes the same information as at least one or more of the first information elements included in the character authentication image 12. In the present embodiment, as the second information element related to the owner, the related image 11*b* includes the date of birth of the owner.

As shown in FIG. 2, the display member 10 includes a substrate 121, an adhesive layer 122, a concealing layer 124, and a protective layer 125, which are laminated in this order in the display member 10.

The substrate 121 needs to have strength capable of supporting the adhesive layer 122, the concealing layer 124, and the protective layer 125 laminated on the substrate 121. For example, the substrate 121 may be formed of various synthetic resins or various papers.

In the case where the substrate 121 is a resin film or a resin sheet, for example, the resin film or the resin sheet may be formed of a polyethylene terephthalate resin (PET), a polypropylene resin (PP), a polycarbonate resin (PC), a polymethyl methacrylate resin (PMMA), a polyethylene resin (PE), or the like.

The adhesive layer 122 has light transmissivity. The adhesive layer 122 needs to have adhesion that allows the concealing layer 124 to be adhered to the substrate 121. The adhesive layer 122 may be formed of various resins. The adhesive layer 122 functions as an image receiving layer for the first image pattern and the second image pattern, and thus the adhesive layer 122 preferably has high adhesion to ink constituting the image patterns. The adhesive layer 122 may have a function as an anchor layer for the substrate 121. Between the substrate 121 and the adhesive layer 122, the display member 10 may have an anchor layer which is a layer different from the adhesive layer 122.

A surface of the adhesive layer 122 in contact with the concealing layer 124 is a front surface 122F. On the front surface 122F of the adhesive layer 122, a first image pattern 123*a* and a second image pattern 123*b* are located. The first image pattern 123*a* is an image pattern which is covered by the front surface 10*a* and displays, through the front surface 10*a*, the character authentication image 12 including one or more pieces of information for identifying the owner of the display member 10.

The second image pattern 123*b* is an image pattern which is covered by the front surface 10*a* and in which one or more second information elements are embedded. Identification of the one or more second information elements embedded in the second image pattern is restricted by a part of the second image pattern. The second image pattern 123*b* has an image that differs from the character authentication image 12 produced by the first image pattern 123*a* and is for identifying the owner of the display member 10.

In the present embodiment, the second image pattern 123*b* includes a portion for displaying the facial image 11*a* and a portion for displaying the background image 11*c*. Furthermore, the second image pattern 123*b* includes a portion for forming the related image 11*b* together with the concealment pattern. Among these, the facial image 11*a* is the image that differs from the character authentication image 12 produced by the first image pattern 123*a* and is for identifying the owner of the display member 10. Furthermore, the portion of the second image pattern 123*b* for forming the related image 11*b* together with the concealment pattern is a portion of the second image pattern 123*b* in which the second information element is embedded. The portion of the second image pattern 123*b* for displaying the background image 11*c* is a portion for restricting identification of the second information element embedded in the second image pattern 123*b*.

The first image pattern 123*a* is composed of a plurality of printed dots 123*a*1, and the printed dots 123*a*1 are each formed of ink. For example, the ink for forming the printed dots 123*a*1 is pigment ink containing a pigment. The printed dots 123*a*1 are composed of printed dots of a single color, and for example, the printed dots 123*a*1 are composed of black printed dots 123*a*1.

For example, the first image pattern 123*a* is formed by a thermal transfer printing method using a thermal head, but may be formed by an ink-jet printing method or the electrophotographic method. The first image pattern 123*a* may include printed dots 123*a*1 formed by different respective methods.

The second image pattern 123*b* is composed of a plurality of printed dots 123*b*1, and the printed dots 123*b*1 are each formed of ink. For example, the ink for forming the printed dots 123*b*1 is pigment ink containing a pigment. The printed dots 123*b*1 are preferably composed of printed dots 123*b*1 of two or more colors, but may be composed of printed dots 123*b*1 of a single color.

Similarly to the first image pattern 123*a*, for example, the second image pattern 123*b* is formed by a thermal transfer printing method using a thermal head, but may be formed by the ink-jet printing method or the electrophotographic method.

Another adhesive layer may be located between the concealing layer 124 and the adhesive layer 122. In this case, the first image pattern 123*a* and the second image pattern 123*b* need to be located on a surface of the adhesive layer on a side opposite to a surface of the adhesive layer in contact with the concealing layer 124.

The first image pattern 123*a* does not need to be formed of ink. For example, the first image pattern 123*a* may be formed by irradiating, with a laser beam, a layer containing a thermosensitive coloring agent. In this case, the substrate 121 may be the layer containing a thermosensitive coloring agent, and a first image pattern may be formed on the substrate 121. Alternatively, the display member 10 may include a layer containing a thermosensitive coloring agent between the substrate 121 and the adhesive layer 122, and a first image pattern may be formed on the layer containing a thermosensitive coloring agent. In this case, the first image pattern may be composed of both a portion formed by the various printing methods described above and a portion formed on the layer containing a thermosensitive coloring agent.

The concealing layer 124 includes a concealment pattern 124*a* and a transmission portion 124*b*. The concealment pattern 124*a* is located closer to the front surface side than the second image pattern 123*b* is, i.e., at a portion closer to the front surface 10*a* than the second image pattern 123*b* is, and the concealment pattern 124*a* conceals a part of the second image pattern 123*b*. Thus, the concealment pattern 124*a* removes the restriction on identification of the second information element embedded in the second image pattern 123*b*. As a result of the removal of the restriction on identification of the second information element embedded in the second image pattern 123*b* by the concealment pattern 124*a*, the related image 11*b* is displayed.

According to the display member 10, the restriction on identification of the second information element embedded in the second image pattern 123*b* is removed by the concealment of the part of the second image pattern 123*b* by the concealment pattern 124*a*. Thus, as compared with a configuration in which the second information element can be identified only by the second image pattern 123*b*, falsification of the display member 10 can be better prevented.

The transmission portion 124*b* has light transmissivity, and has a layer shape filling a portion of the concealing layer 124 other than the concealment pattern 124*a*. The transmission portion 124*b* may be formed of a transparent resin or a transparent dielectric.

In the case where the transmission portion 124*b* is formed of a transparent dielectric, the transmission portion 124*b* functions as a transparent reflective layer. The transparent reflective layer may have a monolayer structure or a multilayer structure. In the case where the transparent reflective layer has a multilayer structure, a material for forming layers of the transparent reflective layer and the like may be selected so that reflection and interference repeatedly occur in the transparent reflective layer, i.e., so that the transparent reflective layer functions as a multilayer interference film. In such a configuration, for example, the transmission portion 124*b* may be formed of zinc sulfide, titanium dioxide, or the like.

The transmission portion 124*b* may be a metal layer that has light transmissivity and has a thickness of less than 20 nm. For example, the metal layer may be formed of chromium, nickel, aluminum, iron, titanium, silver, gold, copper, or the like.

The concealment pattern 124*a* is composed of a plurality of concealing portions 124*a*1. The concealing portions 124*a*1 have lower light transmissivity than the transmission portion 124*b*. Furthermore, in a state in which the concealing portions 124*a*1 overlap the printed dots 123*b*1, the concealing portions 124*a*1 block enough light to allow the printed dots 123*b*1 not to be visually recognized. In other words, the concealing portions 124*a*1 are opaque enough to have almost no light transmissivity.

The concealing portions 124*a*1 may be formed of the metals mentioned above as the material for forming the transmission portion 124*b*. Thus, the concealment pattern 124*a* can be formed by etching a metal film. However, the concealing portions 124*a*1 differ from the transmission portion 124*b* in that the concealing portions 124*a*1 have enough thickness to transmit almost no light incident on the concealing portions 124*a*1. The concealing portions 124*a*1 preferably have a thickness of 20 nm or more and 80 nm or less. Furthermore, out of the above metals, the concealing portions 124*a*1 is preferably formed of aluminum.

In plan view of the front surface 10*a*, the concealment pattern 124*a* needs to be large enough to overlap at least the portion of the second image pattern 123*b* for forming the related image 11*b*. In the present embodiment, however, the concealment pattern 124*a* is large enough to also overlap the portion of the second image pattern 123*b* for displaying the background image 11*c*.

The concealment pattern 124*a* may be formed by etching using a mask in which a metal layer is patterned to have a predetermined pattern. Alternatively, the concealment pattern 124*a* may be formed by forming a metal layer on a base layer having an asperity structure and then etching the metal layer. In this case, a portion of the asperity structure located at a portion of the base layer overlapping the concealment pattern 124*a* needs to be larger than a portion of the asperity structure located at a portion of the base layer not overlapping the concealment pattern 124*a*.

The protective layer 125 is a layer having light transmissivity, and is preferably a transparent layer. The protective layer 125 protects the concealing layer 124 of the display member 10 from chemical or physical damage. A surface of the protective layer 125 in contact with the concealing layer 124 is a back surface 125R, and a surface on a side opposite to the back surface 125R is a front surface 125F. The front surface 125F of the protective layer 125 is the front surface 10*a* of the display member 10.

Diffraction portions 125*a* are located on the back surface 125R of the protective layer 125. The diffraction portions 125*a* are located closer to the front surface side than the concealment pattern 124*a* is, i.e., at a portion closer to the front surface 10*a* than the concealment pattern 124*a* is, and are configured such that diffracted light is emitted due to asperities. In other words, the diffraction portions 125*a* are located between the concealment pattern 124*a* and the front surface 10*a*. The protective layer 125 includes two diffraction portions 125*a*, and in plan view of the front surface 10*a*, one of the diffraction portions 125*a* overlaps the first image pattern 123*a*, and the other of the diffraction portions 125*a* overlaps the concealment pattern 124*a*.

Thus, since the display member 10 includes the diffraction portions 125*a*, falsification of the display member 10 becomes more difficult. This can consequently better prevent falsification of the display member 10. Furthermore, a diffraction image formed by the diffracted light emitted from the diffraction portions 125*a* overlaps the character authentication image 12 produced by the first image pattern 123*a*, and also overlaps the related image 11*b* formed by the overlapping of the concealment pattern 124*a* with the second image pattern 123*b*. This improves designability of the display member 10. Furthermore, since the images each need to be aligned with the diffraction image, falsification of the display member 10 becomes more difficult. This can consequently better prevent falsification of the display member 10.

The diffraction portions 125*a* need to include at least one of a hologram and a diffraction grating. The protective layer 125 may be formed of a photocurable resin, a thermosetting resin, or a thermoplastic resin.

Among these, examples of the photocurable resin include a polycarbonate resin, an acrylic resin, a fluorine acrylic resin, a silicone acrylic resin, an epoxy acrylate resin, a polystyrene resin, a cycloolefin polymer, a methylstyrene resin, a fluorene resin, a polyethylene terephthalate resin, and a polypropylene resin. Examples of the thermosetting resin include an acrylonitrile-styrene copolymer resin, a phenolic resin, a melamine resin, a urea resin, and an alkyd resin. Examples of the thermoplastic resin include a polypropylene resin, a polyethylene terephthalate resin, and a polyacetal resin. The material for forming the protective layer 125 preferably has a refractive index of approximately 1.5.

The diffraction portions 125*a* may be located on the front surface 125F of the protective layer 125. However, in terms of better preventing chemical or physical damage to the diffraction portions 125*a*, the diffraction portions 125*a* are preferably located on the back surface 125R of the protective layer 125. The display member 10 may have a layer that differs from the protective layer 125, is located between the protective layer 125 and the concealing layer 124, and includes a diffraction portion. The diffraction portions 125*a* may be omitted.

Examples of Concealment Pattern and Second Image Pattern

Examples of the concealment pattern and the second image pattern will be described with reference to FIGS. 19 to 30. As a combination of the concealment pattern and the second image pattern, six examples in which at least one of the concealment pattern and the second image pattern is different will be described below.

First Example

A first example will be described with reference to FIGS. 19 and 20.

Figure 19:
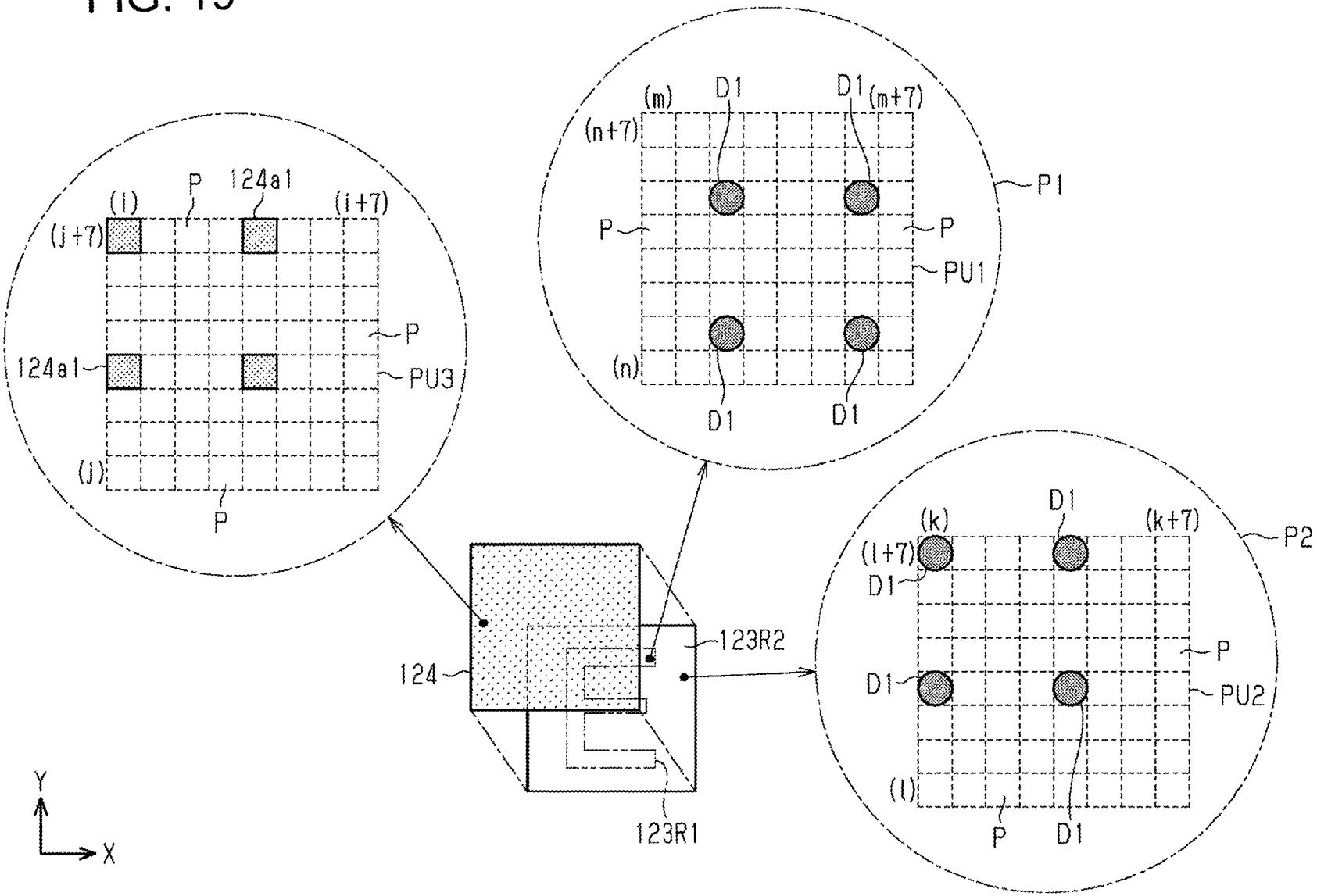
FIG. 19 is a plan view showing a structure of a concealing layer and a second image pattern of a first example, together with an enlarged plan view of a part of a concealment pattern and the second image pattern.

As shown in FIG. 19, in plan view of the front surface 10*a* of the display member 10, the second image pattern 123*b* includes a first region 123R1 and a second region 123R2. The first region 123R1 is a region composed of a plurality of printed dots 123*b*1 for forming the related image 11*b*, and is a region of the second image pattern 123*b* in which the second information element is embedded. The second region 123R2 is a region composed of a plurality of printed dots 123*b*1 for forming the background image 11*c*, and is a region of the second image pattern 123*b* that restricts identification of the second information element.

On the image receiving layer on which the first image pattern 123*a* and the second image pattern 123*b* are formed, a plurality of image cells arranged along the X direction and the Y direction are set. As a pixel position which is a position of a pixel, i.e., the printed dot 123*b*1, located in the image cell, unique coordinates in the XY coordinate system are assigned to each of the plurality of image cells. In plan view of the front surface 10*a*, the plurality of image cells form a square lattice.

Among all the image cells, a region in which the plurality of printed dots 123*b*1 for forming the related image 11*b* are arranged is a first cell region P1, and a region in which the plurality of printed dots 123*b*1 for forming the background image 11*c* are arranged is a second cell region P2.

A plurality of image cells P belonging to the first cell region P1 include a plurality of image cells P bounded by an image cell P located at (m, n), an image cell P located at (m, n+7), an image cell P located at (m+7, n), and an image cell P located at (m+7, n+7). A set of these image cells P is a first cell unit PU1.

In the first cell unit PU1, a first dot D1 is located in each of an image cell P located at (m+2, n+1), an image cell P located at (m+6, n+1), an image cell P located at (m+2, n+5), and an image cell P located at (m+6, n+5). The first dots D1 are each an example of a printed dot. In the image cell P in which the first dot D1 is located, the first dot D1 has a shape of a circle inscribed in the image cell P.

In the first cell region P1, the plurality of first cell units PU1 are arranged with no space therebetween. Thus, in the first cell region P1, a pitch between the first dots D1 in the X direction is 4 times that of the image cells P, and a pitch between the first dots D1 in the Y direction is 4 times that of the image cells P.

A plurality of image cells P belonging to the second cell region P2 include a plurality of image cells P bounded by an image cell P located at (k, l), an image cell P located at (k, l+7), an image cell P located at (k+7, l), and an image cell P located at (k+7, l+7). A set of these image cells P is a second cell unit PU2.

In the second cell unit PU2, a first dot D1 is located in each of an image cell P located at (k, l+3), an image cell P located at (k+4, l+3), the image cell P located at (k, l+7), and an image cell P located at (k+4, l+7).

In the second cell region P2, the plurality of second cell units PU2 are arranged with no space therebetween. Thus, similarly to the first cell region P1, in the second cell region P2, a pitch between the first dots D1 in the X direction is 4 times that of the image cells P, and a pitch between the first dots D1 in the Y direction is 4 times that of the image cells P. However, when the first cell unit PU1 is overlapped with the second cell unit PU2, positions of the first dots D1 located in the first cell unit PU1 are shifted by 2 image cells P in the X direction and 2 image cells P in the Y direction from positions of the first dots D1 located in the second cell unit PU2.

The concealing layer 124 is a layer superimposed on the image receiving layer on which the second image pattern 123*b* is formed. Thus, similarly to the image receiving layer, also in the concealing layer 124, a plurality of image cells P arranged along the X direction and the Y direction can be set. As a pixel position which is a position of a pixel located in the image cell P, unique coordinates in the XY coordinate system are assigned to each of the plurality of image cells P. In plan view of the front surface 10*a*, the plurality of image cells P form a square lattice.

The image cells P include a plurality of image cells P bounded by an image cell P located at (i, j), an image cell P located at (i, j+7), an image cell P located at (i+7, j), and an image cell P located at (i+7, j+7). A set of these image cells P is a third cell unit PU3.

In the third cell unit PU3, a concealing portion 124*a*1 is located in each of an image cell P located at (i, j+3), an image cell P located at (i+4, j+3), the image cell P located at (i, j+7), and an image cell P located at (i+4, j+7). The concealing portions 124*a*1 each have a square shape having the same size as the image cells P.

In portions of the concealing layer 124 for forming the related image 11*b* and the background image 11*c*, the third cell units PU3 are arranged with no space therebetween. Thus, similarly to the first cell region P1 and the second cell region P2, a pitch between the concealing portions 124*a*1 in the X direction is 4 times that of the image cells P, and a pitch between the concealing portions 124*a*1 in the Y direction is 4 times that of the image cells P. Furthermore, when the second cell unit PU2 is overlapped with the third cell unit PU3, the concealing portions 124*a*1 overlap the different respective first dots D1.

Thus, the concealment pattern 124*a* may include the plurality of concealing portions 124*a*1 having a dot shape, and the concealing portions 124*a*1 may be arranged at regular intervals in an arrangement direction which is at least one direction. According to this configuration, the concealing portions 124*a*1 having the same shape are arranged at regular intervals in the arrangement direction. Thus, as compared with a configuration in which the concealing portions have random shapes or a configuration in which the concealing portions are randomly arranged, the concealment pattern 124*a* can be easily formed.

Figure 20:
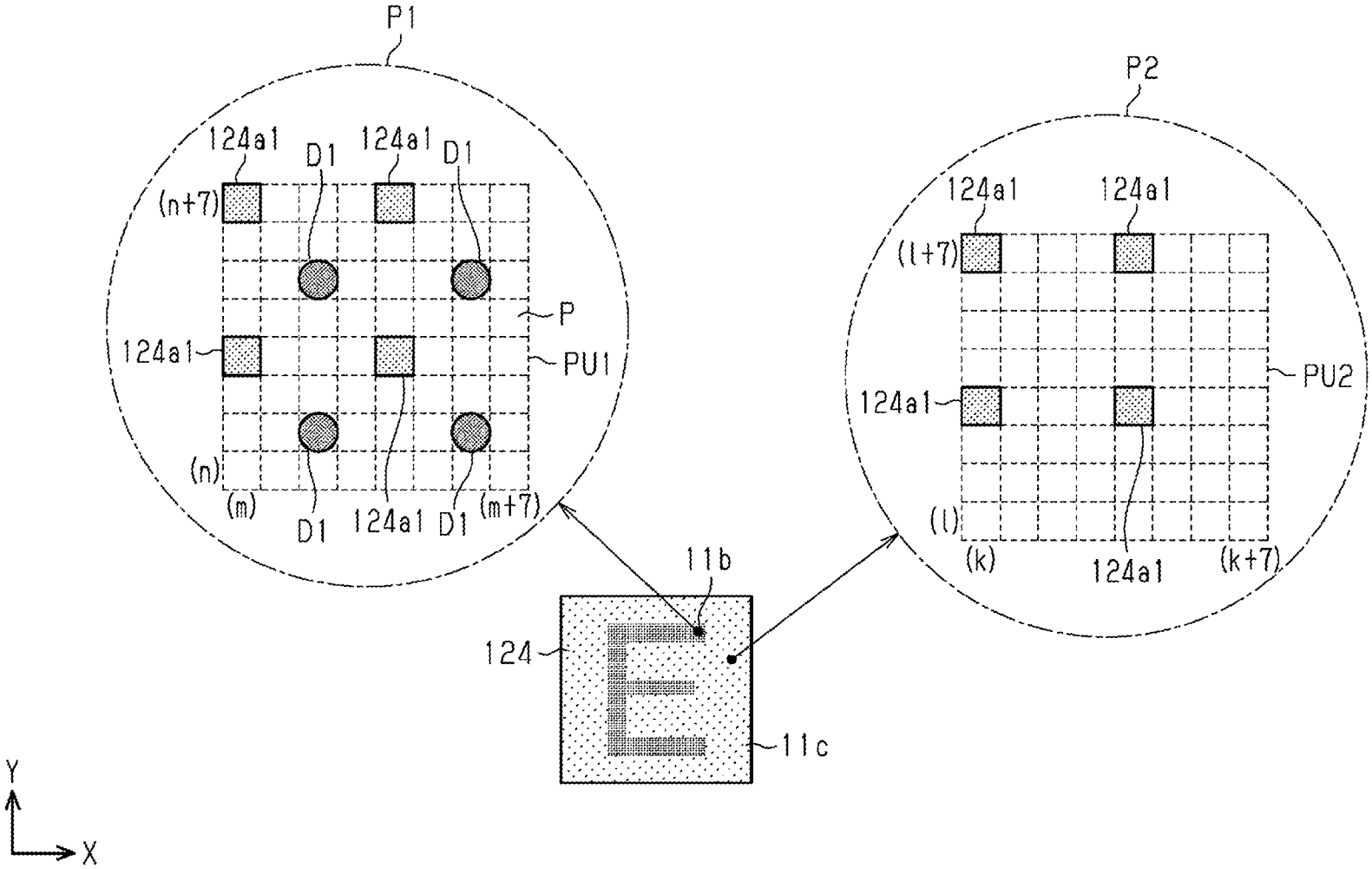
FIG. 20 is a plan view showing a structure of a second information image of the first example, together with an enlarged plan view of a part of the concealment pattern and the second image pattern.

As shown in FIG. 20, when the concealment pattern 124*a* is overlapped with the second image pattern 123*b*, in the second image pattern 123*b*, none of the first dots D1 located in the first region 123R1 is concealed by the concealment pattern 124*a*. On the other hand, all the first dots D1 located in the second region 123R2 are concealed by the concealment pattern 124*a*.

Thus, the background image 11*c* is formed only by the concealment pattern 124*a*, while the related image 11*b* is formed by the concealment pattern 124*a* and the second image pattern 123*b*. Accordingly, the background image 11*c* has a color tone different from a color tone of the related image 11*b*.

As a result, the restriction on identification of the second information element embedded in the second image pattern 123*b* is removed. In other words, the related image 11*b* is formed by the concealment pattern 124*a* and the second image pattern 123*b* so that an observer of the display member 10 can visually recognize the related image 11*b*. Thus, when the related image 11*b* is formed in this manner, a reading device for the display member 10 can distinguish the related image 11*b* from the background image 11*c*. The reading device can consequently read the related image 11*b*.

As described above, in the second image pattern 123*b*, a density of the first dots D1 is equal between the first region 123R1 and the second region 123R2. Accordingly, when only the second image pattern 123*b* is visually recognized, in the second image pattern 123*b*, the first region 123R1 is not distinguished from the second region 123R2. Thus, the second region 123R2 restricts identification of the second information element embedded in the first region 123R1.

Furthermore, for example, the first dots D1 are formed of black ink, but the first dots D1 may be formed of printed dots of at least one color of cyan, magenta, and yellow. In the case where the first dots D1 are formed of printed dots of a plurality of colors, the printed dots of the respective colors are formed by a dot-on-dot method, i.e., the printed dots of the respective colors are formed so that the printed dots overlap each other. Accordingly, the second image pattern 123*b* include overlapping dots in which a plurality of printed dots overlap each other. The dot-on-dot method is a printing method in which overlapping dots are formed. The overlapping dots can be formed by forming a plurality of printed dots so that the printed dots overlap each other in a single image cell P.

Thus, when the second image pattern 123*b* has been formed by a printing method different from the dot-on-dot method, it can be determined, according to a shape of printed dots constituting the second image pattern, whether the display member 10 has been falsified. This effect can also be obtained in a configuration in which the first image pattern 123*a* includes overlapping dots.

For example, when the second image pattern has been formed by means of a color copying machine that forms an image according to the CMYK color model, cyan printed dots, magenta printed dots, and yellow printed dots are arranged in an arrangement unique to the color copying machine. Accordingly, even when the second image pattern is overlapped with the concealment pattern 124*a*, it is difficult to form the same image as the related image 11*b* formed together with the concealment pattern 124*a* by the second image pattern 123*b* composed of the printed dots formed by the dot-on-dot method. Thus, by observing the related image 11*b* displayed by the display member 10, it is possible to determine whether the display member 10 has been falsified.

Furthermore, the image cell P preferably has a unit length of 5 μm or more and 200 μm or less. In other words, a diameter of the printed dot 123*b*1 located in the image cell P and a unit length of the concealing portion 124*a*1 are each preferably 5 μm or more and 200 μm or less.

When the image cell P has a unit length of 5 μm or more, difficulty in alignment of the concealment pattern 124*a* with the second image pattern 123*b* is reduced. This better prevents a position of the concealment pattern 124*a* from being shifted from a position of the second image pattern 123*b*. As a result, the reading device for the display member 10 can easily read the information included in the related image 11*b*.

When the image cell P has a unit length of 200 μm or less, even if the position of the concealment pattern 124*a* is shifted from the position of the second image pattern 123*b*, it is possible to better prevent the shift from being increased to such an extent that the shift is visually recognized by an observer of the display member 10. In addition, the second image pattern 123*b* has resolution fine enough to better prevent falsification of the second image pattern 123*b*.

Second Example

A second example will be described with reference to FIGS. 21 and 22.

Figure 21:
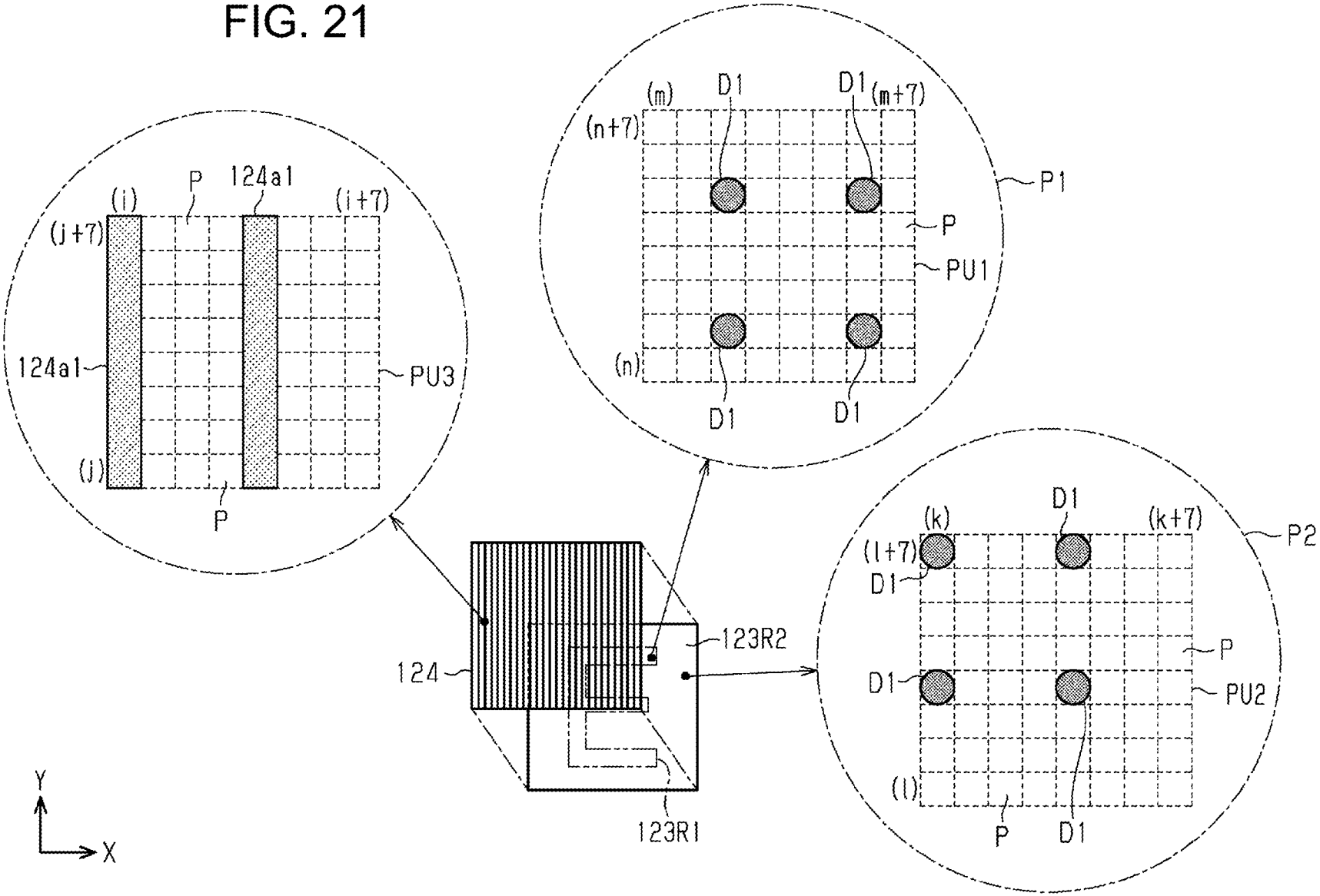
FIG. 21 is a plan view showing a structure of a concealing layer and a second image pattern of a second example, together with an enlarged plan view of a part of a concealment pattern and the second image pattern.

As shown in FIG. 21, in the second example, an arrangement of first dots D1 in each of the first region 123R1 and the second region 123R2 of the second image pattern 123*b* are similar to that of the first example.

On the other hand, in the third cell unit PU3 of the concealing layer 124, a concealing portion 124*a*1 has a line shape extending from an image cell P located at (i, j) to an image cell P located at (i, j+7). Furthermore, another concealing portion 124*a*1 has a line shape extending from an image cell P located at (i+4, j) to an image cell P located at (i+4, j+7). Accordingly, in the concealing layer 124, a pitch between the concealing portions 124*a*1 in the X direction is 4 times that of the image cells P. Thus, the concealment pattern 124*a* is a parallel line pattern in which a plurality of lines are arranged at regular intervals.

Figure 22:
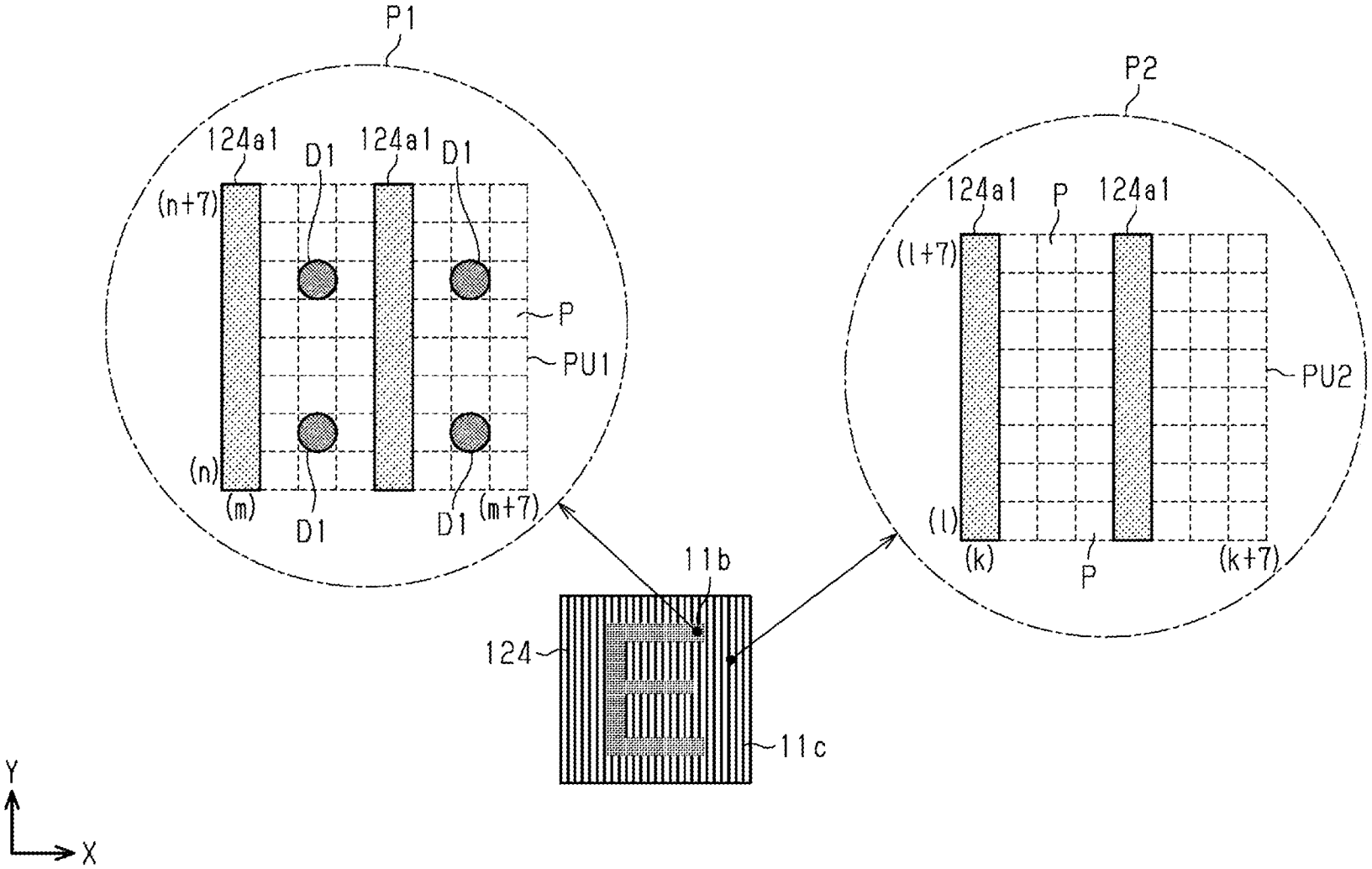
FIG. 22 is a plan view showing a structure of a second information image of the second example, together with an enlarged plan view of a part of the concealment pattern and the second image pattern.

Accordingly, as shown in FIG. 22, when the concealment pattern 124*a* is overlapped with the second image pattern 123*b*, similarly to the first example, none of the first dots D1 located in the first region 123R1 is concealed by the concealment pattern 124*a*. On the other hand, all the first dots D1 located in the second region 123R2 are concealed by the concealment pattern 124*a*.

As described above, the concealment pattern 124*a* may include the plurality of concealing portions 124*a*1 having a line shape, and the concealing portions 124*a*1 may be arranged at regular intervals in the X direction intersecting the Y direction in which the concealing portions 124*a*1 extend, i.e., in an arrangement direction. According to this configuration, the plurality of concealing portions 124*a*1 having a line shape are arranged at regular intervals in the arrangement direction. Thus, as compared with a configuration in which the concealing portions have random shapes or a configuration in which the concealing portions are randomly arranged, the concealment pattern 124*a* can be easily formed.

Third Example

A third example will be described with reference to FIGS. 23 and 24.

Figure 23:
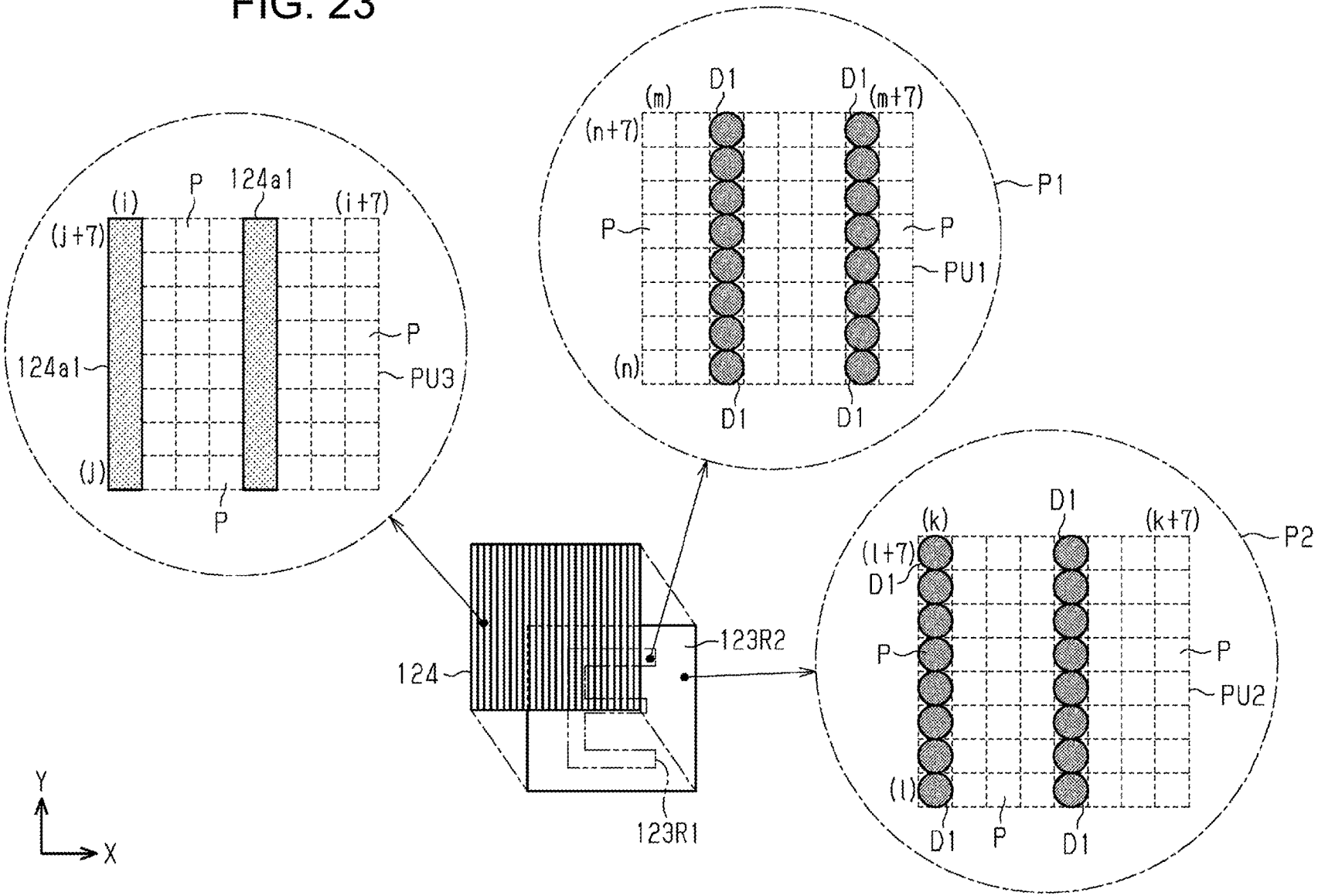
FIG. 23 is a plan view showing a structure of a concealing layer and a second image pattern of a third example, together with an enlarged plan view of a part of a concealment pattern and the second image pattern.

As shown in FIG. 23, in the third example, an arrangement of concealing portions 124*a*1 in the concealing layer 124 is similar to that of the second example.

On the other hand, in the first cell unit PU1 of the first region 123R1, first dots D1 are located in eight respective image cells P arranged along the Y direction from an image cell P located at (m+2, n) to an image cell P located at (m+2, n+7). Furthermore, first dots D1 are located in eight respective image cells P arranged along the Y direction from an image cell P located at (m+6, n) to an image cell P located at (m+6, n+7).

In the second cell unit PU2 of the second region 123R2, first dots D1 are located in eight respective image cells P arranged along the Y direction from an image cell P located at (k, l) to an image cell P located at (k, l+7). Furthermore, first dots D1 are located in eight respective image cells P arranged along the Y direction from an image cell P located at (k+4, l) to an image cell P located at (k+4, l+7).

Figure 24:
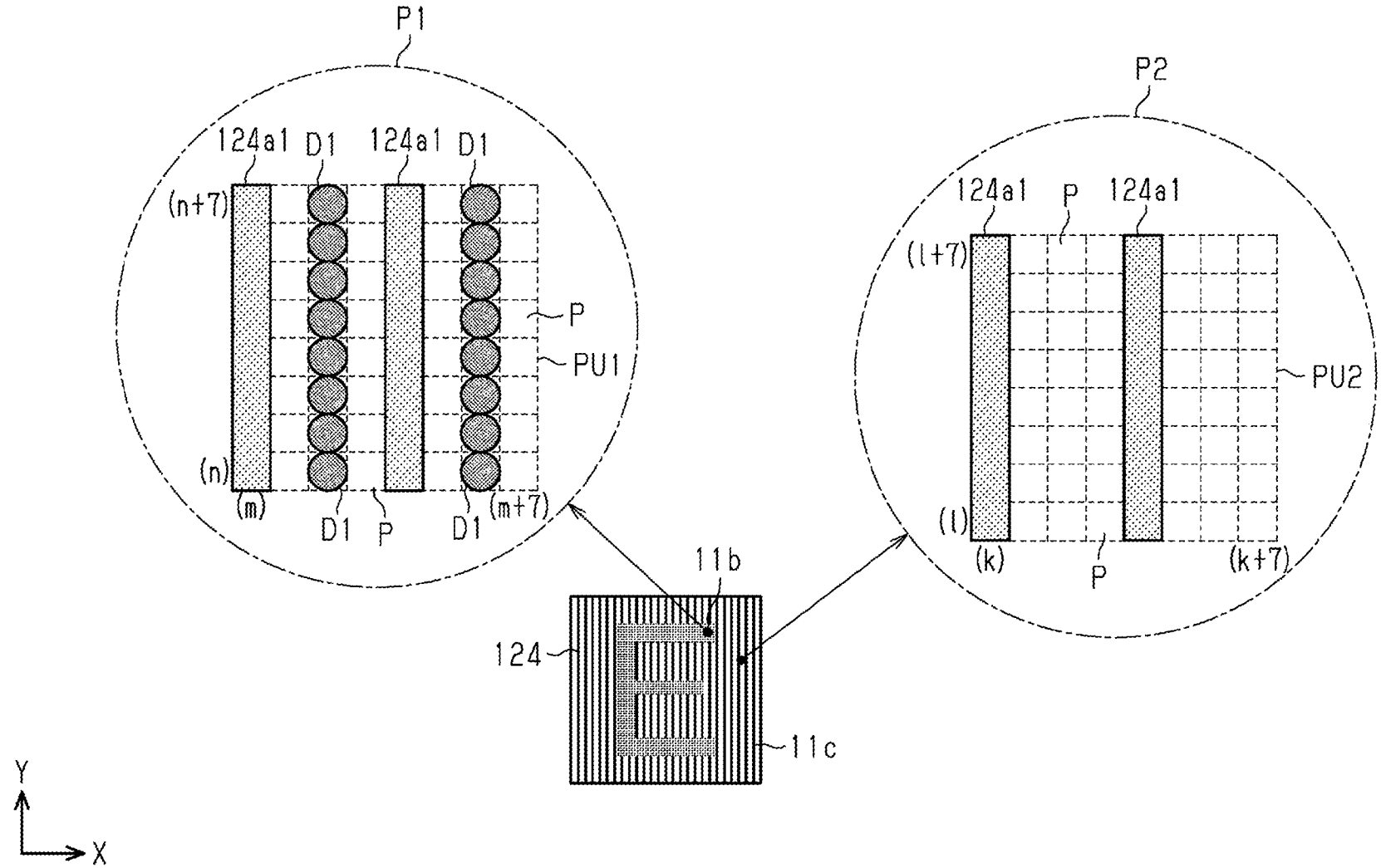
FIG. 24 is a plan view showing a structure of a second information image of the third example, together with an enlarged plan view of a part of the concealment pattern and the second image pattern.

Accordingly, as shown in FIG. 24, when the concealment pattern 124*a* is overlapped with the second image pattern 123*b*, similarly to the first example, none of the first dots D1 located in the first region 123R1 is concealed by the concealment pattern 124*a*. On the other hand, all the first dots D1 located in the second region 123R2 are concealed by the concealment pattern 124*a*.

Fourth Example

A fourth example will be described with reference to FIGS. 25 and 26.

Figure 25:
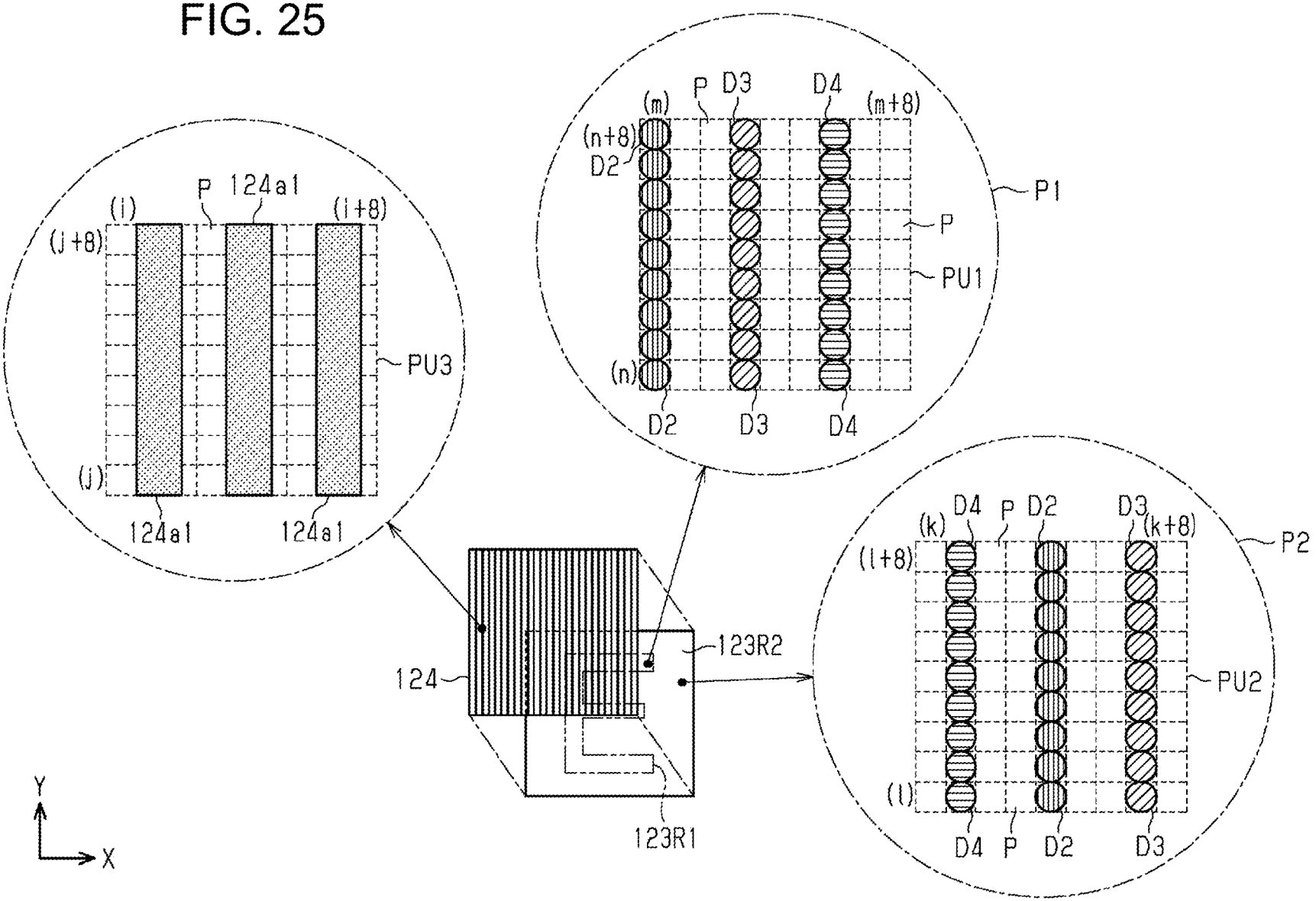
FIG. 25 is a plan view showing a structure of a concealing layer and a second image pattern of a fourth example, together with an enlarged plan view of a part of a concealment pattern and the second image pattern.

As shown in FIG. 25, a plurality of image cells P belonging to the first cell region P1 include a plurality of image cells P bounded by an image cell P located at (m, n), an image cell P located at (m, n+8), an image cell P located at (m+8, n), and an image cell P located at (m+8, n+8). A set of these image cells P is a first cell unit PU1.

In the first cell unit PU1, second dots D2, third dots D3, and fourth dots D4 are located. The second dots D2, the third dots D3, and the fourth dots D4 differ from each other in color of dots. The second dots D2, the third dots D3, and the fourth dots D4 are each an example of the printed dot 123*b*1.

In the first cell unit PU1, second dots D2 are located in nine respective image cells P arranged along the Y direction from the image cell P located at (m, n) to the image cell P located at (m, n+8). Third dots D3 are located in nine respective image cells P arranged along the Y direction from an image cell P located at (m+3, n) to an image cell P located at (m+3, n+8). Fourth dots D4 are located in nine respective image cells P arranged along the Y direction from an image cell P located at (m+6, n) to an image cell P located at (m+6, n+8).

In the first cell region P1, the plurality of first cell units PU1 are arranged with no space therebetween. Thus, in the first cell region P1, a pitch in the X direction between rows of the printed dots of each of the colors is 9 times that of the image cells P, and a pitch between rows of the printed dots adjacent to each other in the X direction is 3 times that of the image cells P. In other words, the pitch in the X direction between the rows of the printed dots of each of the colors and the pitch between the rows of the printed dots adjacent to each other in the X direction are an integral multiple of the size of the printed dot which is an example of a pixel.

A plurality of image cells P belonging to the second cell region P2 include a plurality of image cells P bounded by an image cell P located at (k, l), an image cell P located at (k, l+8), an image cell P located at (k+8, l), and an image cell P located at (k+8, l+8). A set of these image cells P is a second cell unit PU2.

In the second cell unit PU2, fourth dots D4 are located in nine respective image cells P arranged along the Y direction from an image cell P located at (k+1, l) to an image cell P located at (k+1, l+8). Second dots D2 are located in nine respective image cells P arranged along the Y direction from an image cell P located at (k+4, l) to an image cell P located at (k+4, l+8). Third dots D3 are located in nine respective image cells P arranged along the Y direction from an image cell P located at (k+7, l) to an image cell P located at (k+7, l+8).

In the second cell region P2, the plurality of second cell unit PU2 are arranged with no space therebetween. Thus, similarly to the first cell region P1, in the second cell region P2, a pitch in the X direction between rows of the printed dots of each of the colors is 9 times that of the image cells P, and a pitch between rows of the printed dots adjacent to each other in the X direction is 3 times that of the image cells P. In other words, the pitch in the X direction between the rows of the printed dots of each of the colors and the pitch between the rows of the printed dots adjacent to each other in the X direction are an integral multiple of the size of the printed dot which is an example of a pixel.

However, when the first cell unit PU1 is overlapped with the second cell unit PU2, positions of the printed dots of the respective colors located in the first cell unit PU1 are shifted by 4 image cells P in the X direction from positions of the printed dots of the respective colors located in the second cell unit PU2.

The image cells P include a plurality of image cells P bounded by an image cell P located at (i, j), an image cell P located at (i, j+8), an image cell P located at (i+8, j), and an image cell P located at (i+8, j+8). A set of these image cells P is a third cell unit PU3.

In the third cell unit PU3, a first concealing portion 124*a*1 extends from an image cell P located at (i+1, j) to an image cell P located at (i+1, j+8). In addition, the first concealing portion 124*a*1 extends from an image cell P located at (i+2, j) to an image cell P located at (i+2, j+8) with a width of only ½ of the unit length of the image cell P. Thus, the first concealing portion 124*a*1 has a width of 1.5 times that of the image cell P.

A second concealing portion 124*a*1 extends from an image cell P located at (i+4, j) to an image cell P located at (i+4, j+8). Furthermore, the second concealing portion 124*a*1 extends in the X direction and extends from an image cell P located at (i+5, j) to an image cell P located at (i+5, j+8). Thus, the second concealing portion 124*a*1 has a width of 1.5 times that of the image cell P.

A third concealing portion 124*a*1 extends from an image cell P located at (i+7, j) to an image cell P located at (i+7, j+8). Furthermore, the third concealing portion 124*a*1 extends in the X direction and extends from an image cell P located at (i+8, j) to an image cell P located at (i+8, j+8). Thus, the third concealing portion 124*a*1 has a width of 1.5 times that of the image cell P.

In portions of the concealing layer 124 for forming the related image 11*b* and the background image 11*c*, the third cell units PU3 are arranged with no space therebetween. Thus, a pitch in the X direction between the concealing portions 124*a*1 is 3 times that of the image cells P, and is equal to the pitch in the X direction between the rows of the printed dots in each of the cell regions. Furthermore, when the second cell unit PU2 is overlapped with the third cell unit PU3, the concealing portions 124*a*1 overlap the different respective rows of the printed dots.

Figure 26:
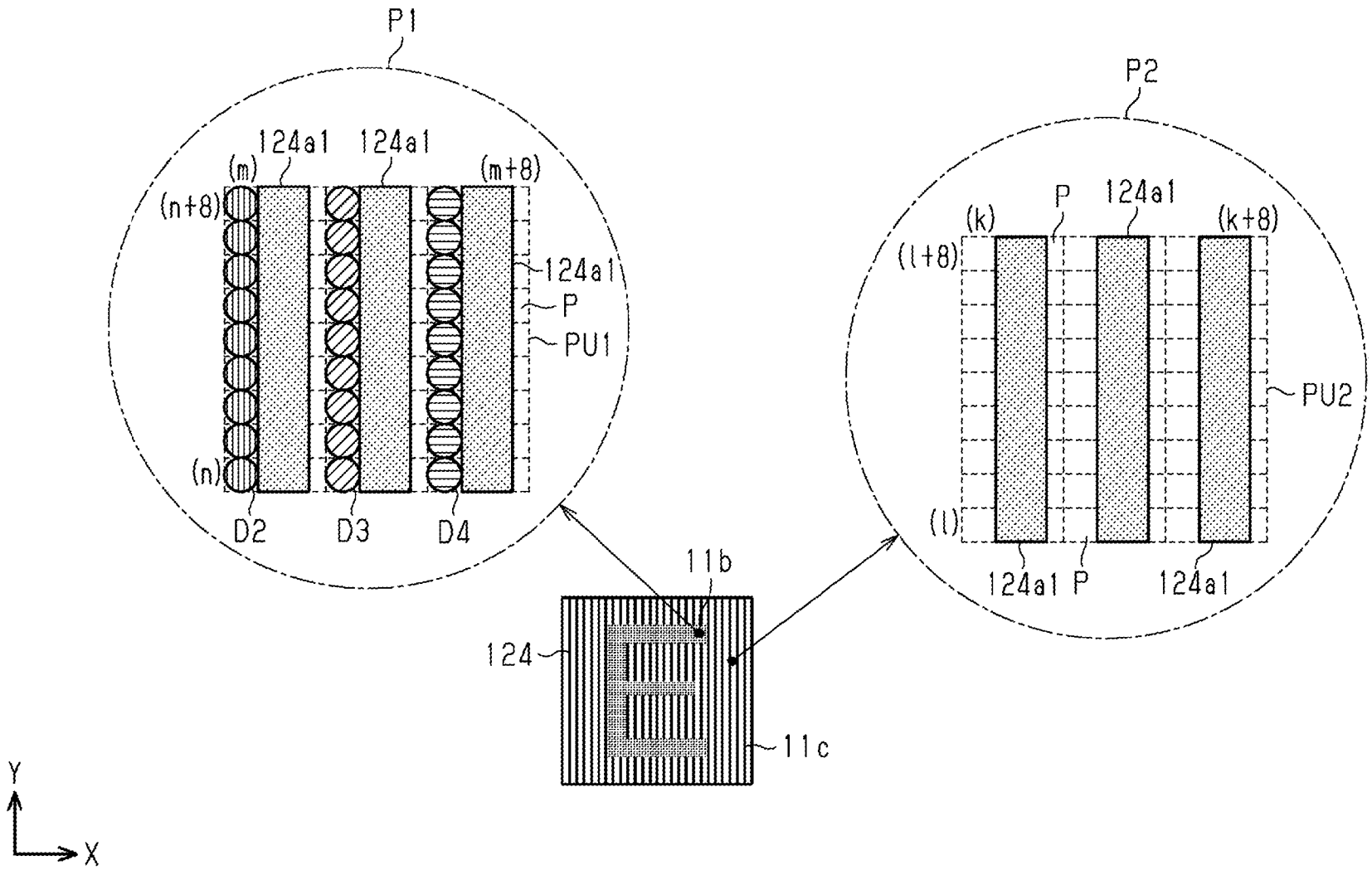
FIG. 26 is a plan view showing a structure of a second information image of the fourth example, together with an enlarged plan view of a part of the concealment pattern and the second image pattern.

Thus, as shown in FIG. 26, when the concealment pattern 124*a* is overlapped with the second image pattern 123*b*, in the second image pattern 123*b*, none of the printed dots located in the first region 123R1 is concealed by the concealment pattern 124*a*. On the other hand, all the printed dots located in the second region 123R2 are concealed by the concealment pattern 124*a*.

Thus, the background image 11*c* is formed only by the concealment pattern 124*a*, while the related image 11*b* is formed by the concealment pattern 124*a*, the second dots D2, the third dots D3, and the fourth dots D4. Accordingly, the background image 11*c* has a color tone different from a color tone of the related image 11*b*. As a result, the restriction on identification of the second information element embedded in the second image pattern 123*b* is removed. In other words, the related image 11*b* is formed by the concealment pattern 124*a* and the second image pattern 123*b* so that an observer of the display member 10 can visually recognize the related image 11*b*.

As described above, in the second image pattern 123*b*, the pitch between the rows of the second dots D2, the pitch between the rows of the third dots D3, and the pitch between the rows of the fourth dots D4 are equal between the first region 123R1 and the second region 123R2. Accordingly, when only the second image pattern 123*b* is visually recognized, the second image pattern 123*b* is a single image composed of the second dots D2, the third dots D3, and the fourth dots D4, and in the second image pattern 123*b*, the first region 123R1 is not distinguished from the second region 123R2. Thus, the second region 123R2 restricts identification of the second information element embedded in the first region 123R1.

For example, the second dots D2, the third dots D3, and the fourth dotes D4 are each formed of at least one of cyan printed dots, magenta printed dots, and yellow printed dots, and as described above, the second dots D2, the third dots D3, and the fourth dots D4 have different respective colors.

Fifth Example

A fifth example will be described with reference to FIGS. 27 and 28. The fifth example differs from the fourth example described above in positions of a plurality of image cells P in which printed dots of the respective colors are arranged and in positions of a plurality of image cells P on which the concealment pattern 124*a* is superimposed.

Figure 27:
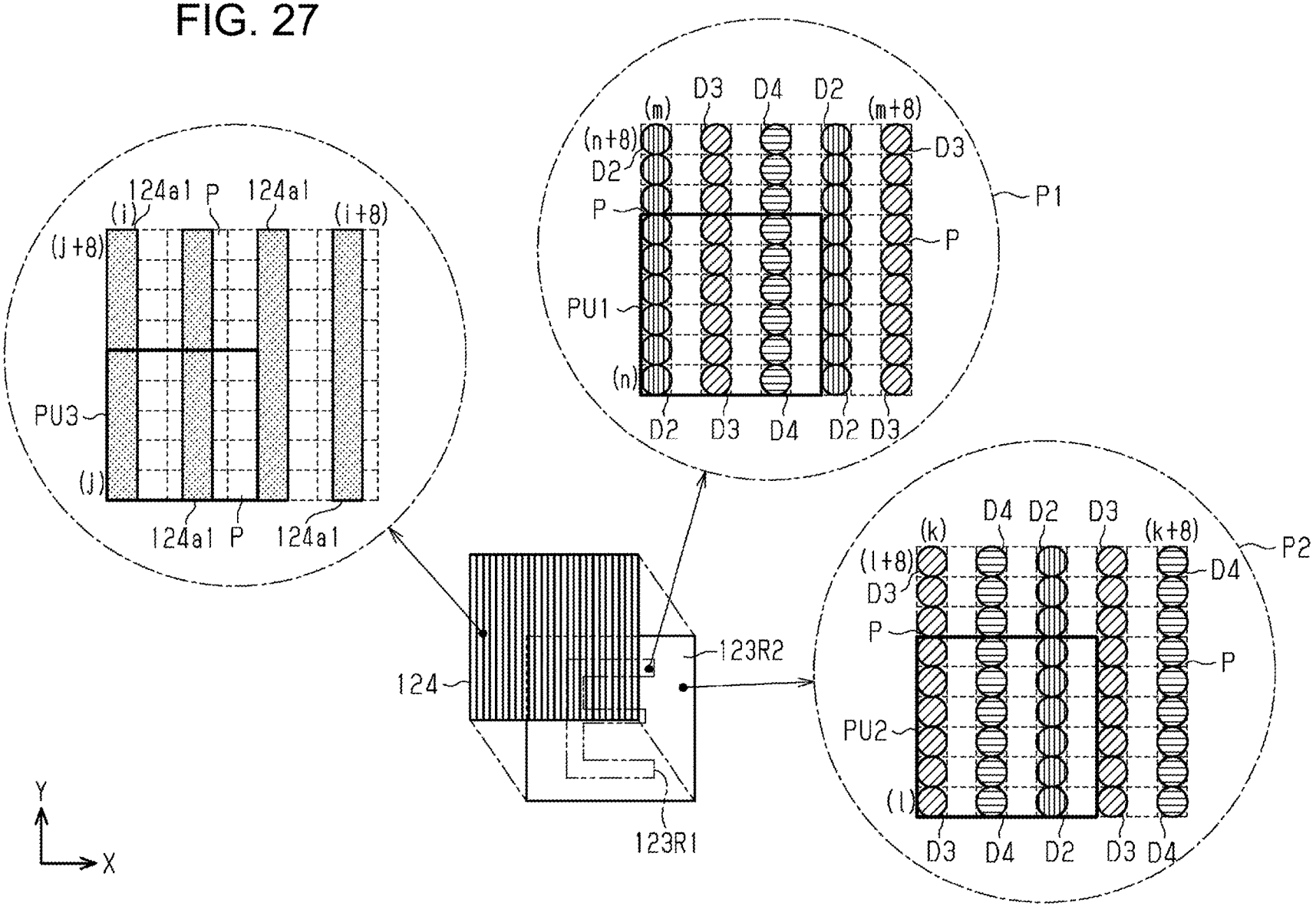
FIG. 27 is a plan view showing a structure of a concealing layer and a second image pattern of a fifth example, together with an enlarged plan view of a part of a concealment pattern and the second image pattern.

As shown in FIG. 27, in the first cell region P1, second dots D2 are located in nine respective image cells P arranged along the Y direction from an image cell P located at (m, n) to an image cell P located at (m, n+8). In addition, second dots D2 are located in nine respective image cells P arranged along the Y direction from an image cell P located at (m+6, n) to an image cell P located at (m+6, n+8).

Third dots D3 are located in nine respective image cells P arranged along the Y direction from an image cell P located at (m+2, n) to an image cell P located at (m+2, n+8). In addition, third dots D3 are located in nine respective image cells P arranged along the Y direction from an image cell P located at (m+8, n) to an image cell P located at (m+8, n+8).

Fourth dots D4 are located in nine respective image cells P arranged along the Y direction from an image cell P located at (m+4, n) to an image cell P located at (m+4, n+8).

In the first cell region P1, the first cell unit PU1 is composed of a plurality of image cells P located in a region bounded by the image cell P located at (m, n), an image cell P located at (m, n+5), an image cell P located at (m+5, n), and an image cell P located at (m+5, n+5). In the first cell region P1, the plurality of first cell units PU1 are arranged with no space therebetween. Thus, in the first cell region P1, a pitch in the X direction between rows of the printed dots of each of the colors is 6 times that of the image cells P, and a pitch between rows of the printed dots adjacent to each other in the X direction is twice that of the image cells P.

In the second cell region P2, third dots D3 are located in nine respective image cells P arranged along the Y direction from an image cell P located at (k, l) to an image cell P located at (k, l+8). In addition, third dots D3 are located in nine respective image cells P arranged along the Y direction from an image cell P located at (k+6, l) to an image cell P located at (k+6, l+8).

Fourth dots D4 are located in nine respective image cells P arranged along the Y direction from an image cell P located at (k+2, l) to an image cell P located at (k+2, l+8). In addition, fourth dots D4 are located in nine respective image cells P arranged along the Y direction from an image cell P located at (k+8, l) to an image cell P located at (k+8, l+8).

Second dots D2 are located in nine respective image cells P arranged along the Y direction from an image cell P located at (k+4, l) to an image cell P located at (k+4, l+8).

In the second cell region P2, the second cell unit PU2 is composed of a plurality of image cells P located in a region bounded by the image cell P located at (k, l), an image cell P located at (k, l+5), an image cell P located at (k+5, l), and an image cell P located at (k+5, l+5). In the second cell region P2, the plurality of second cell units PU2 are arranged with no space therebetween. Thus, similarly to the first cell region P1, in the second cell region P2, a pitch in the X direction between rows of the printed dots of each of the colors is 6 times that of the image cells P, and a pitch between rows of the printed dots adjacent to each other in the X direction is twice that of the image cells P.

However, when the first cell unit PU1 is overlapped with the second cell unit PU2, positions of the printed dots of the respective colors located in the first cell unit PU1 are shifted by 2 image cells P in the X direction from positions of the printed dots of the respective same colors located in the second cell unit PU2.

The concealment pattern 124*a* is composed of a plurality of concealing portions 124*a*1 having a line shape. The concealing portions 124*a*1 extend along the Y direction and have a width in the X direction equal to the unit length of the image cell P.

For example, the concealment pattern 124*a* includes a concealing portion 124*a*1 extending from an image cell P located at (i, j) to an image cell P located at (i, j+8). The concealment pattern 124*a* includes a concealing portion 124*a*1 extending from a position across an image cell P located at (i+2, j) and an image cell P located at (i+3, j) to a position across an image cell P located at (i+2, j+8) and an image cell P located at (i+3, j+8).

The concealment pattern 124*a* includes a concealing portion 124*a*1 extending from an image cell P located at (i+5, j) to an image cell P located at (i+5, j+8). The concealment pattern 124*a* includes a concealing portion 124*a*1 extending from a position that spans the image cell P located at (i+7, j) and the image cell P located at (i+8, j) to a position across the image cell P located at (i+7, j) and the image cell P located at (i+7, j+8).

In the concealment pattern 124*a*, a pitch between the plurality of concealing portions 124*a*1 arranged in the X direction is 2.5 times that between the image cells P. In the concealment pattern 124*a*, the third cell unit PU3 is composed of a plurality of image cells P located in a region bounded by the image cell P located at (i, j), an image cell P located at (i, j+4), an image cell P located at (i+4, j), and an image cell P located at (i+4, j+4).

In the fifth example, the pitch between the rows of the printed dots arranged in the X direction is twice that between the image cells P, while the pitch between the plurality of concealing portions 124*a*1 arranged in the X direction is 2.5 times that between the image cells P. In other words, the pitch between the concealing portions 124*a*1 is shifted by 25% from the pitch between the rows of the printed dots.

Figure 28:
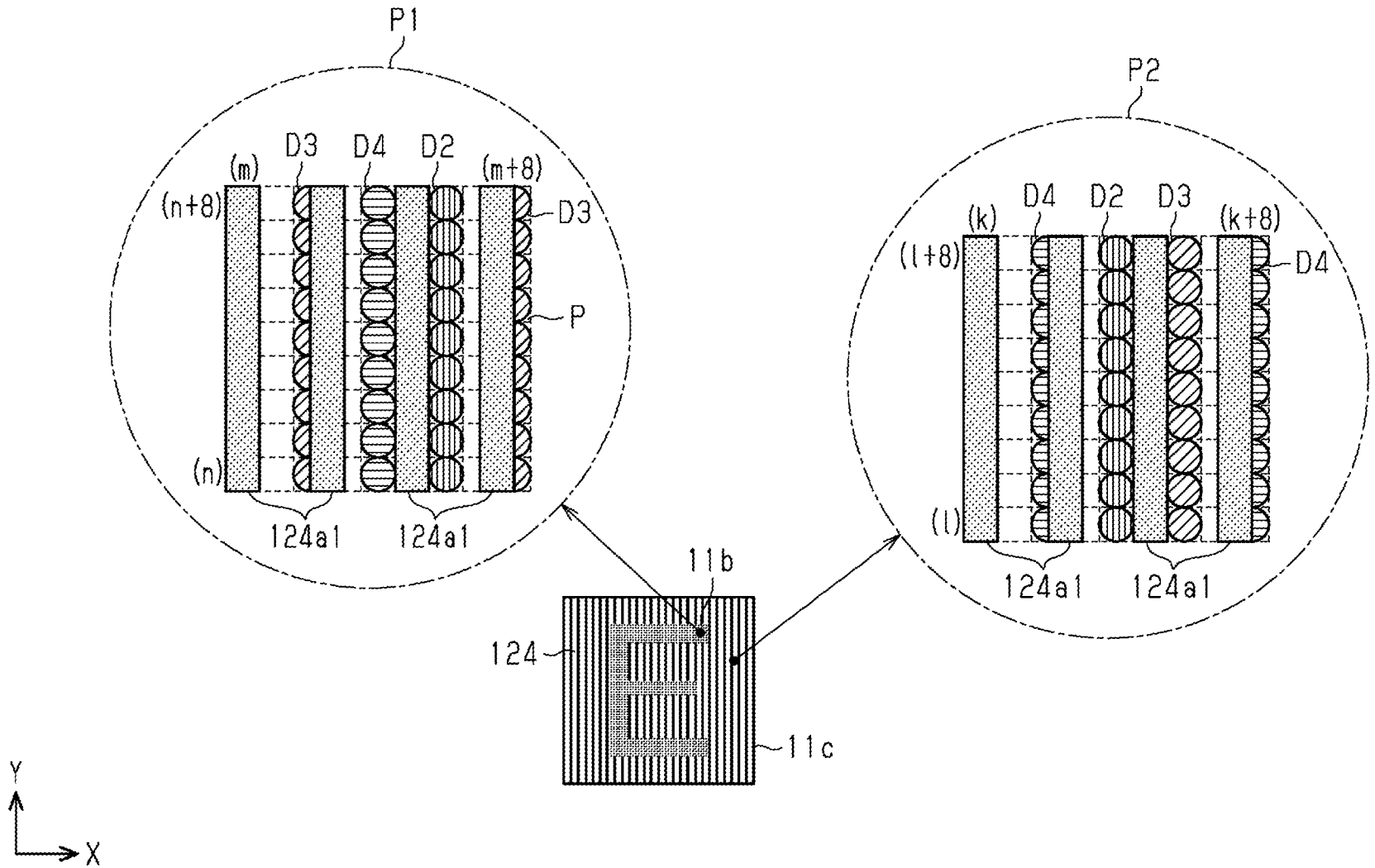
FIG. 28 is a plan view showing a structure of a second information image of the fifth example, together with an enlarged plan view of a part of the concealment pattern and the second image pattern.

Thus, as shown in FIG. 28, in both the first cell region P1 and the second cell region P2, in a repetition of a row of the second dots D2, a row of the third dots D3, and a row of the fourth dots D4, a row concealed by the concealment pattern 124*a* and a row not concealed by the concealment pattern 124*a* are changed along the X direction. Accordingly, in both the first cell region P1 and the second cell region P2, by the overlapping of the concealment pattern 124*a* with the second image pattern 123*b*, it is possible to form an image having a rainbow color, in other words, an image whose color gradually changes along the X direction.

Furthermore, the first cell region P1 differs from the second cell region P2 in an order in which the row of the second dots D2, the row of the third dots D3, and the row of the fourth dots D4 are arranged in the X direction. Accordingly, an image formed by the printed dots located in the first cell region P1 and the concealment pattern 124*a* has a rainbow color different from a rainbow color of an image formed by the printed dots located in the second cell region P2 and the concealment pattern 124*a*.

For example, in the first cell region P1, a row of the third dots D3 whose width in the X direction is ½, a row of the fourth dots D4, a row of the second dots, and a row of the third dots D3 whose width in the X direction is ½ are arranged in this order in the X direction, and thus a part of an image having a rainbow color is formed. On the other hand, in the second cell region P2, a row of the fourth dots D4 whose width in the X direction is ½, a row of the second dots D2, a row of the third dots D3, and a row of the fourth dots D4 whose width in the X direction is ½ are arranged in this order in the X direction, and thus a part of an image having a rainbow color is formed.

In order for the first cell region P1 and the second cell region P2 to form images having different respective rainbow colors, in the X direction, a pitch ratio, which is a shift of the pitch between the concealing portions 124*a*1 from the pitch between the rows of the printed dots, is preferably 25% or less. When the pitch ratio is 25% or less, as described above, the first cell region P1 and the second cell region P2 can form images having different respective rainbow colors.

Furthermore, as compared with a configuration in which the pitch ratio is more than 25%, when the pitch ratio is 25% or less, a portion corresponding to the first cell region P1 and a portion corresponding to the second cell region P2 are less likely to have stripes of a rainbow color in which the color changes at a pitch smaller than a pitch at which the color changes in the image of a rainbow color. Since the color changes at a small pitch in such stripes of a rainbow color, a difference between an image formed by the first cell region P1 and an image formed by the second cell region P2 is less likely to be distinguished. As a result, when the display member 10 is visually recognized or read by the reading device, the related image 11*b* is less likely to be distinguished from the background image 11*c*.

In this regard, when the pitch ratio is 25% or less, stripes of a rainbow color are less likely to be formed, and thus the image formed by the first cell region P1 is more likely to be distinguished from the image formed by the second cell region P2.

Sixth Example

A sixth example will be described with reference to FIGS. 29 and 30. Similarly to the fifth example, in the sixth example, by overlapping of the concealment pattern 124*a* with the second image pattern 123*b*, an image having a rainbow color is formed in the first cell region P1 and an image having a rainbow color is formed in the second cell region P2. However, the sixth example differs from the fifth example in an arrangement of printed dots in the cell regions and an arrangement of superimposed concealing portions 124*a*1.

Figure 29:
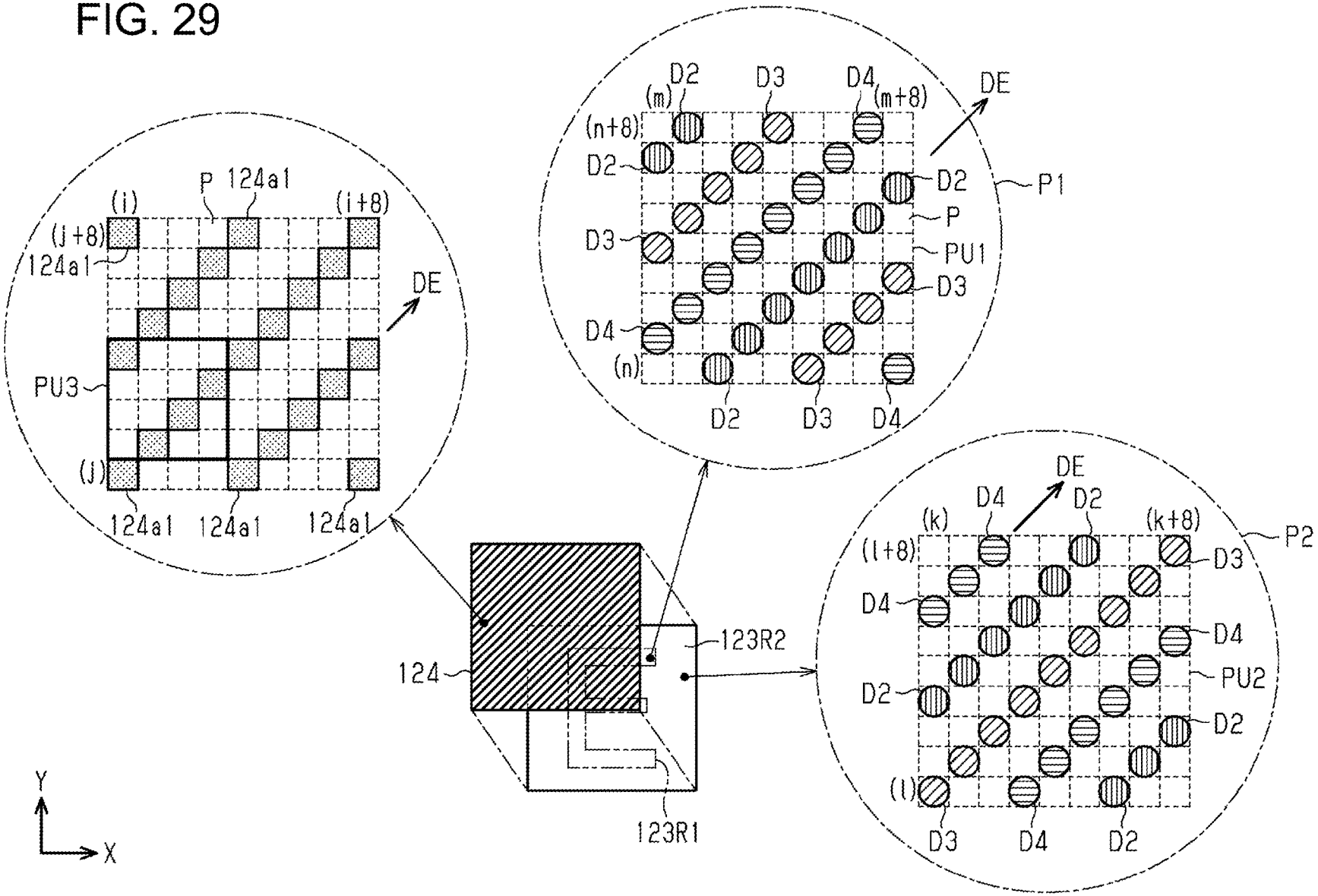
FIG. 29 is a plan view showing a structure of a concealing layer and a second image pattern of a sixth example, together with an enlarged plan view of a part of a concealment pattern and the second image pattern.

As shown in FIG. 29, in the first cell unit PU1, second dots D2 are located in seven respective image cells P located on a straight line that connects an image cell P located at (m+2, n) to an image cell P located at (m+8, n+6) and that intersects the X direction at 45°, i.e., on a straight line extending along an extending direction DE. Furthermore, second dots D2 are located in respective 2 image cells P located on a straight line that connects an image cell P located at (m, n+7) to an image cell P located at (m+1, n+8) and that extends along the extending direction DE.

Third dots D3 are located in respective 4 image cells P located on a straight line that connects an image cell P located at (m+5, n) to an image cell P located at (m+8, n+3)

and that extends along the extending direction DE. Furthermore, third dots D3 are located in respective 5 image cells P located on a straight line that connects an image cell P located at (m, n+4) to an image cell P located at (m+4, n+8) and that extends along the extending direction DE.

Fourth dots D4 are located in eight respective image cells P located on a straight line that connects an image cell P located at (m, n+1) to an image cell P located at (m+7, n+8) and that extends along the extending direction DE. Furthermore, a fourth dot D4 is located in an image cell P located at (m+8, n).

In the first cell region P1, the plurality of first cell units PU1 are arranged with no space therebetween. Thus, in the first cell region P1, a pitch in the Y direction between rows of the printed dots of each of the colors is 9 times that of the image cells P, and a pitch in the X direction between rows of the printed dots of each of the colors is 9 times that of the image cells P. Furthermore, a pitch between rows of the printed dots adjacent to each other in the Y direction is 3 times that of the image cells P, and a pitch between rows of the printed dots adjacent to each other in the X direction is 3 times that of the image cells P.

In the second cell unit PU2, second dots D2 are located in respective 3 image cells P located on a straight line that connects an image cell P located at (k+6, l) to an image cell P located at (k+8, l+2) and that extends along the extending direction DE. Furthermore, second dots D2 are located in respective 6 image cells P located on a straight line that connects an image cell P located at (k, l+3) to an image cell P located at (k+5, l+8) and that extends along the extending direction DE.

Third dots D3 are located in nine respective image cells P located on a straight line that connects an image cell P located at (k, l) to an image cell P located at (k+8, l+8) and that extends along the extending direction DE.

Fourth dots D4 are located in respective 6 image cells P located on a straight line that connects an image cell P located at (k+3, l) to an image cell P located at (k+8, l+5) and that extends along the extending direction DE. Furthermore, fourth dots D4 are located in respective 3 image cells P located on a straight line that connects an image cell P located at (k, l+6) to an image cell P located at (k+2, l+8) and that extends along the extending direction DE.

In the second cell region P2, the plurality of second cell units PU2 are arranged with no space therebetween. Thus, similarly to the first cell region P1, in the second cell region P2, a pitch in the Y direction between rows of the printed dots of each of the colors is 9 times that of the image cells P, and a pitch in the X direction between rows of the printed dots of each of the colors is 9 times that of the image cells. Furthermore, a pitch between rows of the printed dots adjacent to each other in the Y direction is 3 times that of the image cells P, and a pitch between rows of the printed dots adjacent to each other in the X direction is 3 times that of the image cells P. However, when the first cell unit PU1 is overlapped with the second cell unit PU2, positions of the printed dots of the respective colors located in the first cell unit PU1 are shifted by 4 image cells P in the Y direction from positions of the printed dots of the respective same colors located in the second cell unit PU2.

The concealment pattern 124*a* is composed of a plurality of concealing portions 124*a*1 extending along the extending direction DE. For example, the concealment pattern 124*a* includes a concealing portion 124*a*1 in an image cell P located at (i, j+8) and a concealing portion 124*a*1 in an image cell P located at (i+8, j). Furthermore, the concealment pattern 124*a* includes a concealing portion 124*a*1 extending across 5 image cells P located on a straight line that connects an image cell P located at (i, j+4) to an image cell P located at (i+4, j+8) and that extends along the extending direction DE.

Furthermore, the concealment pattern 124*a* includes a concealing portion 124*a*1 extending across 9 image cells P located on a straight line that connects an image cell P located at (i, j) to an image cell P located at (i+8, j+8) and that extends along the extending direction DE. Furthermore, the concealment pattern 124*a* includes a concealing portion 124*a*1 extending across 5 image cells P located on a straight line that connects an image cell P located at (i+4, j) to an image cell P located at (i+8, j+4) and that extends along the extending direction DE.

In the concealment pattern 124*a*, the third cell unit PU3 is composed of a plurality of image cells P located in a region bounded by an image cell P located at (i, j+1), an image cell P located at (i, j+4), an image cell P located at (i+3, j+1), and an image cell P located at (i+3, j+4). In the concealment pattern 124*a*, the plurality of third cell units PU3 are arranged with no space therebetween.

Accordingly, in the concealment pattern 124*a*, a pitch between the concealing portions 124*a*1 adjacent to each other in the Y direction is 4 times that of the image cells P, and a pitch between the concealing portions 124*a*1 adjacent to each other in the X direction is 4 times that of the image cells P. Thus, the pitch in the X direction of the concealment pattern 124*a* differs from the pitch in the X direction of the second image pattern 123*b*, and the pitch in the Y direction of the concealment pattern 124*a* differs from the pitch in the Y direction of the second image pattern 123*b*.

Figure 30:
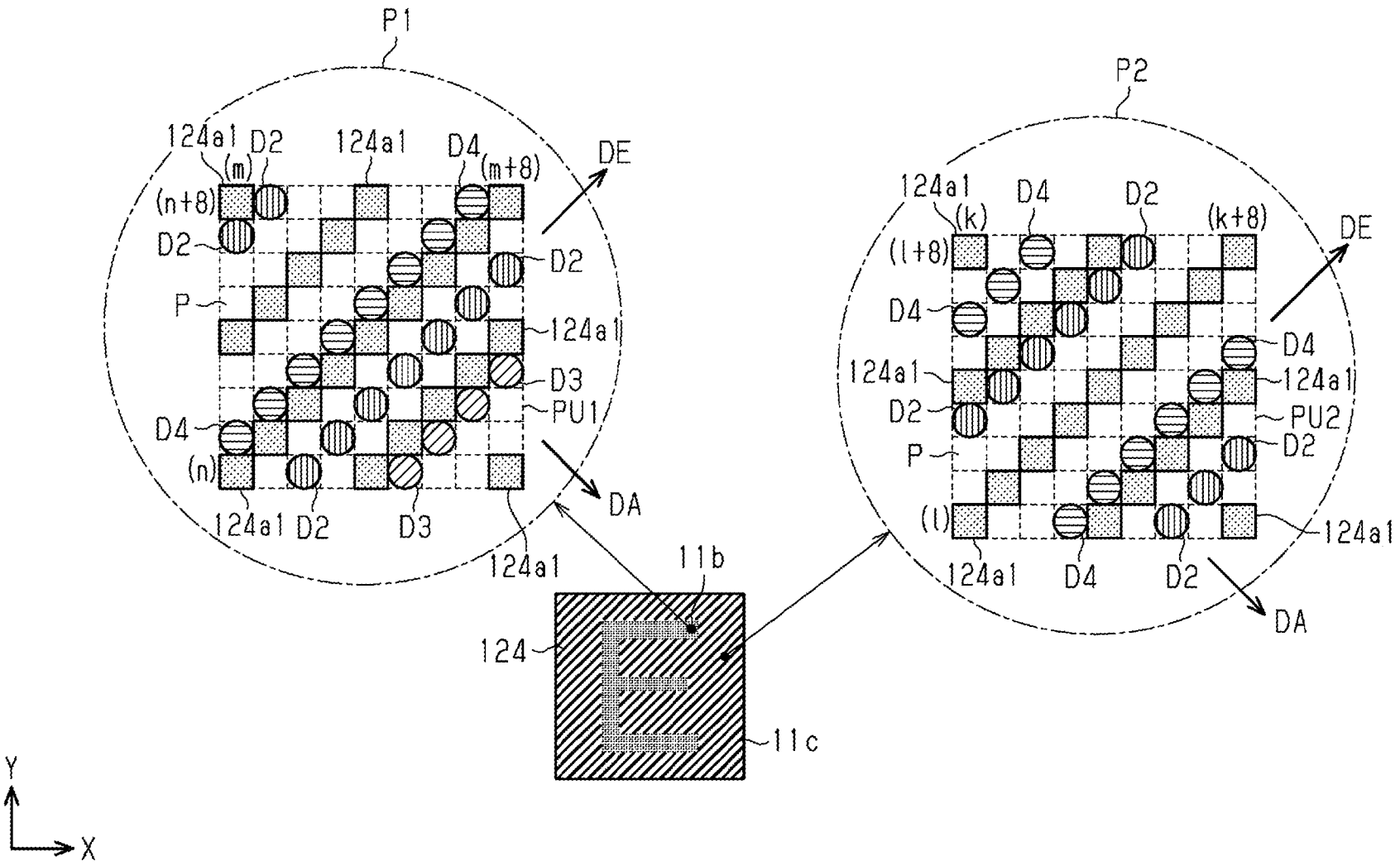
FIG. 30 is a plan view showing a structure of a second information image of the sixth example, together with an enlarged plan view of a part of the concealment pattern and the second image pattern.

As shown in FIG. 30, a direction orthogonal to the extending direction DE is an arrangement direction DA. In both the first cell region P1 and the second cell region P2, in a repetition of a row of the second dots D2, a row of the third dots D3, and a row of the fourth dots D4, a row concealed by the concealment pattern 124*a* and a row not concealed by the concealment pattern 124*a* are changed along the arrangement direction DA. Accordingly, in both the first cell region P1 and the second cell region P2, by the overlapping of the concealment pattern 124*a* with the second image pattern 123*b*, it is possible to form an image having a rainbow color, in other words, an image whose color gradually changes along the arrangement direction DA.

For example, in the first cell region P1, a row of the second dots D2, a row of the fourth dots D4, a row of the second dots D2, and a row of the third dots D3 are arranged in this order in the arrangement direction DA, and thus a part of an image having a rainbow color is formed. On the other hand, in the second cell region P2, a row of the fourth dots D4, a row of the second dots D2, a row of the fourth dots D4, and a row of the second dots D2 are arranged in this order in the arrangement direction DA, and thus a part of an image having a rainbow color is formed.

Application Examples of Display Member

Application examples of the display member will be described with reference to FIGS. 31 and 32.

Figure 31:
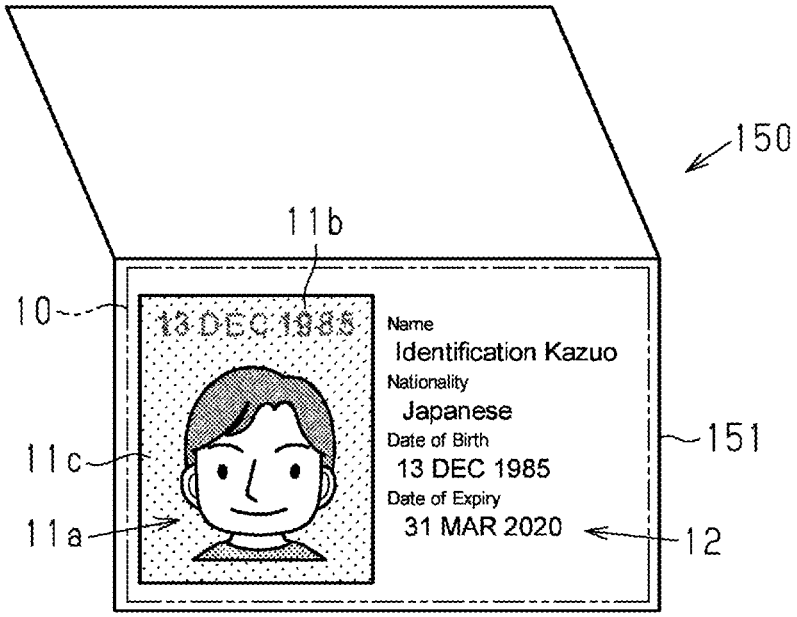
FIG. 31 is a plan view showing a planar structure of a passport which is an example of the display member.

As shown in FIG. 31, a passport 150 is an example of a booklet including the display member 10. The passport 150 includes a substrate 151 that supports the display member 10. For example, the substrate 151 is one of bound substrates and is formed of paper. The substrate 151 may be formed of various synthetic resins.

Figure 32:
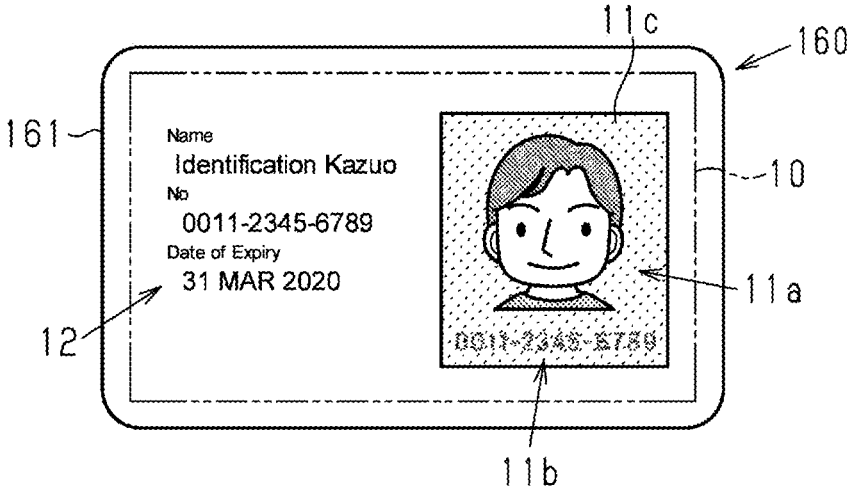
FIG. 32 is a plan view showing a planar structure of an ID card which is an example of the display member.

As shown in FIG. 32, an ID card 160 includes the display member 10. The ID card 160 includes a substrate 161 that supports the display member 10, and the substrate 161 has a plate shape. In addition to various synthetic resins, for example, the substrate 161 is formed of paper, metal, ceramic, glass, or the like. The character authentication image 12 displayed by the ID card 160 includes a personal number as information on the owner, and the related image 11*b* includes a personal number as information on the owner.

The display member 10 is transferred to each of the substrate 151 of the passport 150 and the substrate 161 of the ID card 160 by the following method. The display member 10 is thermally transferred to the substrates by using hot stamp. Instead of the hot stamp, one of a heat roll and a thermal head may be used for thermal transfer of the display member 10.

In order to improve adhesion of the display member 10 to the substrates, an anchor layer may be formed on a surface of the substrates to which the display member 10 is to be transferred. Furthermore, in the display member 10, an adhesive layer may be formed on a surface of the substrate 121 on a side opposite to the adhesive layer 122. Thus, adhesion of the display member 10 to the substrates can be improved.

Example 2

Example 2 in which the personal authentication medium is applied to a passport will be described.

First, as a booklet for the passport, a booklet including a front cover, a data page, and a visa page was prepared. The data page was a page in which information on an owner of the passport and a facial image were to be recorded. As the data page, a page composed of a substrate made of paper and an adhesion enhancement layer was prepared.

Next, by means of a passport printer (the same as Example 1), a first image pattern for displaying a character authentication image and a second image pattern for displaying a facial image, a background image, and a related image were formed on the data page by the following method.

First, an intermediate transfer medium composed of a base film, a peeling layer, and an image receiving layer was prepared. In the intermediate transfer medium, the peeling layer was configured to also function as a protective layer of the personal authentication medium, and the image receiving layer was configured to also function as an adhesive layer of the personal authentication medium.

Furthermore, a concealment pattern was formed on a surface of the peeling layer in contact with the image receiving layer. The concealment pattern was formed by etching an aluminum film formed by vapor deposition so that the concealment pattern had the following concealing portions. Specifically, the concealment pattern was composed of a plurality of concealing portions having a line shape. The concealment pattern was formed so that the concealing portions extended along a direction intersecting a conveying direction of the intermediate transfer medium at 45°, the width of the concealing portions in the conveying direction was 200 μm, and a pitch between the concealing portions in the conveying direction was 400 μm. A space of the concealment pattern was filled by the image receiving layer formed on the concealment pattern.

In a portion of the intermediate transfer medium overlapping the concealment pattern, a first image pattern and a second image pattern were formed in the following manner by using an ink ribbon and a thermal head. Specifically, a plurality of printed dots for forming the first image pattern were formed using ink of black. The first image pattern was formed to include a shape representing a date of birth of the owner as information on the owner. Subsequently, as printed dots for forming the second image pattern, cyan printed dots, magenta printed dots, and yellow printed dots were sequentially formed.

In a first cell region and a second cell region of the second image pattern, printed dots were formed as described earlier with reference to FIG. 29. At this time, the cyan printed dots were used as the second dots, the magenta printed dots were used as the third dots, and the yellow printed dots were used as the fourth dots. Furthermore, a diameter of the printed dots was set to 80 μm, a pitch between image cells in the conveying direction was set to 130 μm, and a pitch between rows of the dots in the conveying direction was set to 390 μm. Furthermore, the second image pattern was formed so that the date of birth of the owner, which was information for identifying the owner, was embedded in the first region of the second image pattern.

In the intermediate transfer medium in which the first image pattern and the second image pattern were formed, a portion of the intermediate transfer medium including the first image pattern and the second image pattern was overlapped on the data page. Then, this portion was thermally transferred to the data page by means of a heat roller. Thus, a passport of Example 2 was obtained.

In the passport of Example 2, it was found that in plan view of a plane of the data page, in the data page, an image having a rainbow color was formed in each of the first region and the second region of the second image pattern. Furthermore, it was found that the rainbow color of the image formed in the first region differs from the rainbow color of the image formed in the second region, and thus a related image, which was an image including the date of birth of the owner as information, was visually recognizable.

As has been described, according to the second embodiment of the display member, the booklet, the ID card, the method of manufacturing a display member, and the apparatus for manufacturing a display member, the following effects can be obtained.

(2-1) The restriction on identification of the second information element embedded in the second image pattern 123*b* is removed by the concealment of the part of the second image pattern 123*b* by the concealment pattern 124*a*. Thus, as compared with a configuration in which the second information element can be identified only by the second image pattern 123*b*, falsification of the display member 10 can be better prevented.

(2-2) The concealment pattern 124*a* can be formed by etching a metal film.

(2-3) Since the display member 10 includes the diffraction portions 125*a*, falsification of the display member 10 becomes more difficult. This can consequently better prevent falsification of the display member 10.

(2-4) A diffraction image formed by the diffracted light emitted from the diffraction portions 125*a* overlaps the image produced by the first image pattern 123*a*, and also overlaps the related image 11*b* formed by the overlapping of the concealment pattern 124*a* with the second image pattern 123*b*. This improves designability of the display member 10. Furthermore, since the images each need to be aligned with the diffraction image, falsification of the display member 10 becomes more difficult. This can consequently better prevent falsification of the display member 10.

(2-5) When one of the first image pattern 123*a* and the second image pattern 123*b* including overlapping dots has been formed by a printing method different from the dot-on-dot method, it can be determined, according to a shape of printed dots constituting the image pattern, whether the display member 10 has been falsified.

(2-6) According to the concealment pattern 124*a* composed of the plurality of dots, the concealing portions 124*a*1 having the same shape are arranged at regular intervals in the arrangement direction. Thus, as compared with a configuration in which the concealing portions 124*a*1 have random shapes or a configuration in which the concealing portions 124*a*1 are randomly arranged, the concealment pattern 124*a* can be easily formed.

(2-7) When the concealment pattern 124*a* is a parallel line pattern, the concealing portions 124*a*1 having a line shape are arranged at regular intervals in the arrangement direction. Thus, as compared with a configuration in which the concealing portions 124*a*1 have random shapes or a configuration in which the concealing portions 124*a*1 are randomly arranged, the concealment pattern 124*a* can be easily formed.

Modified Examples of Second Embodiment

The second embodiment described above may be modified as appropriate in the following manner.

The number of diffraction portions 125*a* of the display member 10 is not limited to 2 as described above, and may be 3 or more, or may be 1. Furthermore, in plan view of the front surface 10*a* of the display member 10, a single diffraction portion 125*a* may overlap both the two image patterns.

In plan view of the front surface 10*a*, the diffraction portion 125*a* may cover only a part of the image patterns or the whole of the image patterns. Thus, the diffraction portion 125*a* may be configured to cover at least a portion of at least one of the two image patterns.

In plan view of the front surface 10*a*, the diffraction portion 125*a* may be formed at a position that overlaps neither the first image pattern 123*a* nor the second image pattern 123*b*. Even in such a configuration, since the display member 10 includes the diffraction portion, falsification of the display member 10 becomes more difficult.

In the first region 123R1 and the second region 123R2 of the second image pattern 123*b*, the printed dots may be located in the respective plurality of image cells P in a repetition pattern other than the repetition pattern described above.

Furthermore, the concealment pattern 124*a* is not limited to the parallel line pattern or the dot pattern. For example, the concealment pattern 124*a* may be composed of a plurality of concealing portions having a folding line shape with at least one bent portion, or may be composed of a plurality of concealing portions having a wavy line shape with a plurality of bent portions. In short, the concealment pattern needs to be configured to overlap at least a part of the second image pattern 123*b* to conceal the part of the second image pattern 123*b* so that the related image 11*b* can be formed.

Thus, a combination of the concealment pattern 124*a* and the second image pattern 123*b* needs to be a combination of patterns that can remove, by the overlapping of the concealment pattern 124*a* with the second image pattern 123*b*, the restriction imposed by a part of the second image pattern on identification of the second information element embedded in the second image pattern 123*b*.

As the information on the owner, instead of the information represented by characters described above, for example, the related image 11*b* may be a design including information for identifying the owner such as a national flag of a country of origin of the owner, or a facial image of the owner.

As long as the image produced by the second image pattern 123*b* is an image different from the character authentication image 12 produced by the first image pattern 123*a*, the image different from the character authentication image 12 does not need to be an image including the facial image 11*a* described above, and may be, for example, a design including information for identifying the owner such as a national flag of a country of origin of the owner.

As described in Example 2, in the concealing layer 124, the transmission portion 124*b* that fills the space of the concealment pattern 124*a* may be formed by a part of the adhesive layer that functions as the image receiving layer for the printed dots and functions as the adhesive layer to the substrate. In such a configuration, the display member 10 needs to be configured to include a protective layer, an adhesive layer, and a substrate and configured such that a concealment pattern is located on a front surface of the adhesive layer which is a surface in contact with the protective layer and that an image pattern is located on a back surface of the adhesive layer which is a surface in contact with the substrate.

In the case where the display member 10 is applied to the passport 150 and the ID card 160, when the substrate 21 of the display member 10 can achieve mechanical strength required for the passport 150 and the ID card 160, the substrates 151 and 161 described above may be omitted.

The display member 10 is also applicable to personal identification media other than the passport 150 and the ID card 160.

Third Embodiment

A third embodiment of the display member, the booklet, the ID card, the method of manufacturing a display member, and the apparatus for manufacturing a display member will be described with reference to FIGS. 33 to 36. The display member of the third embodiment differs from the display member of the second embodiment in that the second image pattern and the concealment pattern are not included in the same sheet. Thus, the differences will be described below in detail, and components common to the second embodiment will be given the same reference numerals and will not be described in detail. A configuration of the display member and a configuration of a passport which is an application example of the display member will be sequentially described below.

[Configuration of Display Member]

A configuration of the display member will be described with reference to FIGS. 33 and 34.

Figure 33:
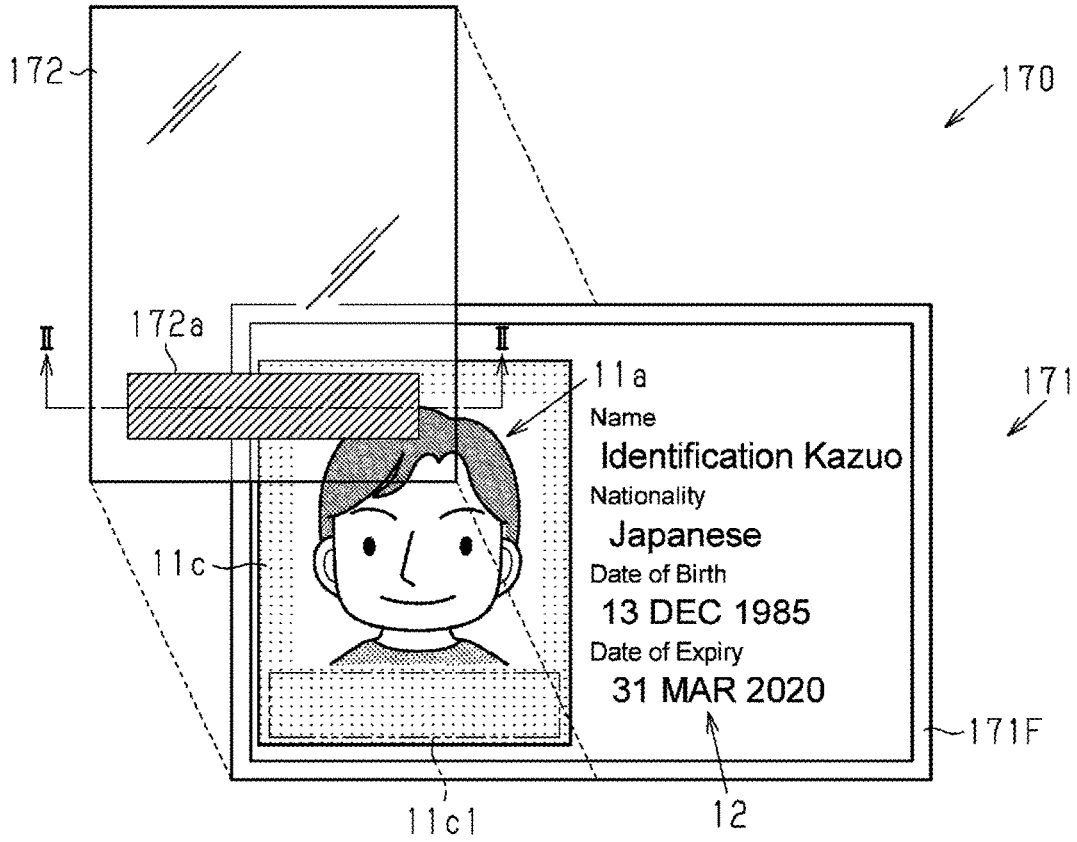
FIG. 33 is a plan view showing an information sheet and a verification sheet to be overlapped with each other.

As shown in FIG. 33, a display member 170 includes an information sheet 171 and a verification sheet 172. The information sheet 171 is an example of a first sheet, and the verification sheet 172 is an example of a second sheet. The information sheet 171 has a front surface 171F which is an observation object. In plan view of the front surface 171F, the information sheet 171 displays the character authentication image 12, the facial image 11*a*, and the background image 11*c* through the front surface 171F. However, the background image 11*c* displayed by the information sheet 171 is an image formed only by the second image pattern 123*b*, and differs from the image displayed by the display member 10 of the second embodiment in that the background image 11*c* has a latent image region 11*c*1 in which the second information element included in the related image 11*b* is embedded.

The verification sheet 172 includes a concealment pattern 172*a* that conceals a part of the second image pattern 123*b*, and is overlapped on the front surface 171F of the information sheet 171. The concealment pattern 172*a* needs to be large enough to cover at least the whole of the latent image region 11*c*1 of the background image 11*c*.

Figure 34:
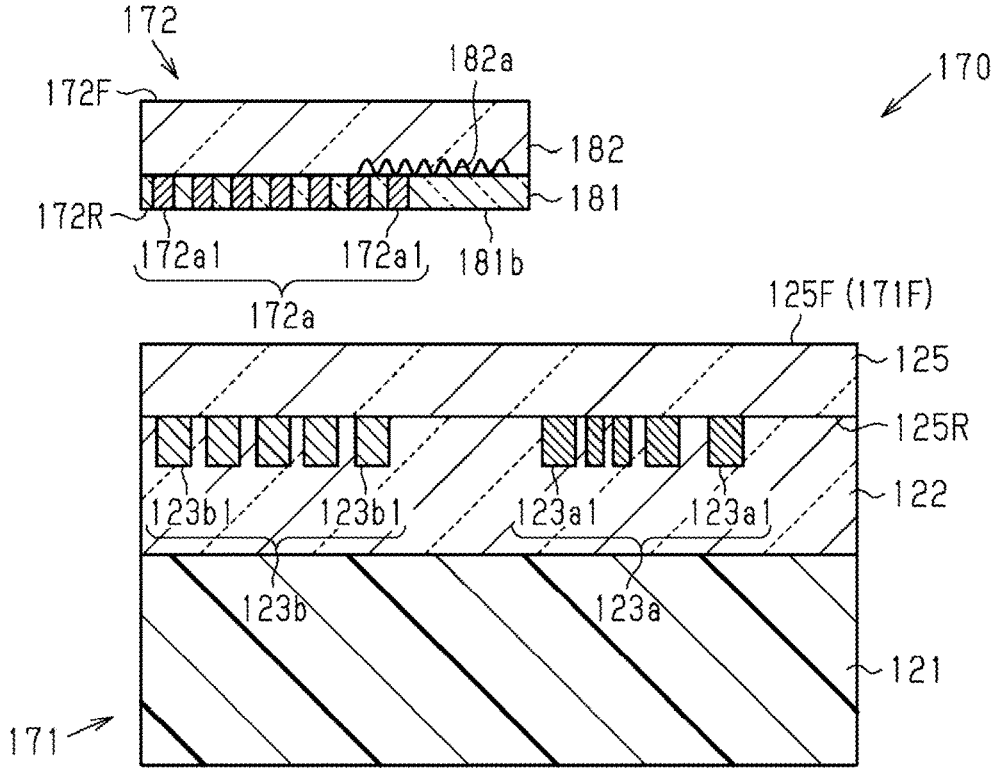
FIG. 34 is a cross-sectional view showing a structure of the verification sheet taken along line II-II in FIG. 33, together with a structure of the information sheet.

As shown in FIG. 34, the information sheet 171 includes the substrate 121, the adhesive layer 122, and the protective layer 125, which are laminated in this order in the information sheet 171. Furthermore, the information sheet 171 is a sheet including the first image pattern 123*a* and the second image pattern 123*b*. In the information sheet 171, the front surface 125F of the protective layer 125 is the front surface 171F of the information sheet 171. The protective layer 125 differs from the protective layer 125 of the second embodiment in that the diffraction portions 125*a* on the back surface 125R of the protective layer 125 are omitted.

Similarly to the second image pattern 123*b* of the second embodiment, the second image pattern 123*b* is composed of the plurality of printed dots 123*b*1. When the verification sheet 172 is overlapped on the front surface 171F of the information sheet 171, the second image pattern 123*b* forms the related image 11*b* together with the concealment pattern 172*a*. In other words, the concealment pattern 172*a* of the verification sheet 172 removes the restriction on identification of the second information element included in the second image pattern 123*b*.

The verification sheet 172 includes a front surface 172F and a back surface 172R on a side opposite to the front surface 172F. The back surface 172R is a surface that faces the front surface 172F of the information sheet 171, when the verification sheet 172 is overlapped on surface 171F of the information sheet 171.

The verification sheet 172 is movable between a first position for concealing a part of the second image pattern 123*b* by the concealment pattern 172*a* and a second position for removing the concealment performed by the concealment pattern 172*a*.

The verification sheet 172 includes a concealing layer 181 and a diffraction layer 182. Similarly to the concealing layer 124 of the second embodiment, the concealing layer 181 includes the concealment pattern 172*a* composed of a plurality of concealing portions 172*a*1, and a transmission portion 181*b*. A surface of the concealing layer 181 on a side opposite to a surface of the concealing layer 181 in contact with the diffraction layer 182 is the back surface 172R of the verification sheet 172.

The verification sheet 172 includes the diffraction portion 182*a*. The diffraction portion 182*a* is located at a portion closer to the front surface 172F of the verification sheet 172 than the concealment pattern 172*a* is, and is configured such that diffracted light is emitted due to asperities. In plan view of a plane of the verification sheet 172, the diffraction portion 182*a* overlaps the concealment pattern 172*a*.

Thus, when the information sheet 171 is observed through the verification sheet 172, the related image 11*b* and a diffraction image formed by the diffracted light emitted from the diffraction portion 182*a* are observed. Furthermore, when the information sheet 171 is observed through the verification sheet 172, the diffraction image formed by the diffracted light emitted from the diffraction portion 182*a* is visually recognized so that the diffraction image overlaps the related image 11*b*. This improves designability of the image formed by the verification sheet 172 and the information sheet 171.

The diffraction layer 182 includes the diffraction portion 182*a* configured as above. A surface of the diffraction layer 182 on a side opposite to a surface of the diffraction layer 182 in contact with the concealing layer 181 is the front surface 172F of the verification sheet 172. The diffraction portion 182*a* is located on the surface of the diffraction layer 182 in contact with the concealing layer 181. The verification sheet 172 needs to include at least the concealing layer 181, and the diffraction layer 182 may be omitted.

Thus, in the third embodiment, the first image pattern 123*a* and the second image pattern 123*b* are included in the information sheet 171. On the other hand, the concealment pattern 172*a* is included in the verification sheet 172. The six examples of the combination of the concealment pattern 124*a* and the second image pattern 123*b* described earlier in the second embodiment are applicable to the concealment pattern 172*a* of the verification sheet 172 and the second image pattern 123*b* of the information sheet 171.

[Configuration of Passport]

A configuration of the passport will be described with reference to FIGS. 35 and 36.

Figure 35:
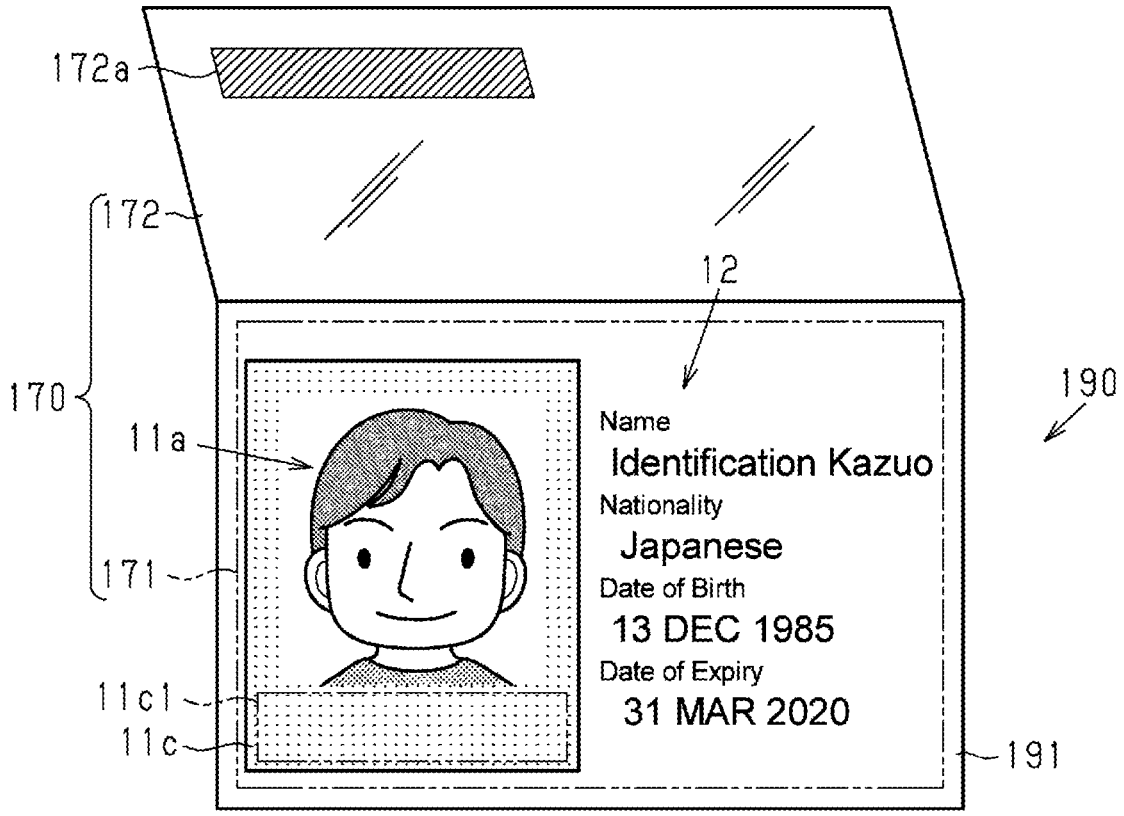
FIG. 35 is a plan view showing a planar structure of a passport which is an example of the display member.

As shown in FIG. 35, a passport 190 is an example of a booklet including the display member 170. The passport 190 includes a substrate 191 that supports the information sheet 171 and the verification sheet 172 as pages adjacent to each other. The substrate 191 and the verification sheet 172 are bound together to constitute a single booklet.

When the verification sheet 172 is not overlapped on the information sheet 171, images formed by the second image pattern 123*b* are only the facial image 11*a* and the background image 11*c*.

Figure 36:
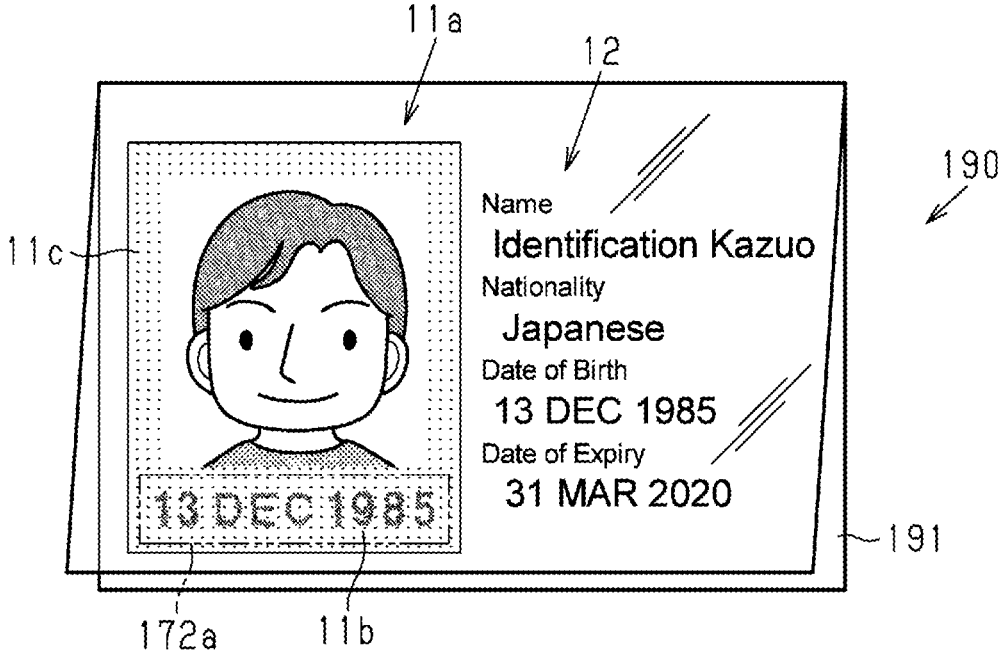
FIG. 36 is a plan view showing a state in which the verification sheet is overlapped on the information sheet in the passport.

On the other hand, as shown in FIG. 36, when the verification sheet 172 is overlapped on the information sheet 171 so that the concealment pattern 172*a* is overlapped with the latent image region 11*c*1, in the second image pattern 123*b*, some of the plurality of printed dots 123*b*1 constituting the latent image region 11*c*1 are concealed by the concealment pattern 172*a*. Thus, the second image pattern 123*b* and the concealment pattern 172*a* form the related image 11*b*. In this manner, when the verification sheet 172 is overlapped on the information sheet 171, the information sheet 171 can display the related image 11*b* which is information on the owner and includes the second information element included in the character authentication image 12.

Example 3

Example 3 in which the personal authentication medium is applied to a passport will be described.

First, as a booklet for the passport, a booklet similar to that of Example 2 described above was prepared. Next, by means of the passport printer (the same as Example 2), a first image pattern for displaying a character authentication image and a second image pattern for displaying a background image including a latent image region were formed on a data page by the following method.

First, an intermediate transfer medium having a configuration similar to that of the intermediate transfer medium of Example 2 was prepared, and a first image pattern and a second image pattern were formed in the following manner by using an ink ribbon and a thermal head. Specifically, the first image pattern was formed by a method similar to that of Example 2. Subsequently, as printed dots for forming the second image pattern, cyan printed dots, magenta printed dots, and yellow printed dots were sequentially formed.

In a first cell region and a second cell region of the second image pattern, printed dots were formed as described earlier with reference to FIG. 29. At this time, overlapping dots composed of the cyan printed dots and the magenta printed dots were used as the second dots. Overlapping dots composed of the magenta printed dots and the yellow printed dots were used as the third dots. Overlapping dots composed of the yellow printed dots and the printed cyan printed dots were used as the fourth dots. Furthermore, a diameter of the overlapping dots was set to 80 μm, a pitch between image cells in a conveying direction was set to 130 μm, and a pitch between rows of the dots in the conveying direction was set to 390 μm. Furthermore, the second image pattern was formed to have a shape representing the owner's birthday.

In the intermediate transfer medium in which the first image pattern and the second image pattern were formed, a portion of the intermediate transfer medium including the first image pattern and the second image pattern was overlapped on the data page. Then, the portion was thermally transferred to the data page by means of the heat roller.

Next, in order to form a verification sheet, a rectangular resin sheet including an aluminum vapor deposition film was prepared. The aluminum vapor deposition film was etched by means of a laser marker (manufactured by Keyence Corporation, MD-V9600A) to form a concealment pattern composed of a plurality of concealing portions having a line shape. The concealment pattern was formed so that the concealing portions extended along a direction intersecting, at 45°, sides of the resin sheet orthogonal to each other and that the width of the concealing portions was 200 μm and a pitch between the concealing portions was 400 μm.

The verification sheet was overlapped on the data page so that the concealment pattern overlapped at least the latent image region of the background image, and the verification sheet and the data page were bound together. Thus, a passport of Example 3 was obtained. When the data page was observed alone, it was found that the whole background image including the latent image region had a gray color. On the other hand, when the verification sheet was overlapped on the data page and the data page was observed in a direction orthogonal to a surface of the data page, it was found that a related image and a background image that had a rainbow color similar to that of Example 2 were formed.

Furthermore, by making a copy of the data page by means of the color copying machine, a copied page was obtained. When the verification sheet was overlapped on the copied page and the copied page was observed in a direction orthogonal to a surface of the copied page, it was found that a related image and a background image that had a rainbow color were not formed. Furthermore, when the copied page was observed with a loupe, it was found that the cyan printed dots, the magenta printed dots, and the yellow printed dots were arranged to form a predetermined angle without overlapping each other. Thus, it was found that the copied page was recognizable as a copy of the data page both in the visual observation of the copied page on which the verification sheet was overlapped and in the observation under magnification with the loupe of the copied page on which the verification sheet was overlapped.

As has been described, according to the third embodiment of the display member, the booklet, the ID card, the method of manufacturing a display member, and the apparatus for manufacturing a display body, in addition to the effects (2-1) to (2-7) described above, the following effects can be obtained.

(3-1) By changing a position of the verification sheet 172 between the two positions, a state of the second information element embedded in the second image pattern 123*b* can be changed between a state in which identification of the second information element is restricted and a state in which identification of the second information element is released.

(3-2) When the information sheet 171 is observed through the verification sheet 172, the related image 11*b* and a diffraction image formed by the diffracted light emitted from the diffraction portion 182*a* are observed.

(3-3) When the information sheet 171 is observed through the verification sheet 172, the diffraction image formed by the diffracted light emitted from the diffraction portion 182*a* is visually recognized so that the diffraction image overlaps the related image 11*b*. This improves designability of the image formed by the verification sheet 172 and the information sheet 171.

Modified Examples of Third Embodiment

The third embodiment described above may be modified as appropriate in the following manner.

When the display member 170 is applied to the passport 190, the information sheet 171 and the verification sheet 172 do not need to be bound together. Thus, in the passport, the information sheet 171 and the verification sheet 172 may be embodied as sheets separated from each other.

Other than the passport 190, the display member 170 is also applicable to the ID card described above. Furthermore, the display member 170 is also applicable to personal identification media other than the ID card.

Fourth Embodiment

A fourth embodiment of the display member, the booklet, the ID card, the method of manufacturing a display member, and the apparatus for manufacturing a display member will be described with reference to FIG. 1, FIG. 2, and FIGS. 37 to 44. A configuration of an intermediate transfer foil that can be used to manufacture a display member, the method of manufacturing a display member, and effects of the display member will be sequentially described below.

[Configuration of Intermediate Transfer Foil]

The configuration described earlier with reference to FIGS. 1 and 2 can be employed for the display member of the present embodiment. Furthermore, the display member of the present embodiment can also be manufactured by using an intermediate transfer foil described below with reference to FIG. 37.

Figure 37:
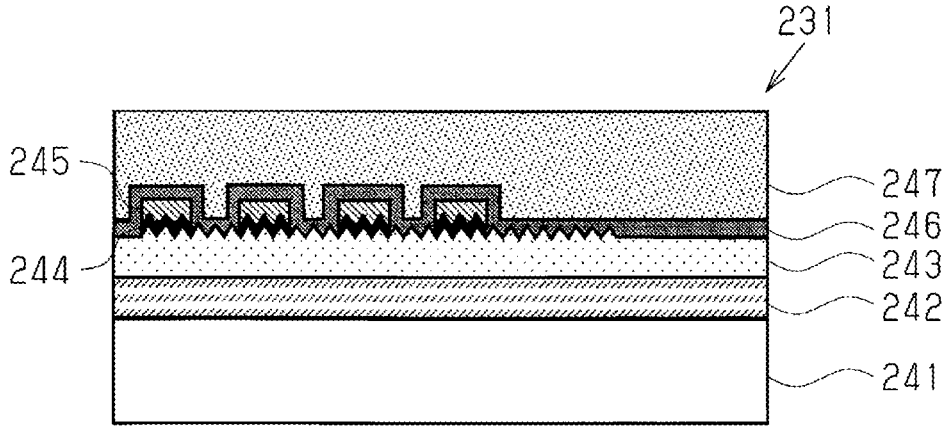
FIG. 37 is a cross-sectional view showing a structure of an intermediate transfer foil used to manufacture the display member.

As shown in FIG. 37, an intermediate transfer foil 231 includes a substrate 241, a protective layer 242, a relief layer 243, a first reflective layer 244, a mask layer 245, a second reflective layer 246, and an image receiving layer 247. In the intermediate transfer foil 231, the protective layer 242 is formed on the substrate 241, and the relief layer 243 is formed on the protective layer 242. A surface of the relief layer 243 on a side opposite to a surface of the relief layer 243 in contact with the protective layer 242 includes a relief surface which is an asperity surface.

The first reflective layer 244 has a predetermined pattern, and covers a part of the relief surface. The mask layer 245 is located on the first reflective layer 244, and has the same pattern as the first reflective layer 244. The mask layer 245 is an etching mask for patterning the first reflective layer 244 by etching. The second reflective layer 246 is a transparent thin film formed of a dielectric, and covers the whole of the relief layer 243. Thus, the second reflective layer 246 covers the whole of the first reflective layer 244 and the mask layer 245. The image receiving layer 247 covers the whole of the second reflective layer 246.

The protective layer 242 preferably has peelability and is cleanly detachable from the substrate 241 of the intermediate transfer foil 231 when the intermediate transfer foil 231 is heated. Furthermore, the protective layer 242 preferably has a function of better preventing the layers covered by the protective layer 242 from being chemically or mechanically damaged after the layers other than the substrate 241 of the intermediate transfer foil 231 are transferred to the substrate 21 described above.

For example, the protective layer 242 may be formed of a thermoplastic acrylic resin, a melamine resin, a chlorinated rubber resin, an epoxy resin, a vinyl chloride-vinyl acetate copolymer resin, a cellulose resin, a chlorinated polypropylene resin, or the like. These resins may be used alone, or a mixture of two or more types of these resins may be used. The protective layer 242 may have a monolayer structure or a multilayer structure.

To the resin forming the protective layer 242, a natural wax, a synthetic wax, an antifriction agent, an inorganic substance, or the like may be added. Examples of natural waxes include animal waxes, plant waxes, mineral waxes, and petroleum waxes. Examples of synthetic waxes include synthetic hydrocarbon waxes, aliphatic alcohols and acid waxes, amines and amide waxes, chlorinated hydrocarbon waxes, synthetic animal waxes, and alpha-olefin waxes. Examples of the antifriction agent include a higher fatty acid metal salt such as zinc stearate.

For example, the relief layer 243 may be formed of a thermoplastic resin, a thermosetting resin, a radiation curable resin, or the like. For example, the thermoplastic resin may be an acrylic resin, an epoxy resin, a cellulose resin, or a vinyl resin, or may be a mixture or copolymer of these resins.

For example, the thermosetting resin may be a urethane resin, a melamine resin, an epoxy resin, or a phenol resin, or may be a mixture or copolymer of these resins. The urethane resin may be a resin formed by a crosslinking reaction of a polyol resin and an isocyanate compound. Examples of the polyol resin include an acrylic polyol resin and a polyester polyol resin.

The radiation curable resin may contain a polymerizable compound and an initiator. For example, the polymerizable compound may be a photoradical polymerizable compound. Specifically, the photoradical polymerizable compound may be a monomer, an oligomer, or a polymer having an ethylenically unsaturated bond or an ethylenically unsaturated group. Alternatively, the photoradical polymerizable compound may be the following monomer, oligomer, or polymer. Examples of the monomer include 1,6-hexanediol, neopentyl glycol diacrylate, trimethylolpropane triacrylate, pentaerythritol acrylate, pentaerythritol tetraacrylate, pentaerythritol pentaacrylate, and dipentaerythritol hexaacrylate. Examples of the oligomer include epoxy acrylate, urethane acrylate, and polyester acrylate. Examples of the polymer include a urethane-modified acrylic resin, and an epoxy-modified acrylic resin.

When the photoradical polymerizable compound is used as the polymerizable compound, the initiator may be a photoradical polymerization initiator. For example, the photoradical polymerization initiator may be a benzoin compound, an anthraquinone compound, a phenyl ketone compound, benzyl dimethyl ketal, thioxanthone, acylphosphine oxide, or Michler's ketone. Examples of the benzoin compound include benzoin, benzoin methyl ether, and benzoin ethyl ether. Examples of the anthraquinone compound include anthraquinone and methyl anthraquinone. Examples of the phenyl ketone compound include acetophenone, diethoxyacetophenone, benzophenone, hydroxyacetophenone, 1-hydroxycyclohexyl phenyl ketone, α-aminoacetophenone, and 2-methyl-1-(4-methylthiophenyl)-2-morpholinopropane-1-one.

The polymerizable compound may be a photocationic polymerizable compound. For example, the photocationic polymerizable compound may be a monomer, an oligomer, or a polymer having an epoxy group, an oxetane skeleton containing compound, or vinyl ethers.

When the photocationic polymerizable compound is used as the polymerizable compound, a photocationic polymerization initiator is used as the initiator. For example, the photocationic polymerization initiator may be an aromatic diazonium salt, an aromatic iodonium salt, an aromatic sulfonium salt, an aromatic phosphonium salt, or a mixed ligand metal salt.

The polymerizable compound may be a mixture of the photoradical polymerizable compound and the photocationic polymerizable compound. In this case, for example, the initiator is a mixture of the photoradical polymerization initiator and the photocationic polymerization initiator. Alternatively, in this case, the initiator may be a polymerization initiator that can function as an initiator for both photoradical polymerization and photocationic polymerization. For example, such an initiator may be an aromatic iodonium salt or an aromatic sulfonium salt.

The material for forming the relief layer 243 does not need to include the polymerization initiator. In this case, a method may be used in which polymerization reaction of the polymerizable compound is caused by irradiating the material for forming the relief layer 243 with an electron beam.

The radiation curable resin may contain at least one of additives such as a sensitizing dye, a dye, a pigment, a polymerization inhibitor, a leveling agent, a defoaming agent, a drip preventing agent, an adhesion improver, a coating surface modifier, a plasticizer, a nitrogen-containing compound, a mold release agent, and an epoxy resin.

In order to improve formability of the radiation curable resin, the radiation curable resin may further include a non-reactive resin. As the non-reactive resin, for example, a thermoplastic resin, a thermosetting resin, or the like may be used alone, or a mixture of these resins may be used.

The first reflective layer 244 may be a metal thin film, high luminance ink, a transparent thin film formed of a dielectric, or the like. The metal thin film may be formed of a metal such as Al, Sn, Cu, Au, Ag, Cr, and Fe. The high luminance ink is ink obtained by processing the above metal thin film into flakes, followed by processing the flakes into ink. The dielectric may be a transparent dielectric having a refractive index different from a refractive index of the relief layer 243. Examples of the dielectric include inorganic materials such as $Sb_2S_3$, $Fe_2O_3$, $TiO_2$, CdS, $CeO_2$, ZnS, $PbC_{12}$, CdO, $SbO_3$, $WO_3$, SiO, $Si_2O_3$, $In_2O_3$, PbO, $Ta_2O_3$, ZnO, $Cd_2O_3$, and $Al_2O_3$. Furthermore, the first reflective layer 244 may have a multilayer structure in which a plurality of thin films formed of the inorganic materials are combined.

When the first reflective layer 244 can conceal an image formed on a layer lower than the first reflective layer 244, in other words, when the first reflective layer 244 has a light shielding property, the first reflective layer 244 can also function alone as the concealment pattern 23*a* of the concealing layer 23. When the first reflective layer 244 has light transmissivity, the mask layer 245 located on the first reflective layer 244 can conceal an image formed on a layer lower than the mask layer 245, and thus a combination of the first reflective layer 244 and the mask layer 245 can function as the concealment pattern 23*a*.

For example, a reflective layer formed of a metal thin film is patterned by the following procedure. First, a relief layer is formed on a rollable substrate film by using a thermoplastic resin, a thermosetting resin, a radiation curable resin, or the like. Subsequently, a nickel press plate having an asperity pattern is heated and pressed against the relief layer. Thus, a relief surface is formed on a surface of the relief layer. Next, a metal thin film for forming the first reflective layer 244 is formed on the entire surface of the relief layer including the relief surface. The metal thin film may be formed by vacuum deposition, sputtering, ion plating, or the like.

Subsequently, the mask layer 245 having a desired pattern is printed on the metal thin film. The mask layer may be printed by offset printing, gravure printing, screen printing, or the like. Next, the metal thin film is etched by using the mask layer 245. Thus, a portion of the metal thin film in which the mask layer 245 is located can be left on the relief layer 243, while the other potion of the metal thin film can be removed from the relief layer 243.

The first reflective layer 244 may be formed by the following method. Specifically, for example, water-soluble ink is applied in advance to a portion of the relief layer from which the metal thin film is desired to be removed, and then the water-soluble ink and the metal thin film are washed with water. Thus, the portion of the metal thin film can be removed together with the water-soluble ink. Furthermore, a method may be used in which a combination of a special relief structure of the relief layer 243 and a dielectric layer located on the metal thin film allows the metal thin film to be etched to have a pattern.

The image receiving layer 247 may be formed of a material equivalent to the material of the adhesion portion 22*c* described earlier with reference to FIG. 1.

Between the layers from the substrate 21 to the protective layer 24 described above, the display member 10 may include functional layers such as a print layer, an intermediate layer, and an adhesive layer. When the display member 10 includes the print layer, the print layer may be formed by various printing methods. Examples of the printing methods include offset printing, gravure printing, screen printing, and flexographic printing.

When the display member 10 includes the intermediate layer, the adhesive layer, and the like, the intermediate layer and the adhesive layer may be formed by a coating method, a transfer method, or the like. Examples of the coating method include a gravure coating method, a reverse gravure coating method, a roll coating method, a die coating method, a bar coating method, and a lip coating method.

When the transfer method is used, a functional layer is applied to a support that supports the functional layer, and then heat, pressure, or the like is applied to the functional layer to adhere the functional layer to an object to which the functional layer is to be transferred. Then, the support is peeled off from the functional layer. The support may be a resin film. The resin film may be formed of polyethylene terephthalate, polyethylene naphthalate, polypropylene, polycarbonate, or the like.

[Method of Manufacturing Display Member]

The method of manufacturing a display member will be described with reference to FIGS. 38 to 42. Prior to the description of the method of manufacturing a display member according to the present embodiment, problems with methods of manufacturing display members will be described below.

Figure 38:
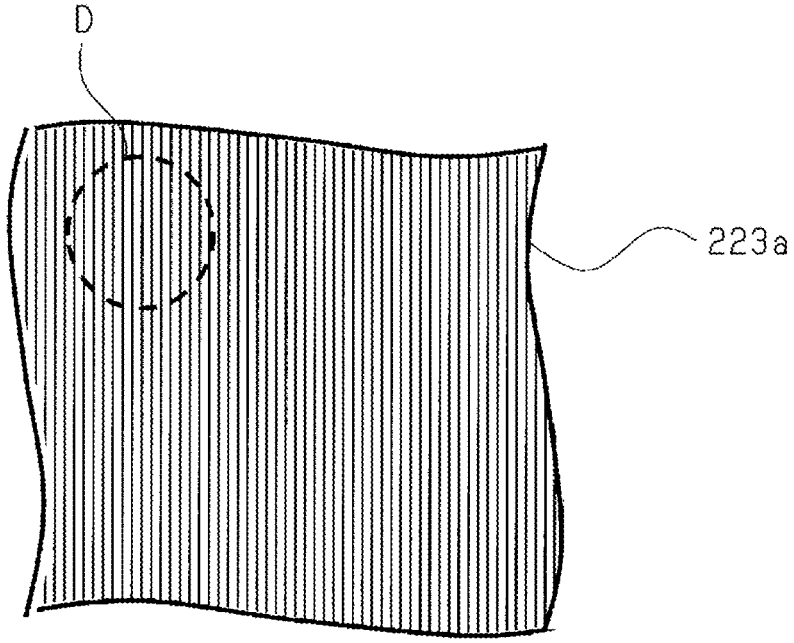
FIG. 38 is a plan view showing a structure of an example of the concealment pattern.

FIG. 38 shows a planar structure of an example of a concealment pattern 223*a*.

As shown in FIG. 38, for example, the concealment pattern 223*a* includes a plurality of concealing portions extending along one direction. The multiple concealment patterns 223*a* are arranged at regular intervals along a direction orthogonal to the direction in which each concealment patterns 223*a* extend. As described above, each concealment pattern 223*a* is formed in advance on the intermediate transfer foil 231. The plurality of printed dots 22*a*1 are formed at a preset assumed pitch on the image receiving layer 247 of the intermediate transfer foil 231, while the printed dots 22*a*1 are aligned with concealment pattern 223*a*. Thus, a print pattern 22*a* is formed on the intermediate transfer foil 231.

Figure 39:
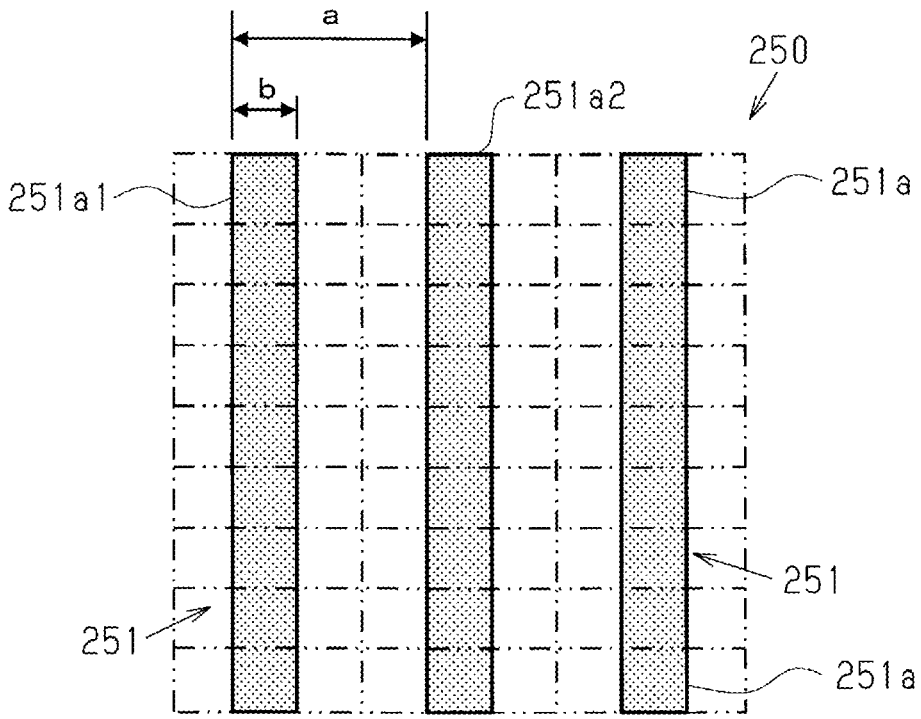
FIG. 39 is a plan view showing an enlarged structure of a region D in FIG. 38.

FIG. 39 shows an enlarged view of a region D bounded by a dashed line in FIG. 38.

As shown in FIG. 39, the concealment pattern 223*a* is composed of a parallel line pattern 250. The parallel line pattern 250 includes a plurality of concealing portions 251. The plurality of concealing portions 251 are each a row of a plurality of pixels 251*a*. In the plurality of concealing portions 251, a distance between a pixel 251*a*1 constituting a first concealing portion 251 and a pixel 251*a*2 constituting a second concealing portion 251 adjacent to the first concealing portion 251 is a pitch a of the parallel line pattern 250. The pixels 251*a* each have a width b in a direction in which the first concealing portion 251 and the second concealing portion 251 are arranged.

As described above, the concealment pattern 223*a* of the intermediate transfer foil 231 can be composed of the first reflective layer 244 described earlier with reference to FIG. 37. As described above, the first reflective layer 244 having a parallel line pattern is formed by the following method. Specifically, a metal thin film is formed on the entire surface of the relief layer 243 by a vacuum deposition method, a sputtering method, an ion plating method, or the like. Then, the mask layer 245 is formed to have a desired pattern. Next, the metal thin film is etched by using the mask layer 245.

When the first reflective layer 244 is formed by such a method, at steps for forming the first reflective layer 244, expansion, contraction, or the like of the substrate occurs. The expansion, contraction, or the like of the substrate is caused by tension applied to the rollable substrate, heat applied to the substrate during printing of the mask layer 245 or during etching of the metal thin film, tension applied to the substrate during processing of the image receiving layer 247, heating in a drying oven, or the like. Thus, even when the pitch a and the width b in the parallel line pattern 250 are accurately designed in a printing plate for printing the mask layer 245, the pitch a and the width b in the parallel line pattern 250 of the intermediate transfer foil 231 may differ from the design values.

Figure 40:
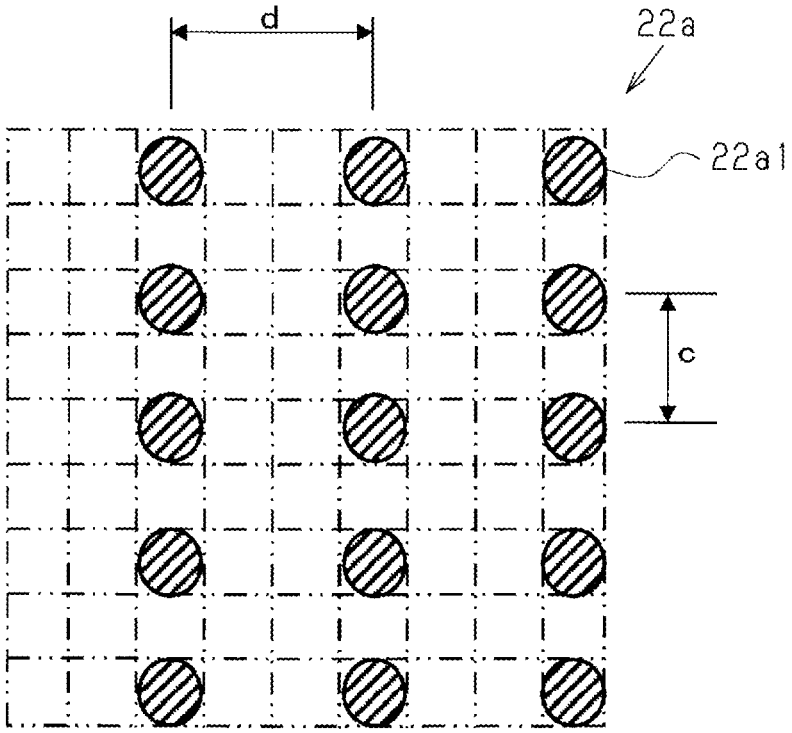
FIG. 40 is a plan view showing a structure of an example of the print pattern.

FIG. 40 shows a part of a planar structure of an example of the first print pattern 22*a* described above.

As shown in FIG. 40, the first print pattern 22*a* includes the plurality of printed dots 22*a*1. As described above, the printed dots 22*a*1 are formed on the intermediate transfer foil 231 by heating a transfer ribbon by means of the thermal head. In the first print pattern 22*a*, a distance between the printed dots 22*a*1 in a main scanning direction DM of the thermal head 33 is a first assumed pitch c, and a distance between the printed dots 22*a*1 in a sub scanning direction DS of the thermal head 33 is a second assumed pitch d.

Figure 41:
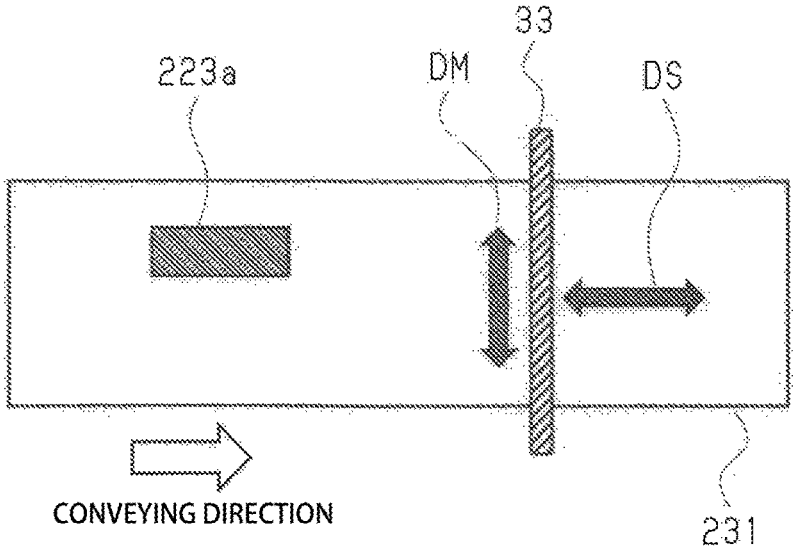
FIG. 41 is a schematic diagram illustrating a relationship between a scanning direction of a thermal head of an intermediate transfer apparatus and a conveying direction of the intermediate transfer foil.

FIG. 41 schematically shows a relationship between the main scanning direction DM and the sub scanning direction DS of the thermal head 33 and a conveying direction of the intermediate transfer foil 231.

As shown in FIG. 41, the thermal head 33 is arranged to extend along a direction perpendicular to the conveying direction of the intermediate transfer foil 231. In the scanning directions of the thermal head 33, a direction orthogonal to the conveying direction of the intermediate transfer foil 231 is the main scanning direction DM, and a direction parallel to the conveying direction of the intermediate transfer foil 231 is the sub scanning direction DS. The thermal head 33 includes a plurality of heating elements arranged in a row. A direction in which the plurality of heating elements are arranged is parallel to the direction in which the thermal head 33 extends. In other words, the plurality of heating elements are arranged along the main scanning direction DM of the thermal head 33.

Thus, an interval between the printed dots 22*a*1 in the main scanning direction DM of the thermal head 33 depends on an interval between the heating elements of the thermal head 33. On the other hand, an interval between the printed dots 22*a*1 in the sub scanning direction DS of the thermal head 33 can be controlled by a feeding amount of the intermediate transfer foil 231.

As described above, the interval between the printed dots 22*a*1 in the main scanning direction DM of the thermal head 33 is the first assumed pitch c, and the interval between the printed dots 22*a*1 in the sub scanning direction DS of the thermal head 33 is the second assumed pitch d.

For example, the concealing portions 251 constituting the parallel line pattern 250 described above may be configured to extend along the conveying direction of the intermediate transfer foil 231, i.e., along the sub scanning direction DS, and to be arranged at the pitch a along the main scanning direction DM. In this case, in the parallel line pattern 250, if the pitch a between the pixels 251*a* constituting the respective concealing portions 251 can always be set to be the same as the first assumed pitch c, the pitch a and the first assumed pitch c are maintained as a constant interval. According to such a display member, therefore, an extremely stable related image 11*b* (a moire image) can be obtained. In other words, the related images 11*b* displayed by the respective display members can be the same.

On the other hand, for example, the concealing portions 251 constituting the parallel line pattern 250 may be configured to extend along the direction perpendicular to the conveying direction of the intermediate transfer foil 231, i.e., along the main scanning direction DM, and to be arranged at the pitch a along the sub scanning direction DS. In this case, in the parallel line pattern 250, if the pitch a between the pixels 251*a* constituting the respective concealing portions 251 can always be set to be the same as the second assumed pitch d, the pitch a and the second assumed pitch d are maintained as a constant interval. According to such a display member, therefore, an extremely stable related image 11*b* can be obtained. In other words, the related images 11*b* displayed by the respective display members can be the same.

As described above, however, due to the tension or heat applied to the substrate of the intermediate transfer foil 231 at the steps, expansion, contraction, or the like occurs in the substrate. Furthermore, such expansion, contraction, or the like varies, for example, depending on variation in conditions at the steps. Thus, the pitch a of the parallel line pattern 250 is highly likely to vary. In other words, it is difficult to completely stabilize the pitch a of the parallel line pattern 250, in other words, to cause the pitch a to be completely the same.

As a result of intensive studies on such variation in the pitch a of the parallel line pattern 250, the inventors of the present application have found the following point. Specifically, the inventors of the present application have arrived at setting the pitch a to be in the range of 100.5% or more and 102% or less of the assumed pitches c and d between the plurality of printed dots 22*a*1. Thus, even when the pitch a of the parallel line pattern 250 is varied to some extent when a display member is manufactured, it is possible to better prevent the related images 11*b* displayed by the respective display members from significantly differing from each other.

On the other hand, as described above, the second assumed pitch d of the printed dots 22*a*1 can be controlled by the feeding amount of the intermediate transfer foil 231 when the printed dots 22*a*1 are formed on the intermediate transfer foil 231 by means of the thermal head 33. However, the feeding amount of the intermediate transfer foil 231 may be varied by variation in performance between the intermediate transfer apparatuses 30, variation in characteristics between the intermediate transfer foils 231. Furthermore, for example, due to a skew, i.e., oblique movement, while the intermediate transfer foil 231 is being conveyed in the intermediate transfer apparatus 30, the printed dots 22*a*1 are not necessarily formed on the image receiving layer 247 so that the assumed pitches c and d between the printed dots 22*a*1 formed by means of the thermal head 33 are the assumed pitches.

As a result of intensive studies on such variation in the pitch between the printed dots 22*a*1, the inventors of the present application have found the following point. Specifically, the inventors of the present application have found that even when the assumed pitches c and d between the printed dots 22*a*1 are varied, it is possible to better prevent the related images 11*b* displayed by the respective display members from significantly differing from each other, by setting an angle formed by the conveying direction and the direction in which the parallel line pattern 250 extends to be in the range of (X-2°) or more and (X-0.5°) or less, where X° represents a design value of the angle formed by the conveying direction and the direction in which the parallel line pattern 250 extends.

Figure 42:
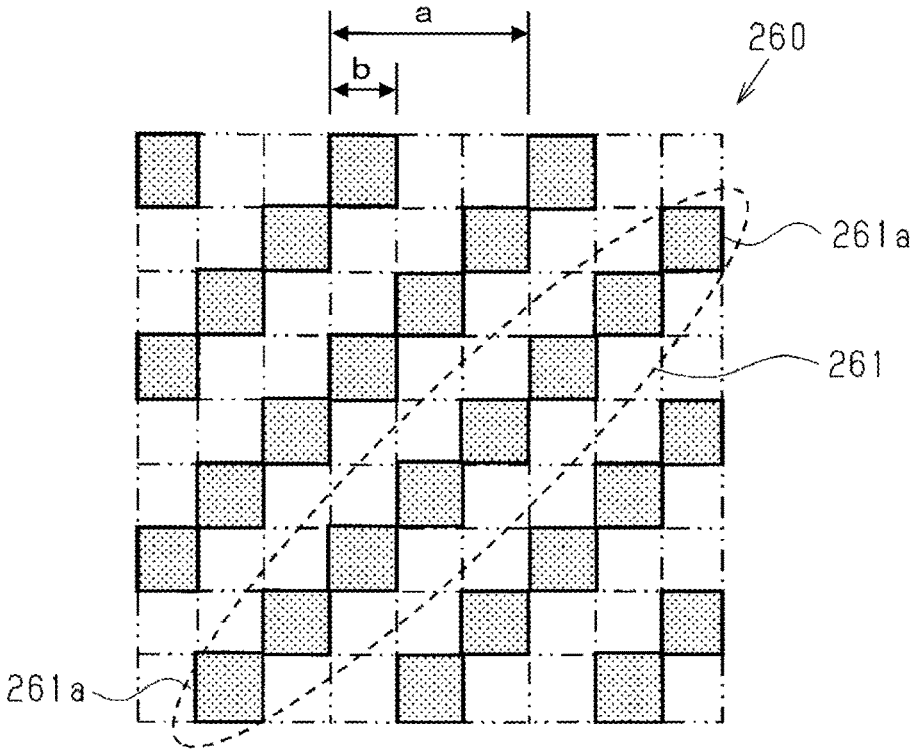
FIG. 42 is a plan view showing a structure of an example of a parallel line pattern.

FIG. 42 shows a planar structure of an example of a parallel line pattern of the present embodiment.

As shown in FIG. 42, a parallel line pattern 260 includes a plurality of concealing portions 261 each of which is a row of a plurality of pixels 261*a*. For example, a pitch a of the parallel line pattern 260 is set along the conveying direction of the intermediate transfer foil 231. Thus, the concealing portions 261 of the parallel line pattern 260 are inclined with respect to the conveying direction of the intermediate transfer foil 231. In the parallel line pattern 260 shown in FIG. 42, a design value of an angle formed by the conveying direction and a direction in which the parallel line pattern 260 extends, i.e., a direction in which the concealing portions 261 extend, is set to 45°. In this case, a direction in which the printed dots 22*a*1 are arranged is set to be parallel to the direction in which the parallel line pattern 260 extends. Thus, a design value of an angle formed by the conveying direction and the direction in which the printed dots 22*a*1 are arranged is 45°. As described above, therefore, the inclination of the concealing portions 261 with respect to the conveying direction, in other words, the angle formed by the conveying direction and the direction in which the concealing portions 261 extend is preferably in the range of (45-2°) or more and (45-0.5°) or less, i.e., in the range of 43° or more and 44.5° or less. Even when the concealing portions 261 are inclined with respect to the conveying direction, the pitch a is also a distance between the concealing portions 261 adjacent to each other in the conveying direction.

[Effects of Display Member]

Effects of the display member will be described with reference to FIGS. 43 and 44.

Figure 43:
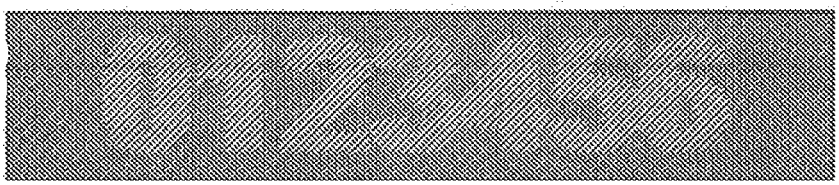
FIG. 43 is a plan view showing an example of the related image.

FIG. 43 shows an example of the related image 11*b* formed by overlapping of a parallel line pattern with printed dots. For example, the related image 11*b* shown in FIG. 43 is formed such that the parallel line pattern extends along the main scanning direction DM, a plurality of concealing portions of the parallel line pattern are arranged at the pitch a at regular intervals, and the pitch a is set to be the same width as the first assumed pitch c of the printed dots. Alternatively, the related image 11*b* shown in FIG. 43 is formed such that the parallel line pattern extends along the sub scanning direction DS, a plurality of concealing portions of the parallel line pattern are arranged at the pitch a at regular intervals, and the pitch a is set to be the same width as the second assumed pitch d of the printed dots.

Figure 44:
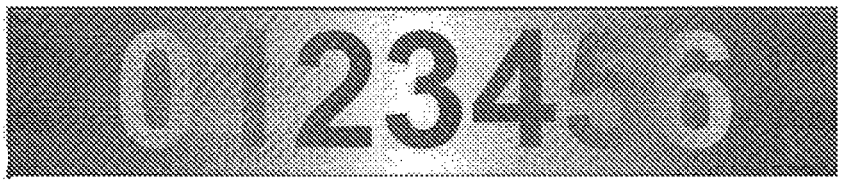
FIG. 44 is a plan view showing an example of the related image.

FIG. 44 shows a related image 11*b* displayed by such a display member when in the display member, the pitch a of the parallel line pattern has been varied because of the factors described above. Thus, due to the variation in the pitch a of the parallel line pattern 250, the related images 11*b* displayed by the respective display members significantly differ from each other. In the case of a display member, such as a personal authentication medium, which is required to have extremely high security, a significant difference between display members in the related image 11*b*, which is an authentication image, may cause a person who makes a determination on the display member to make an erroneous determination. Accordingly, the difference in the related image 11*b* between display members is not desirable.

On the other hand, according to the parallel line pattern 260 of the present embodiment, i.e., the parallel line pattern 260 satisfying the following two conditions, even when in the intermediate transfer foil 231, variation in the pitch a of the parallel line pattern 260 or variation to some extent in the assumed pitches c and d between the printed dots 22*a*1 occurs, the display member can display a stable related image 11*b*. Thus, for example, the related images 11*b* displayed by the respective display members can be substantially the same as the related image 11*b* shown in FIG. 43, or can be substantially the same as the related image 11*b* shown in FIG. 44.

(A) The pitch a is in the range of 100.5% or more and 102% or less of the assumed pitches c and d.

(B) The angle formed by the parallel line pattern and the conveying direction is in the range of (X-2°) or more and (X-0.5°) or less, where X° represents a design value of the angle formed by the conveying direction and the parallel line pattern.

In a display member, when a pitch a of a parallel line pattern does not satisfy the above range (A), or when an angle of the parallel line pattern with respect to a specific direction on a surface of an intermediate transfer foil does not satisfy the above range (B), it is difficult for the display member to display a related image similar to a related image displayed by a display member that satisfies both the ranges. Furthermore, in a display member, when printed dots are not outputted at the assumed pitches c and d during formation of a print pattern, it is also difficult for the display member to display a related image similar to a related image displayed by a display member including printed dots formed at the assumed pitches c and d. Thus, falsification of the display member can be easily determined, and as a result, it is possible to better prevent falsification of the display member.

Modified Examples of Fourth Embodiment

The fourth embodiment described above may be modified as appropriate in the following manner.

The parallel line pattern may overlap the facial image 11*a* in plan view of the surface of the display member. In this case, in plan view of the surface of the display member, a portion of the parallel line pattern overlapping the background image 11*c* may differ in shape from a portion of the parallel line pattern overlapping the facial image 11*a*.

REFERENCE SIGNS LIST

10, 60, 170 . . . Display member; 10*a*, 24*a*, 122F, 125F, 171F, 172F . . . Front surface; 11, 61 . . . Face authentication image; 11*a*, 61*a* . . . Facial image; 11*b*, 61*b* . . . Related image; 11*c*, 51*a*, 61*c* . . . Background image; 11*c*1 . . . Latent image region; 12 . . . Character authentication image; 21, 121, 151, 161, 191, 241 . . . Substrate; 22 . . . Pattern layer; 22*a* . . . First print pattern; 22*a*1, 22*b*1, 123*a*1, 123*b*1 . . . Printed dot; 22*b* . . . Second print pattern, 22*c* . . . Adhesion portion; 23, 124, 181 . . . Concealing layer; 23*a*, 124*a*, 172*a*, 223*a* . . . Concealment pattern; 23*a*1, 124*a*1, 172*a*1, 251, 261 . . . Concealing portion; 23*b*, 124*b*, 181*b* . . . Transmission portion; 24, 125, 242 . . . Protective layer; 30 . . . Intermediate transfer apparatus; 31 . . . Ink ribbon conveyance section; 31*a*, 32*a* . . . Feed roller; 31*b*, 32*b* . . . Take-up roller; 31*c*, 32*d* . . . Conveying roller; 32 . . . Transfer foil conveyance section; 32*c* . . . Platen roller; 33 . . . Thermal head; 34 . . . Stage; 35 . . . Heat roller; 36 . . . Control section; 36*a* . . . Information generation section; 36*b* . . . Formation control section; 36*c* . . . Ribbon conveyance control section; 36*d* . . . Transfer foil conveyance control section; 36*e* . . . Transfer control section; 36*f* . . . Storage section; 41 . . . Ink ribbon; 42, 231 . . . Intermediate transfer foil; 51 . . . Print image; 122 . . . Adhesive layer; 123*a* . . . First image pattern; 123*b* . . . Second image pattern; 123R1 . . . First region; 123R2 . . . Second region; 125*a*, 182*a* . . . Diffraction portion; 125R, 172R . . . Back surface; 150, 190 . . . Passport; 160 . . . ID card; 171 . . . Information sheet; 172 . . . Verification sheet; 182 . . . Diffraction layer; 243 . . . Relief layer; 244 . . . First reflective layer; 245 . . . Mask layer; 246 . . . Second reflective layer; 247 . . . Image receiving layer; 250, 260 . . . Parallel line pattern; 251*a*, 251*a*1, 251*a*2, 261*a* . . . Pixel; all . . . Concealing element; P . . . Image cell; D1 . . . First dot; D2 . . . Second dot; D3 . . . Third dot; D4 . . . Fourth dot; P1 . . . First cell region; P2 . . . Second cell region; DG2 . . . Second dot group; DG3 . . . Third dot group; PU1 . . . First cell unit; PU2 . . . Second cell unit; PU3 . . . Third cell unit.

What is claimed is:

1. A display member comprising:

a substrate, an adhesive layer, a concealing layer, and a protective layer, which are laminated in this order, wherein:

a surface of the protective layer facing away from the concealing layer is an observation surface; a surface of the adhesive layer facing towards the concealing layer comprises a first image pattern and a second image pattern;

the first image pattern displays, through the observation surface, a first image including one or more first information elements identifying an owner of the display member;

the second image pattern contains one or more second information elements, a part of the second image pattern restricting identification of the one or more second information elements, the second image pattern includes a second image that differs from the first image and that is identifying the owner of the display member;

the concealing layer comprises a concealment pattern overlapping with at least the part of the second image pattern; the concealment pattern removes a restriction on identification of the one or more second information elements by concealing the part of the second image pattern from being displayed through the observation surface, wherein the second image pattern comprises a first image comprising a plurality of colors; wherein, the first image is observed through the concealing layer as a second image comprising a plurality of colors, and wherein the second image differs from the first image in a color tone.

2. The display member of claim 1, further comprising a diffraction portion that is located between the concealment pattern and the observation surface, and has asperities and is configured to emit diffracted light.

3. The display member of claim 2, wherein in plan view of the observation surface, the diffraction portion covers at least a part of at least one of the first image pattern and the concealment pattern.

4. The display member of claim 1, wherein the concealment pattern is formed of metal.

5. The display member of claim 1, wherein at least one of the first image pattern and the second image pattern includes overlapping dots in which a plurality of printed dots overlap each other.

6. The display member of claim 1, wherein:

the concealment pattern includes a plurality of concealing portions having a dot shape or a line shape; and the concealing portions are arranged at regular intervals in an arrangement direction.

7. The display member of claim 1, wherein the protective layer contains on a surface facing towards the concealing layer a first diffraction portion and a second diffraction portion, wherein the first diffraction overlaps with the first image pattern in a plan view of the observation surface, and the second diffraction portion overlaps with the concealment pattern in the plan view of the observation surface.

8. The display member of claim 7, wherein at least one of the first diffraction portion and the second diffraction portion is a hologram.

9. The display member of claim 1, wherein the protective layer is a transparent layer comprising a photocurable resin, a thermosetting resin, or a thermoplastic resin.

10. The display member of claim 1 consisting of the substrate, the adhesive layer, the concealing layer, and the protective layer laminated in this order.

11. The display member of claim 1, wherein the first image pattern comprises a plurality of printed dots, each formed of an ink and each having a single color and wherein the second image pattern comprises a plurality of printed dots, each formed of an ink, the printed dots of the second image pattern have two or more colors.

12. A booklet comprising the display member of claim 1.

13. An ID card comprising the display member of claim 1.

* * * * *